US011083250B2

(12) United States Patent
Mowad

(10) Patent No.: US 11,083,250 B2
(45) Date of Patent: Aug. 10, 2021

(54) BELT BUCKLE HAVING LIGHT AND ITEM SEPARATION ALARM CIRCUIT

(71) Applicant: Antoine Mowad, Waterbury, CT (US)

(72) Inventor: Antoine Mowad, Waterbury, CT (US)

( * ) Notice: Subject to any disclaimer, the term of this patent is extended or adjusted under 35 U.S.C. 154(b) by 0 days.

(21) Appl. No.: 16/677,547

(22) Filed: Nov. 7, 2019

(65) Prior Publication Data

US 2021/0137221 A1 May 13, 2021

(51) Int. Cl.

| | |
|---|---|
| ***A44B 11/12*** | (2006.01) |
| ***A44B 11/00*** | (2006.01) |
| ***G08B 21/18*** | (2006.01) |

(52) U.S. Cl.

CPC ..... *A44B 11/005* (2013.01); *A44B 11/12* (2013.01); *G08B 21/18* (2013.01)

(58) Field of Classification Search

CPC .. A41F 9/002; Y10T 24/4072; Y10T 24/4016; Y10T 24/40; A44B 11/12; A44B 11/125

See application file for complete search history.

(56) References Cited

U.S. PATENT DOCUMENTS

| | | | | |
|---|---|---|---|---|
| 3,884 | A | 1/1845 | Beverly | |
| 238,247 | A | 3/1881 | Parsons | |
| 361,166 | A | 4/1887 | Lewis et al. | |
| 1,262,773 | A | 4/1918 | Gillan | |
| 1,438,898 | A | 12/1922 | Carpmill | |
| 3,402,439 | A | 9/1968 | Currat | |
| 3,636,596 | A | 1/1972 | Iizuka | |
| 4,669,155 | A | 6/1987 | Chen | |
| 5,577,300 | A * | 11/1996 | Gutrugianios | A44B 11/12 24/170 |
| 6,331,817 | B1 | 12/2001 | Goldberg | |
| 6,715,449 | B1 | 4/2004 | Jordan | |
| 7,106,191 | B1 | 9/2006 | Liberati | |
| 7,377,665 | B2 | 5/2008 | Langenwalter | |
| 8,094,011 | B2 | 1/2012 | Faris et al. | |

(Continued)

OTHER PUBLICATIONS

"Skin-touch-actuated textile-based triboelectric nanogenerator with black phosphorus for durable biomechanical energy harvesting", by Jiaqing Xiong et al., published by Nature Communications, Publication Date: Oct. 15, 2018 "Triboelectric nanogenerators for next-generation wearable health monitoring", by Michael Berger, published by Nanowerk, Publication Date: Apr. 12, 2019.

*Primary Examiner* — Robert Sandy
*Assistant Examiner* — Michael S Lee
(74) *Attorney, Agent, or Firm* — Raymond A. Nuzzo

(57) ABSTRACT

A belt buckle has a pivoting member pivotally attached to a pair of opposing sidewalls at a predetermined position so as to provide a space between the pivoting member and a belt-receiving surface of the belt buckle. The pivoting member is pivotable to a first position wherein the pivoting member contacts a movable belt section of a belt that is positioned on the belt-receiving surface and between the opposing sidewalls so as to prevent movement of the movable belt section in a direction that would cause loosening of the belt. The belt buckle is configured to allow a user to select the side of the belt that will be visible and the side of the belt that will face the user's waist. In some embodiments, the belt buckle includes a built-in light assembly, an item separation alarm circuit and a compass.

10 Claims, 53 Drawing Sheets

(56) References Cited

U.S. PATENT DOCUMENTS

| | | | | |
|---|---|---|---|---|
| 8,102,316 | B1 | 1/2012 | Brucker et al. | |
| 8,810,392 | B1 | 8/2014 | Teller et al. | |
| 9,489,821 | B2 | 11/2016 | King et al. | |
| 9,710,082 | B2 | 7/2017 | Liu et al. | |
| 9,779,612 | B2 | 10/2017 | Darval et al. | |
| 10,085,519 | B1 | 10/2018 | Mowad | |
| 2002/0035767 | A1 | 3/2002 | Sekanina | |
| 2010/0214095 | A1 | 8/2010 | Davide | |
| 2018/0000202 | A1* | 1/2018 | Fukui | A41F 9/002 |
| 2019/0082796 | A1* | 3/2019 | Chen | A44B 11/2588 |

* cited by examiner

BELT BUCKLE HAVING LIGHT AND ITEM SEPARATION ALARM CIRCUIT

CROSS-REFERENCE TO RELATED APPLICATIONS

None.

FIELD OF THE INVENTION

The present invention generally relates to a belts and belt buckles.

BACKGROUND

Belts and belt buckles are well known in the art and have been used by people for many years to hold up pants, trousers or other clothing.

SUMMARY OF THE INVENTION

In some embodiments, the present invention is directed to a belt buckle comprising a buckle structure comprising a pair of upstanding and opposing sidewalls and a section to which an end portion (202) of a belt (200) may be attached. The belt buckle includes a pivoting member pivotally attached to the opposing sidewalls at a predetermined position such that there is a space under the pivoting member. The pivoting member comprises a body section having a longitudinally extending bore therein and a pin member disposed within the longitudinally extending bore. The pin member includes a first end that extends from the longitudinally extending bore and is pivotally attached to one of the opposing sidewalls and an opposite second end that extends from the longitudinally extending bore and is pivotally attached to the other one of the opposing sidewalls. The body section of the pivoting member comprises a first longitudinally extending generally flat side, a second longitudinally extending generally flat side that is contiguous with the first longitudinally extending generally flat side and a longitudinally extending curved side that is contiguous with both the first longitudinally extending generally flat side and the second longitudinally extending generally flat side. The first and second longitudinally extending generally flat sides and the longitudinally extending curved side form a perimeter of the body section. The pivoting member is pivotable to a first position such that the curved side frictionally contacts a movable belt section (204) of belt (200) that is positioned between the opposing sidewalls so as to prevent movement of the movable belt section (204) in a first direction (352) which would cause loosening of the belt, wherein a tensile force on the belt while the curved side is frictionally contacting the movable belt section (204) increases a degree of frictional contact between the curved side and the movable belt section (204) located between the opposing sidewalls. The pivoting member is pivotable to a second position wherein no portion of the pivoting member physically contacts the movable belt section (204) that is located between the opposing sidewalls so that there is clearance between the pivoting member and the movable belt section (204). When the pivoting member is in the first position, movement of the movable belt section (204) in an opposite second direction (350) causes the pivoting member to pivot to the second position such that the curved side of the pivoting member no longer physically contacts the movable belt section (204) that is located between the opposing sidewalls thereby providing a clearance between the pivoting member and the movable belt section (204) so as to allow the movable belt section (204) to be moved in either the first direction (352) or in the opposite second direction (350).

One important feature of the belt buckle is that the user may break the physical contact between the pivoting member and movable belt section (204) by simply moving belt section (204) in opposite second direction (350) so as to cause the pivoting member to pivot to the second position and break physical contact with movable belt section (204). As a result, there is no physical contact between the pivoting member and belt section (204). This provides a clearance between the pivoting member and belt section (204) and allows movement of belt section (204) with respect to the buckle structure of the belt buckle.

In some embodiments, the present invention is directed to a belt buckle for use with a belt (200) having a first side and an opposite second side. The belt buckle comprises a buckle structure comprising a base section having a belt-receiving surface over which a movable belt section (204) of a belt (200) may pass. The buckle structure includes a belt-retaining section that is rotatably attached to the base section. An end portion (202) of the belt (200) may be removably attached to the belt-retaining section. When the end portion (202) of the belt (200) is attached to the belt-retaining section, a user may rotate the belt-retaining section so that either the first side of the belt (200) is visible and the second side of the belt (200) faces the user's waist or the second side of the belt (200) is visible and the first side of the belt (200) faces the user's waist. The buckle structure further comprises a pair of upstanding and opposing sidewalls attached to the base section. The sidewalls are spaced apart such that the belt-receiving surface is between the sidewalls. The sidewalls are spaced apart by a predetermined distance so as to allow the movable belt section (204) to pass therebetween and over the belt-receiving surface. The belt buckle further comprises a pivoting member pivotally attached to the opposing sidewalls at a predetermined position such that there is a space between the pivoting member and the belt-receiving surface. The pivoting member comprises a body section having a longitudinally extending bore therein and a pin member disposed within the longitudinally extending bore. The pin member has a first end that extends from the longitudinally extending bore and is pivotally attached to one of the opposing sidewalls and an opposite second end that extends from the longitudinally extending bore and is pivotally attached to the other one of the opposing sidewalls. The body section comprises a first longitudinally extending generally flat side, a second longitudinally extending generally flat side that is contiguous with the first longitudinally extending generally flat side and a longitudinally extending curved side that is contiguous with both the first longitudinally extending generally flat side and the second longitudinally extending generally flat side. The first and second longitudinally extending generally flat sides and the longitudinally extending curved side form a perimeter of the body section. The pivoting member is pivotable to a first position such that the curved side frictionally contacts a movable belt section (204) of the belt (200) that is positioned over the belt-receiving surface and between the opposing sidewalls so as to prevent movement of the movable belt section (204) in a first direction (352) which would cause loosening of the belt. A tensile force on the belt, while the curved side is frictionally contacting the movable belt section (204), increases a degree of frictional contact between the curved side and the movable belt section (204) located between the opposing sidewalls. The pivoting member is pivotable to a second position wherein no portion of the pivoting member physically contacts the movable belt section (204) that is located between the opposing sidewalls so that there is clearance between the pivoting member and the movable belt section (204). Whereby, when the pivoting member is in the first position, movement of the movable belt section (204) in an opposite second direction (350) causes the pivoting member to pivot to the second position such that the curved side of the pivoting member no longer physically contacts the movable belt section (204) that is located between the opposing sidewalls thereby providing a clearance between the pivoting member and the movable belt section (204) so as to allow the movable belt section (204) to be moved in either the first direction (352) or in the opposite second direction (350).

Certain features and advantages of the present invention have been generally described in this summary section. However, additional features, advantages and embodiments are presented herein or will be apparent to one of ordinary skill of the art in view of the drawings, specification and claims hereof. Accordingly, it should be understood that the scope of the invention shall not be limited by the particular embodiments disclosed in this summary section.

BRIEF DESCRIPTION OF THE DRAWINGS

The invention will be readily understood by the following detailed description in conjunction with the accompanying drawings, wherein like reference numerals designate like structural elements, and in which.

Figure 11:
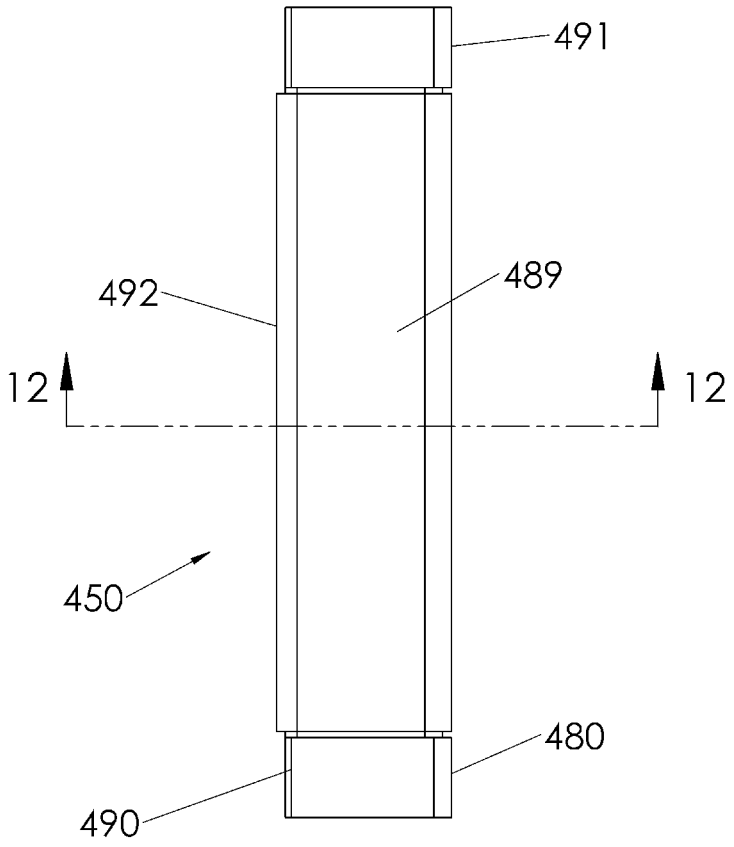
Figure 12:
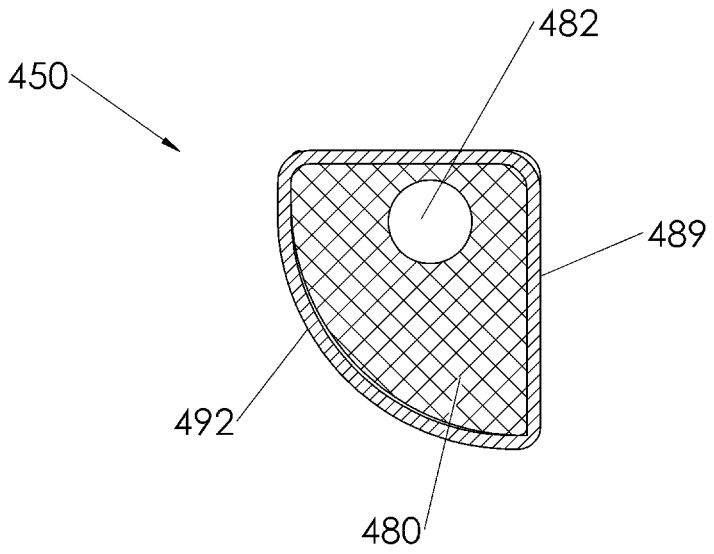
Figure 13:
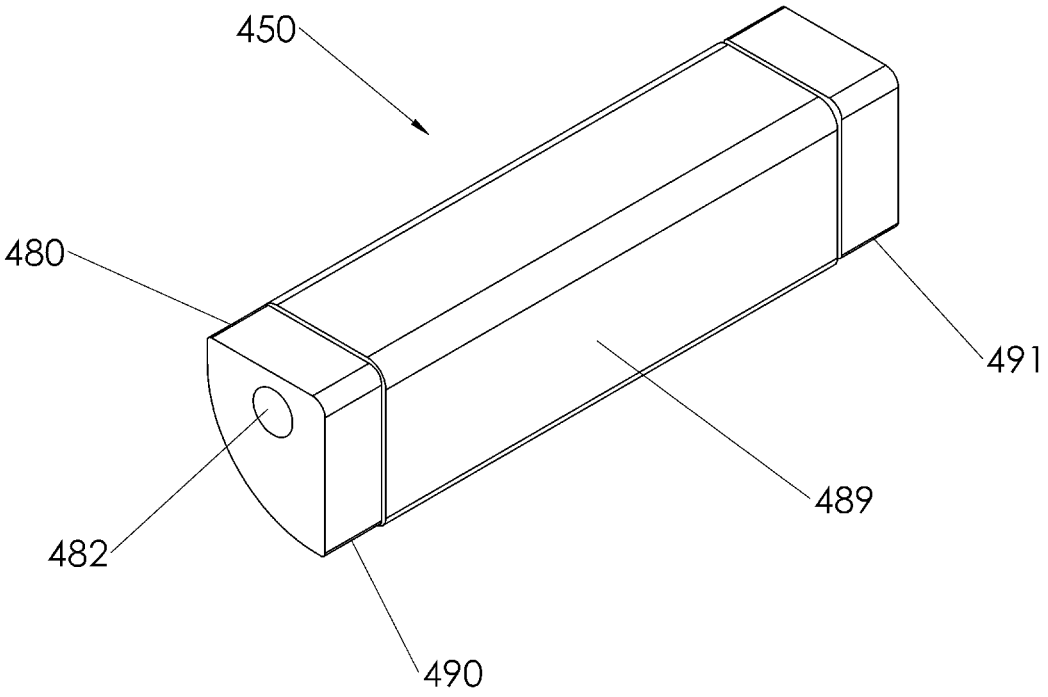
Figure 14:
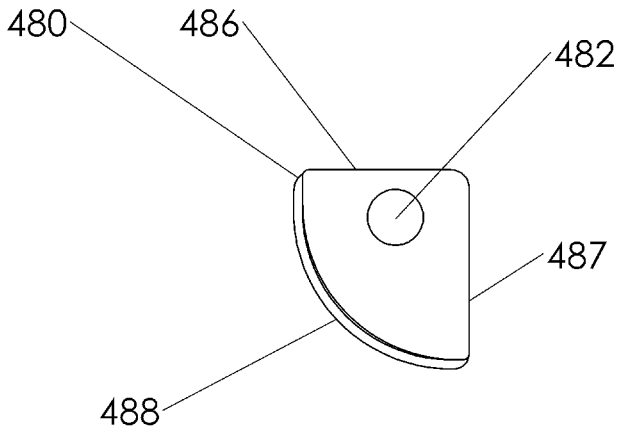
Figure 15:
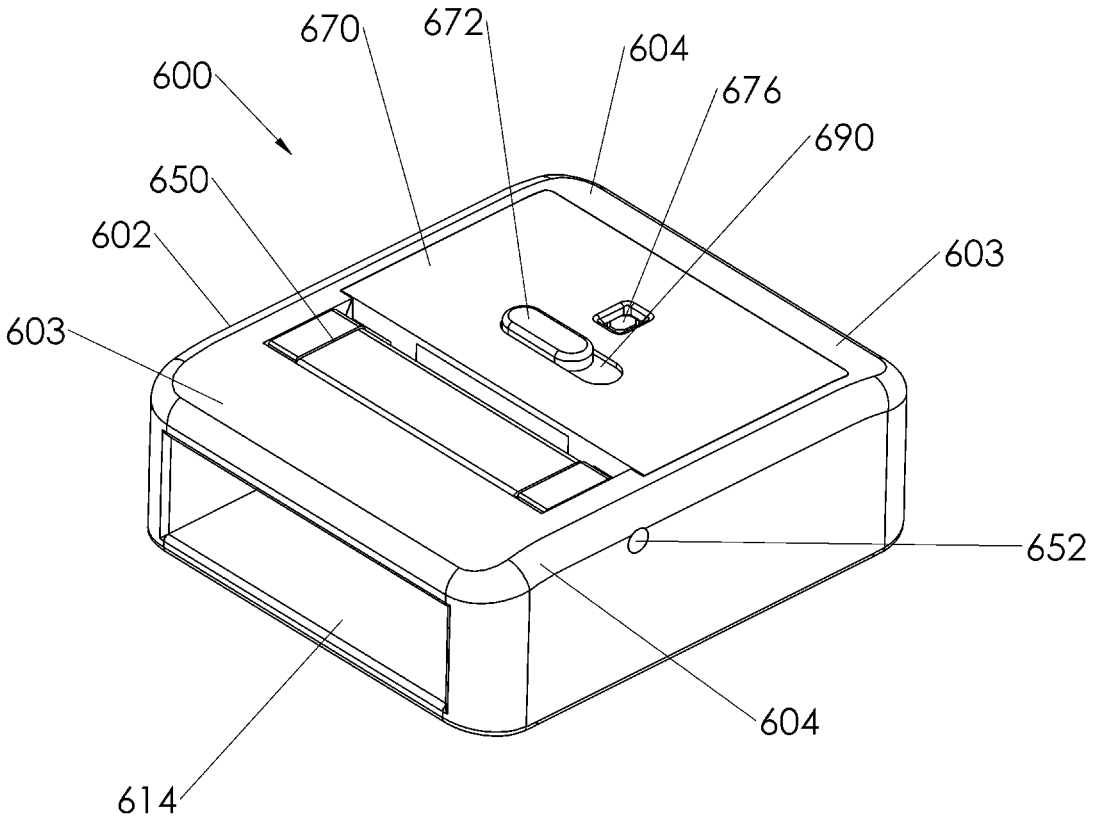
Figure 16:
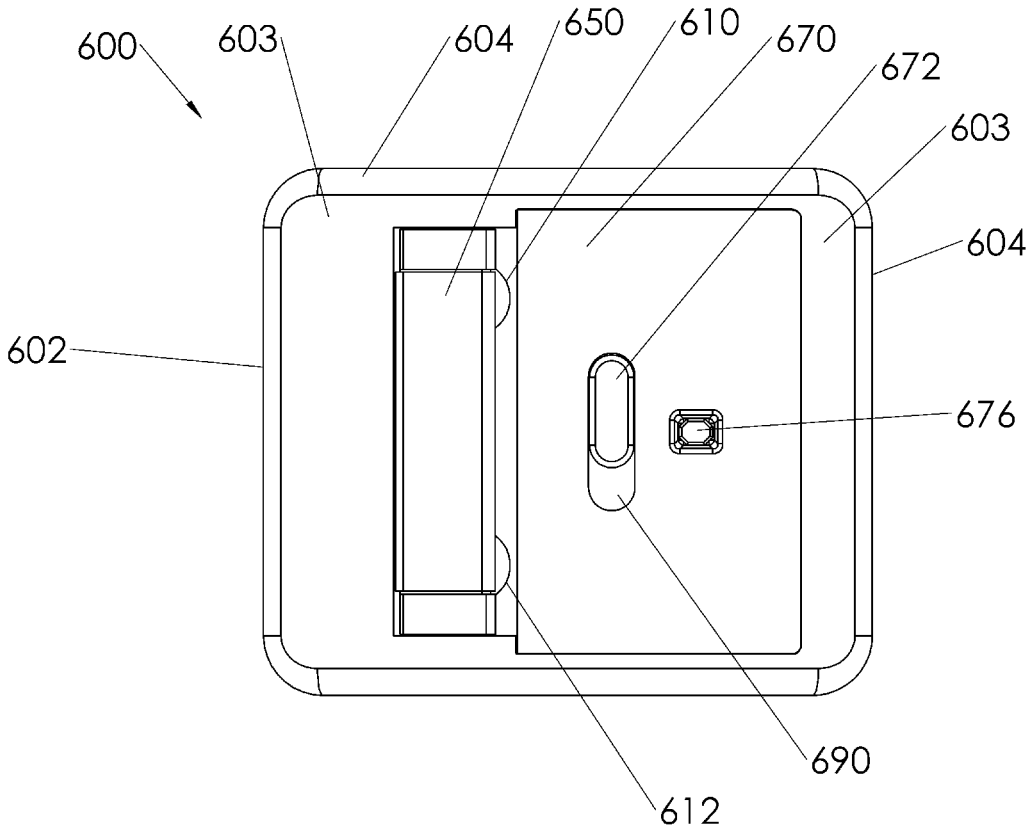
Figure 17:
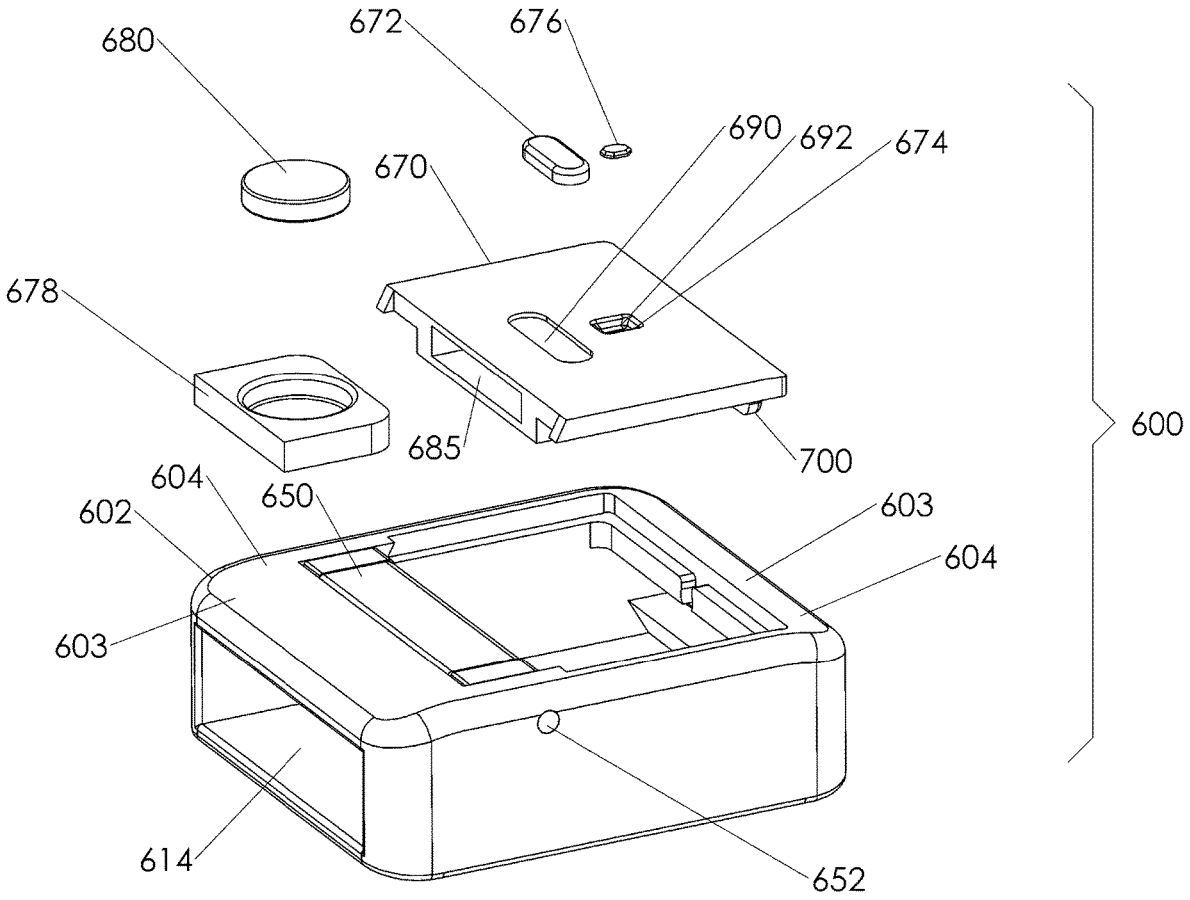
Figure 18:
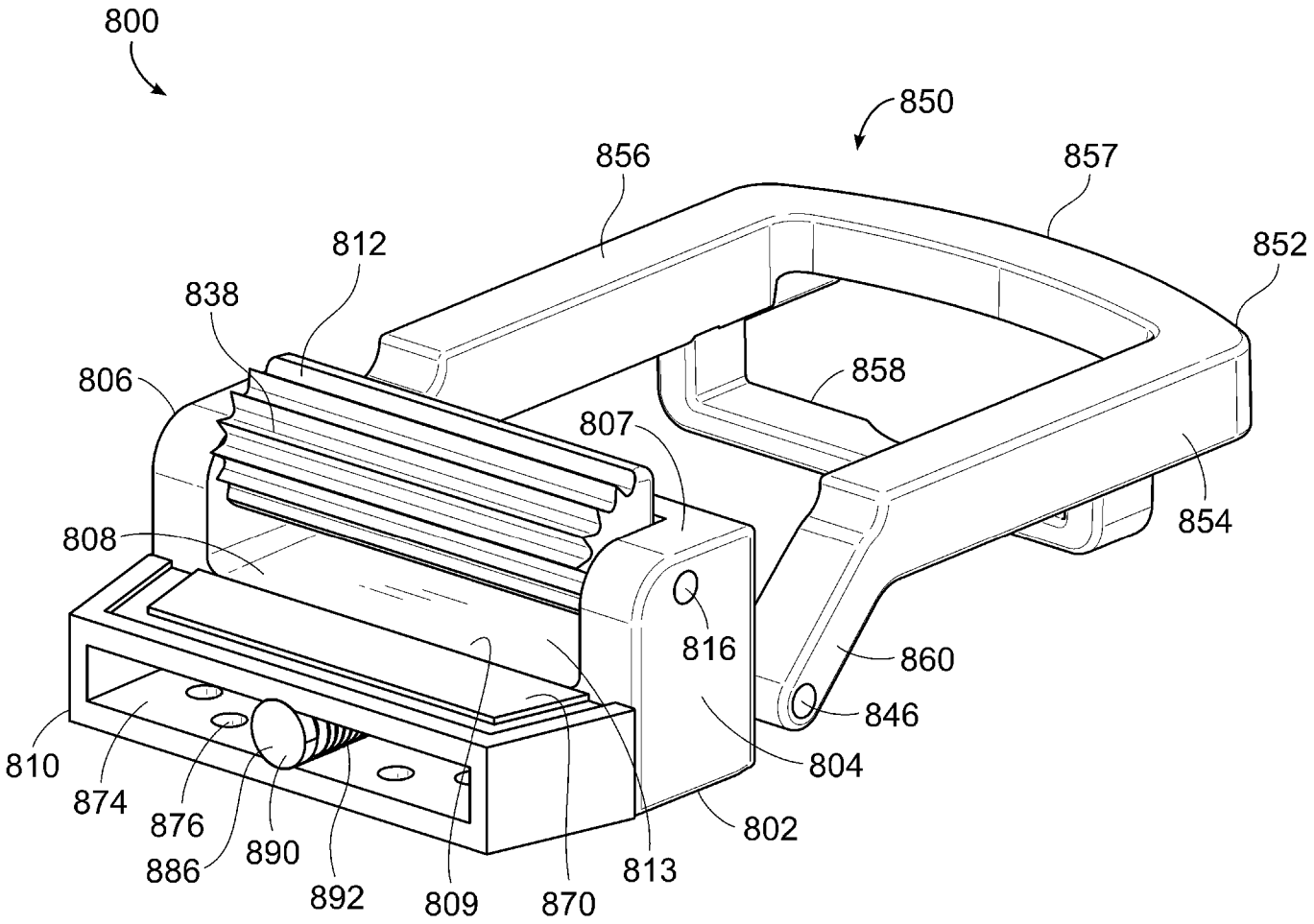
Figure 19:
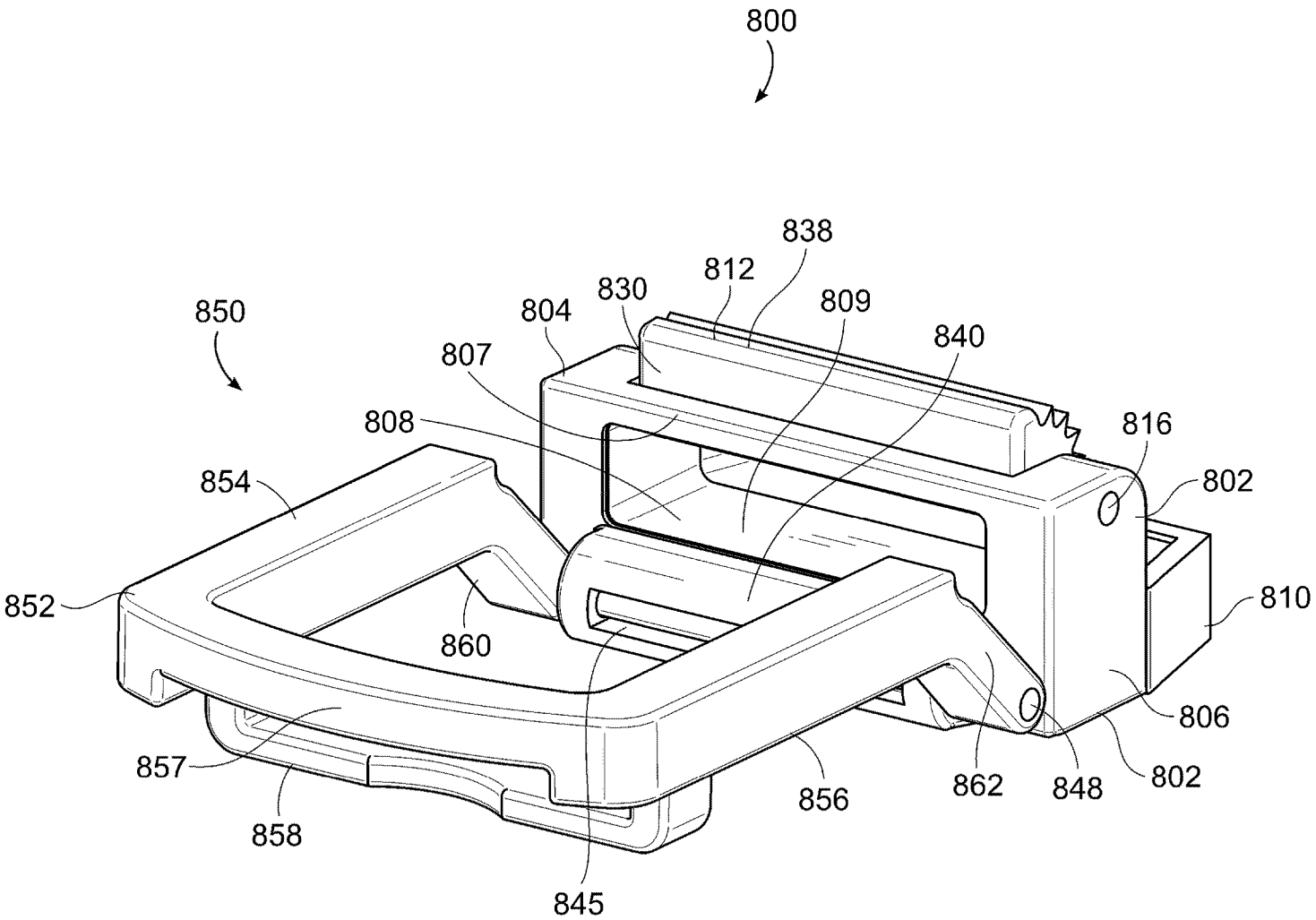
Figure 20:
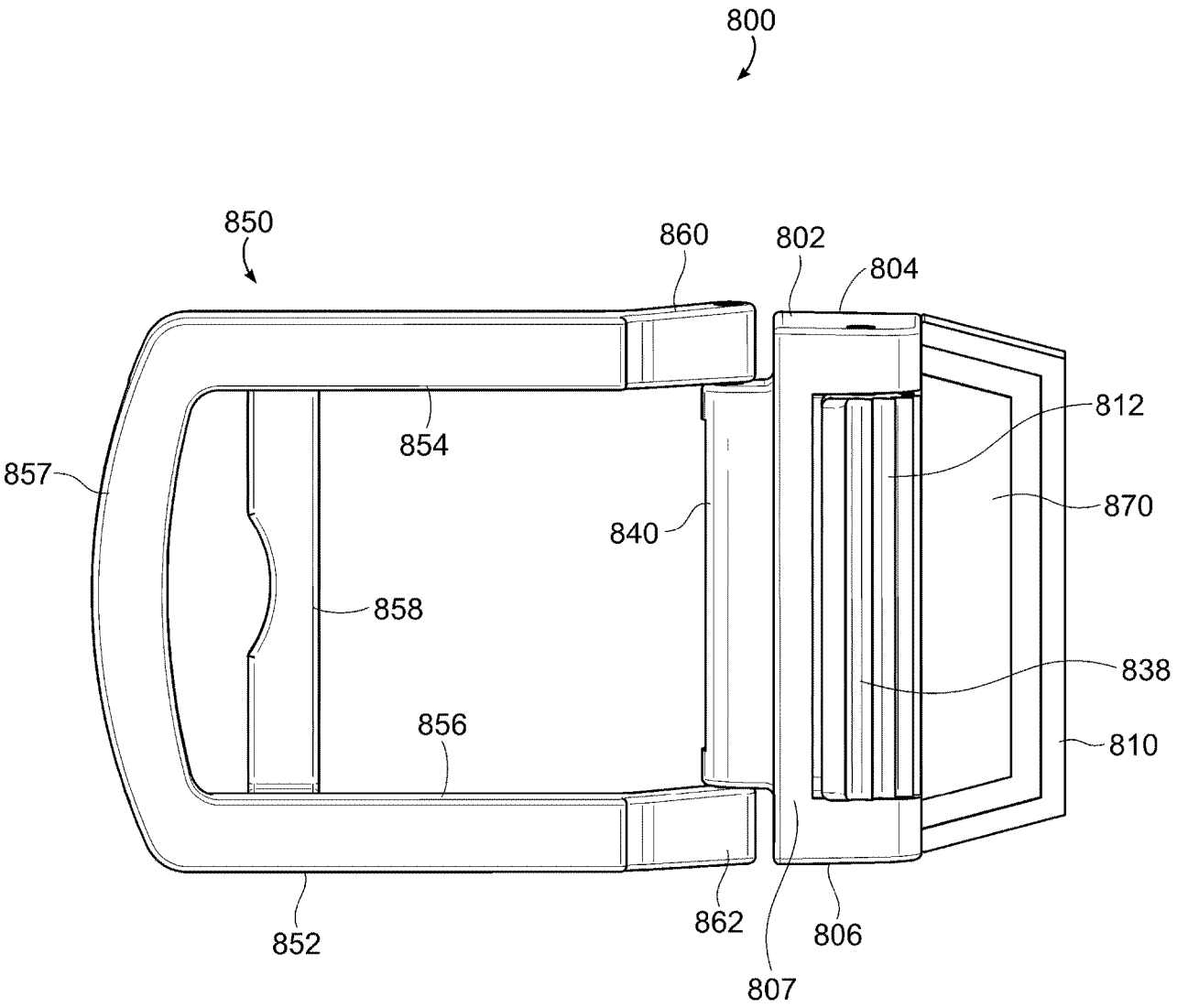
Figure 21:
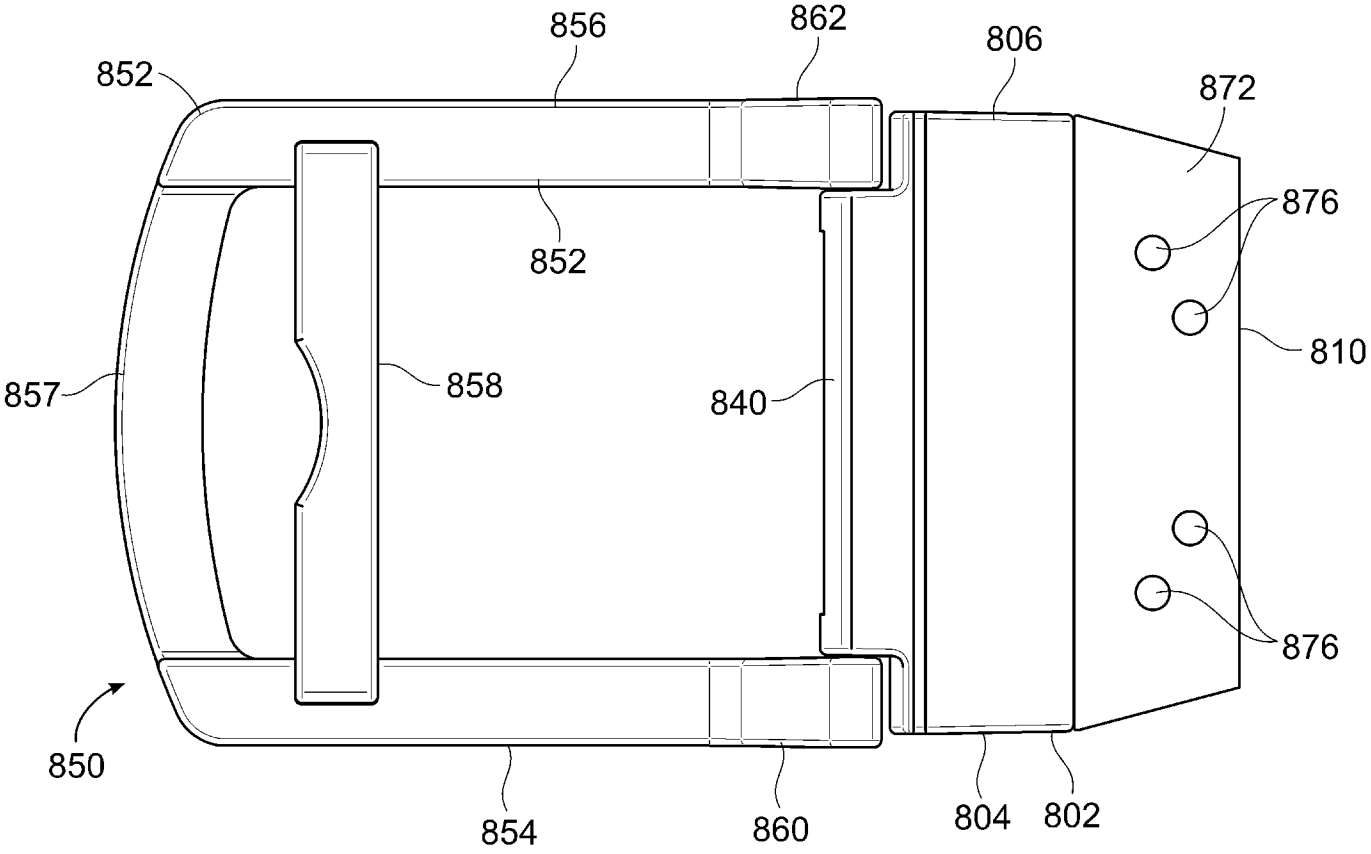
Figure 22:
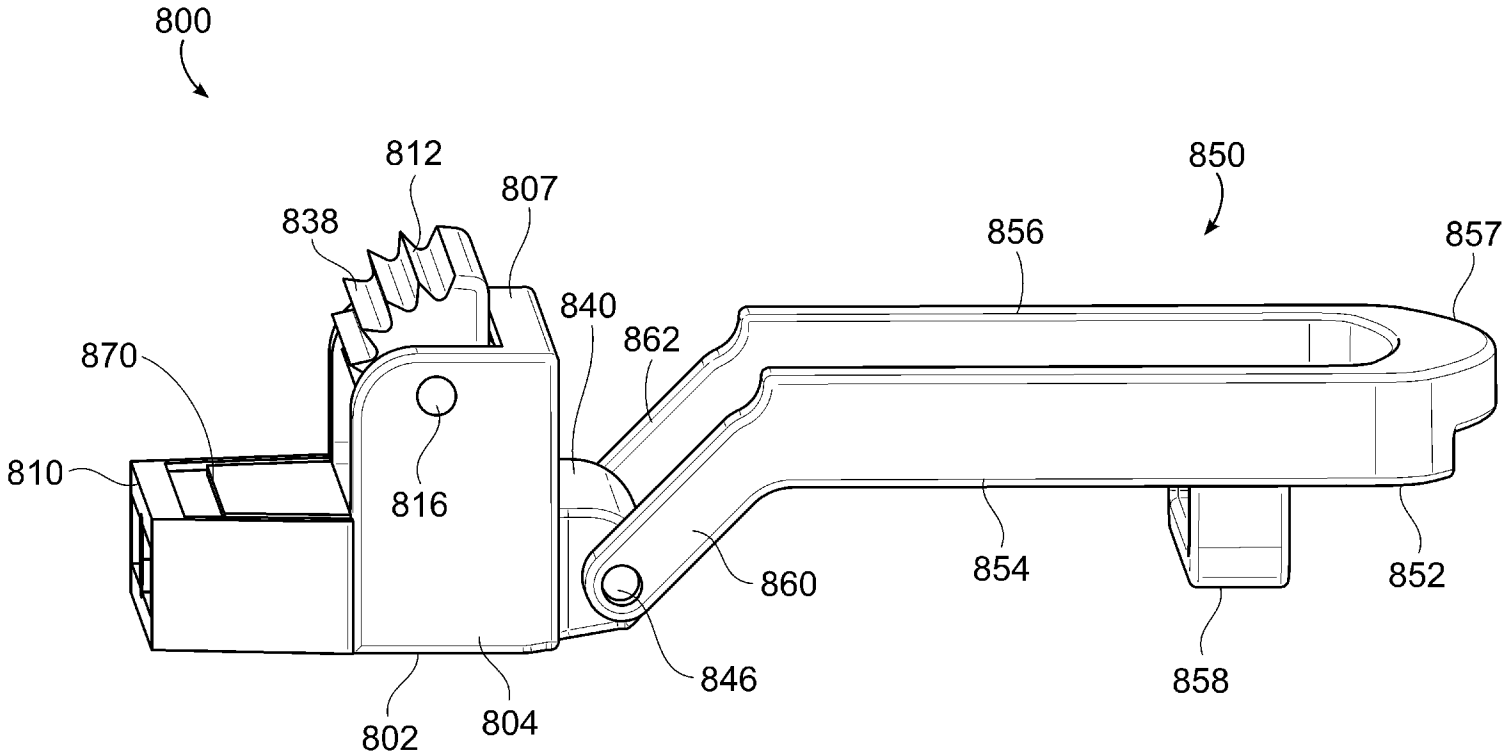
Figure 23:
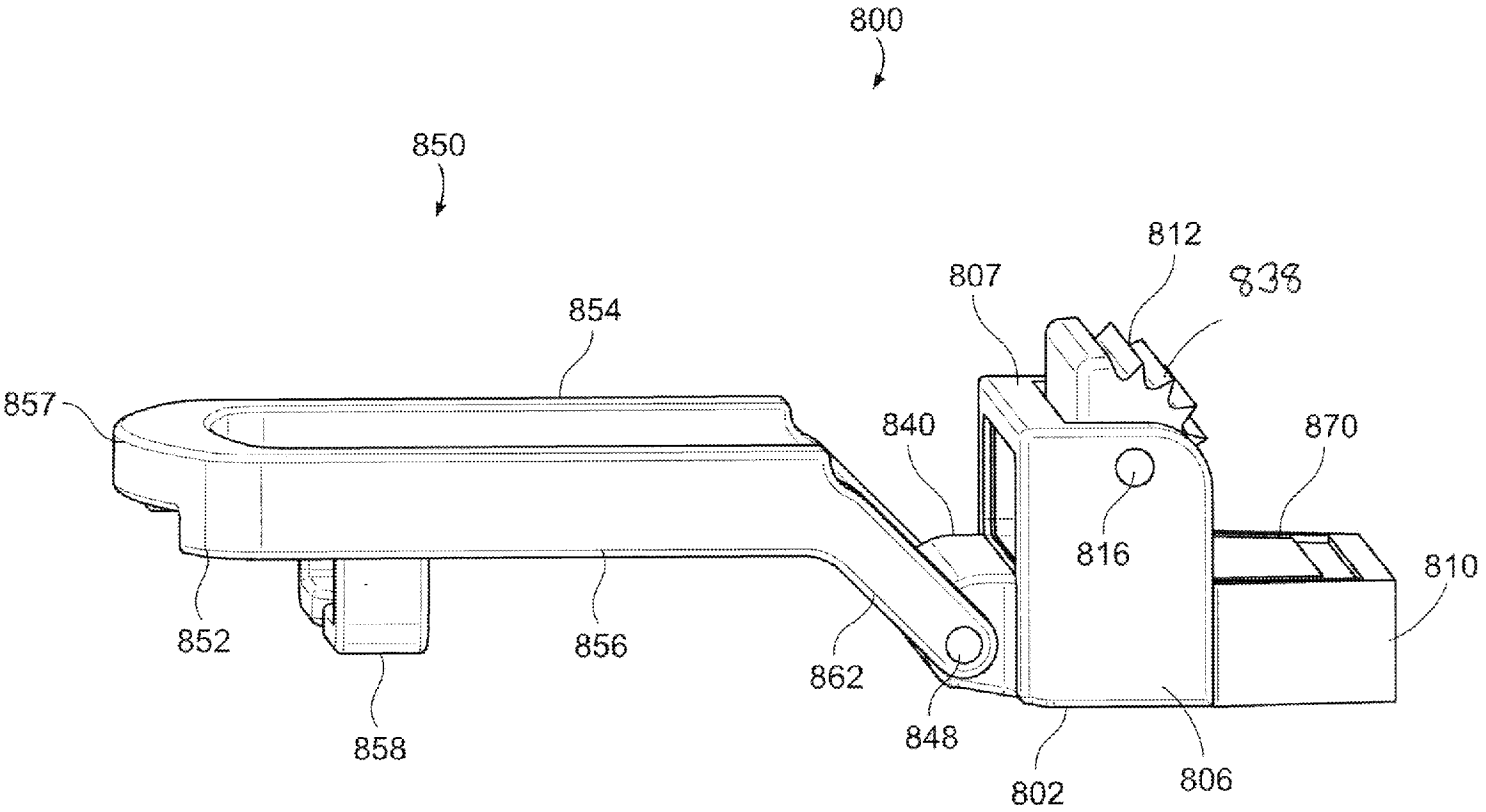
Figure 24:
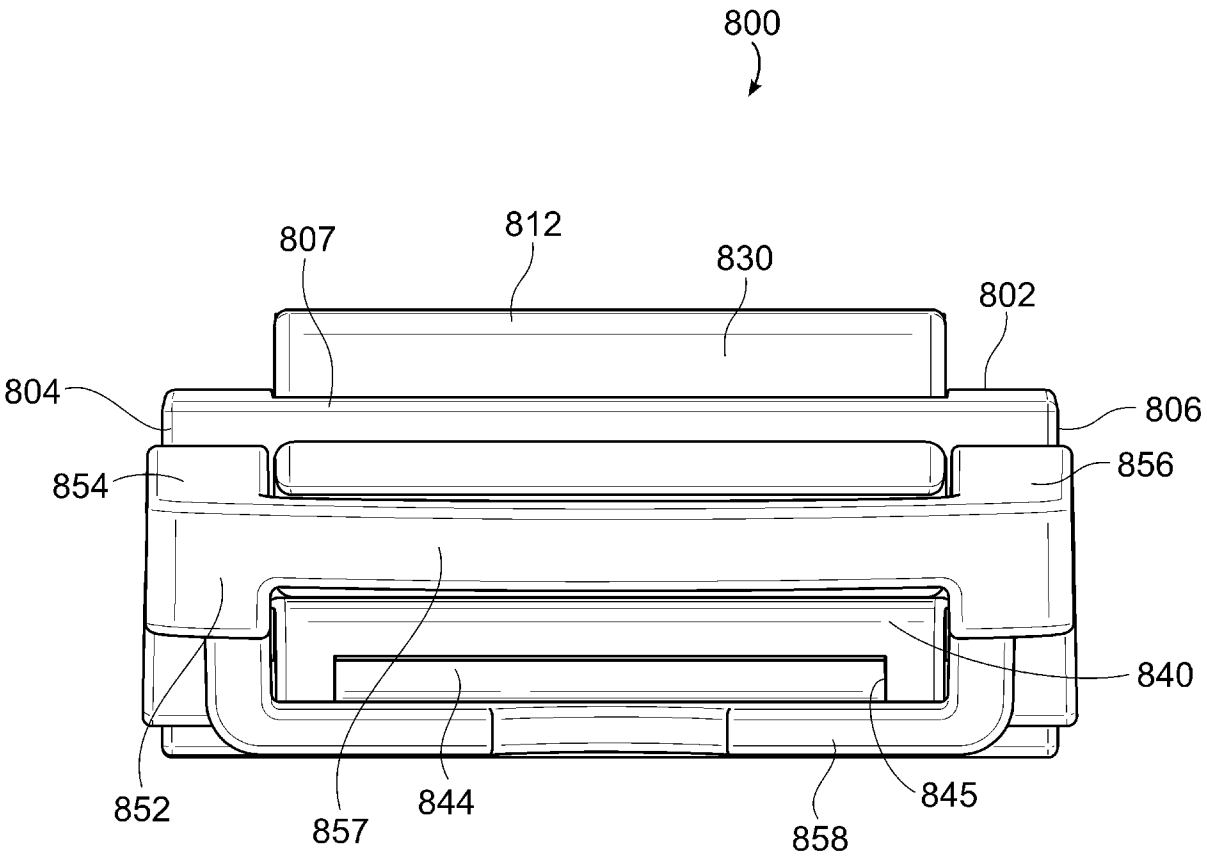
Figure 25:
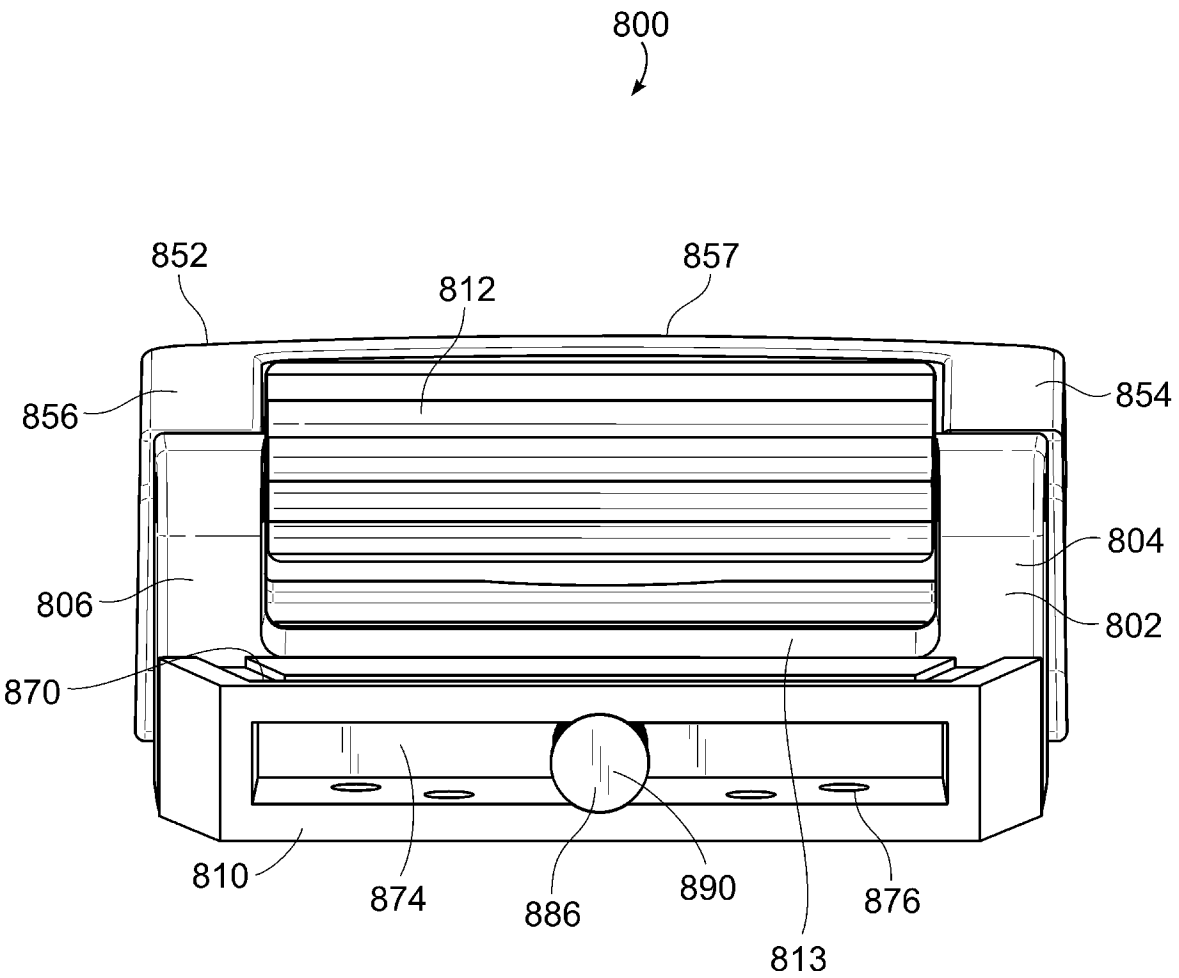
Figure 26:
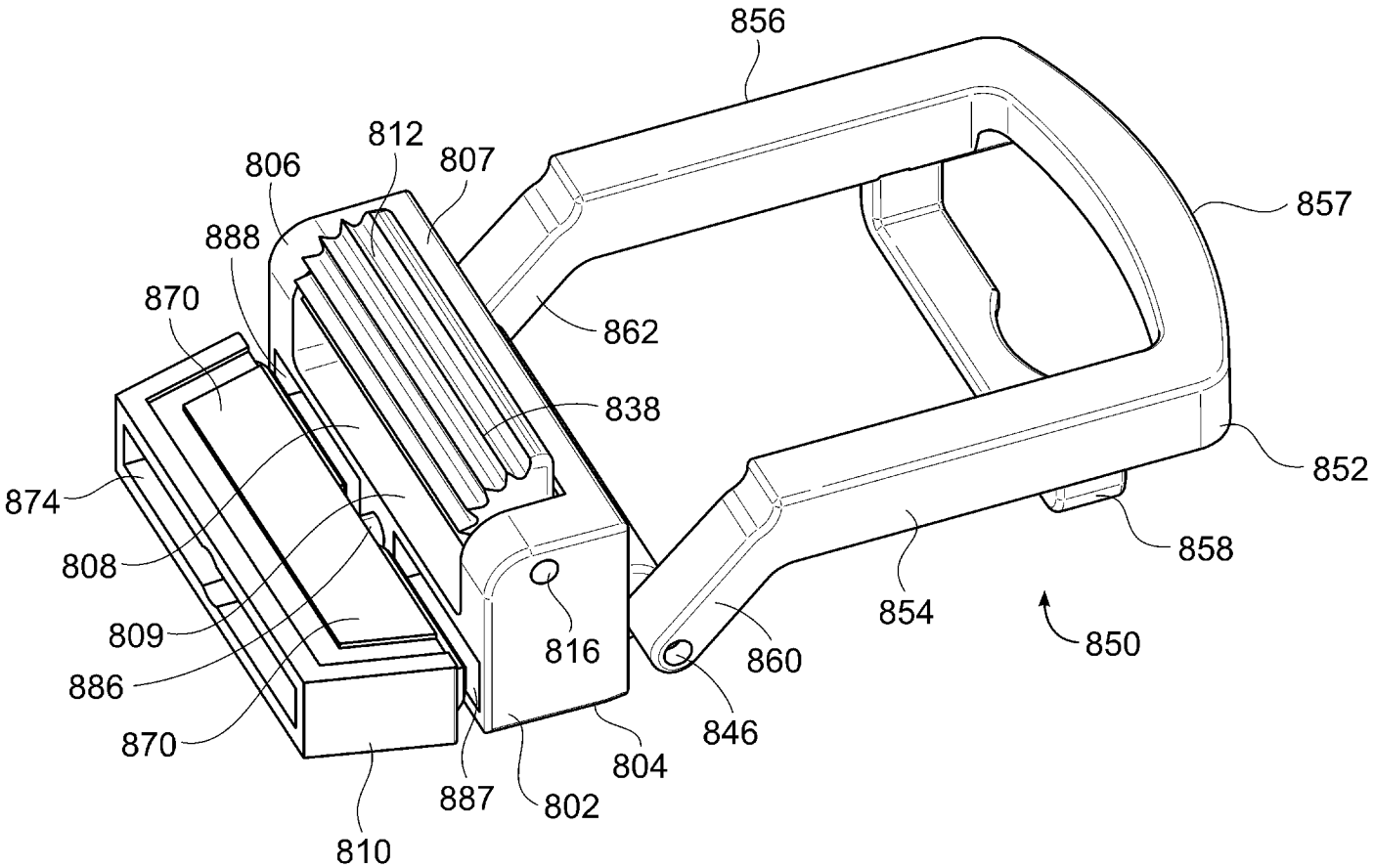
Figure 27A:
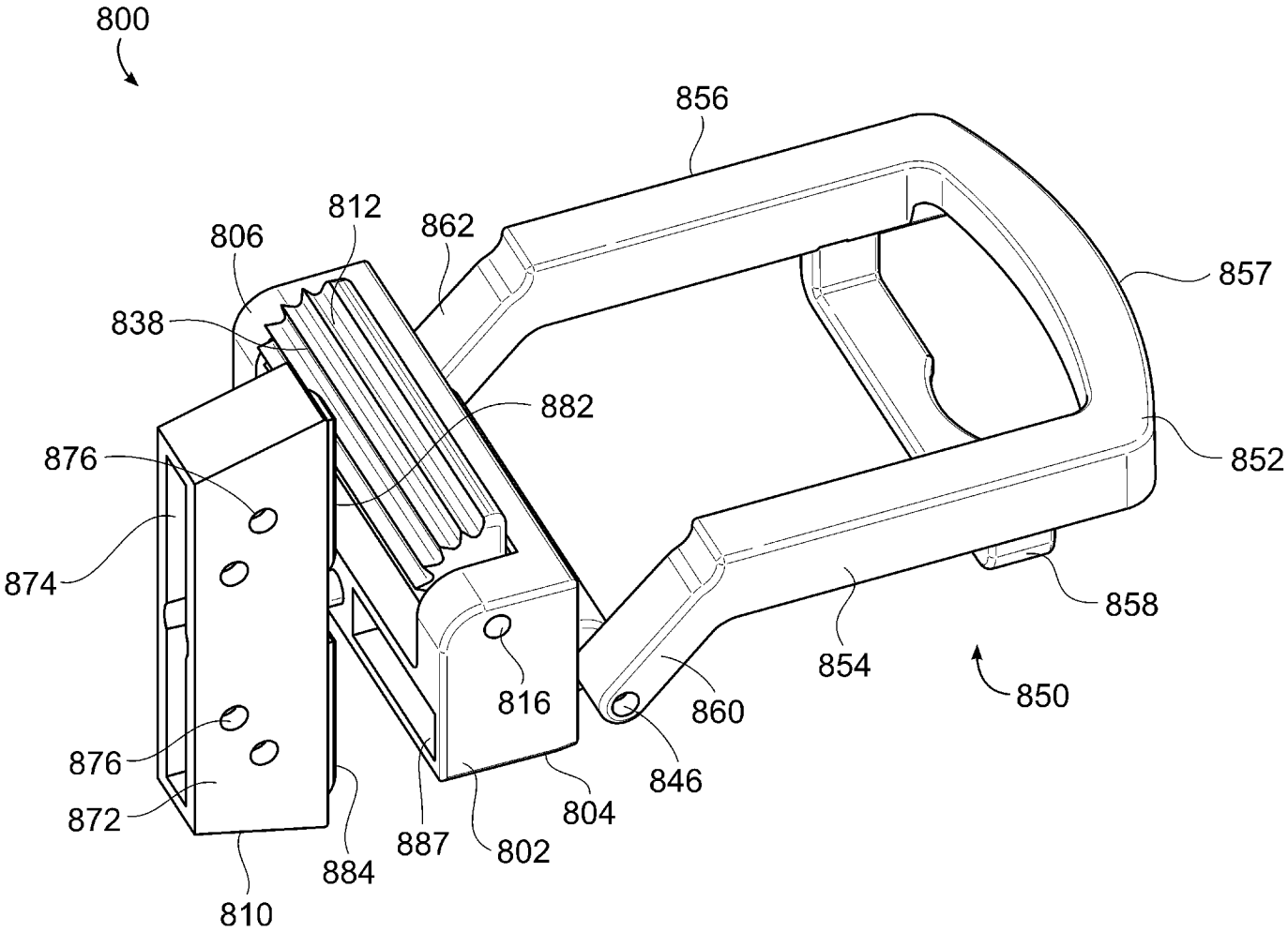
Figure 27B:
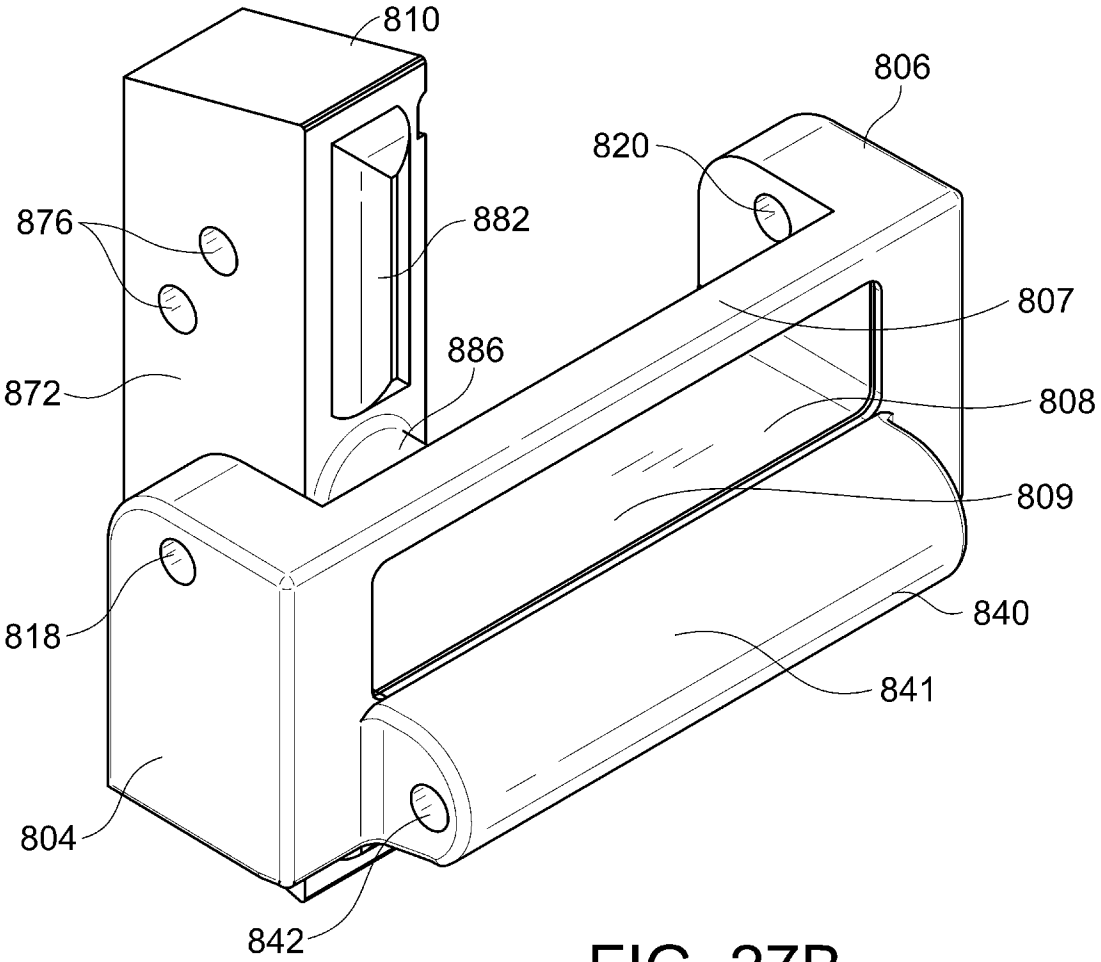
Figure 28:
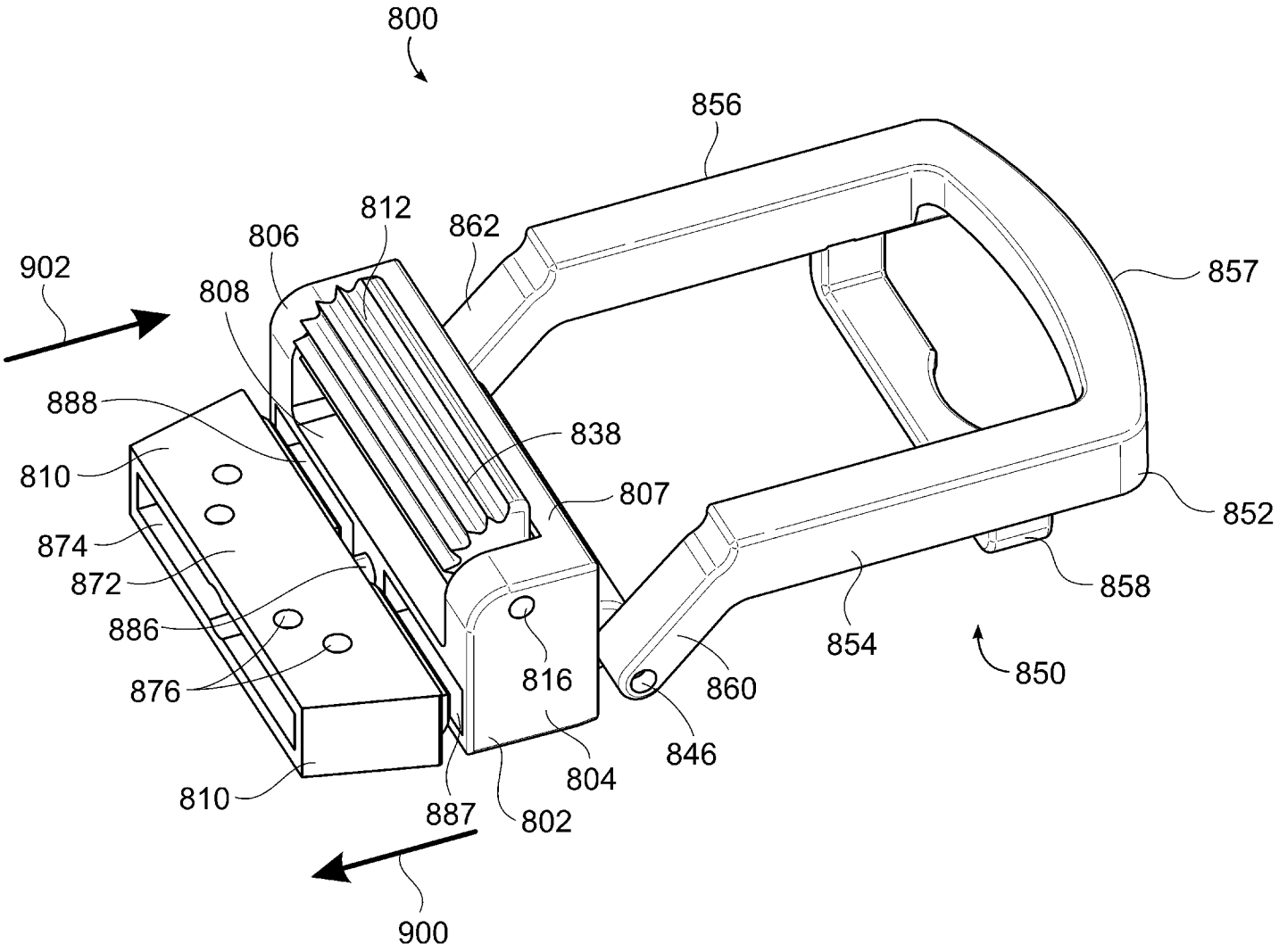
Figure 29:
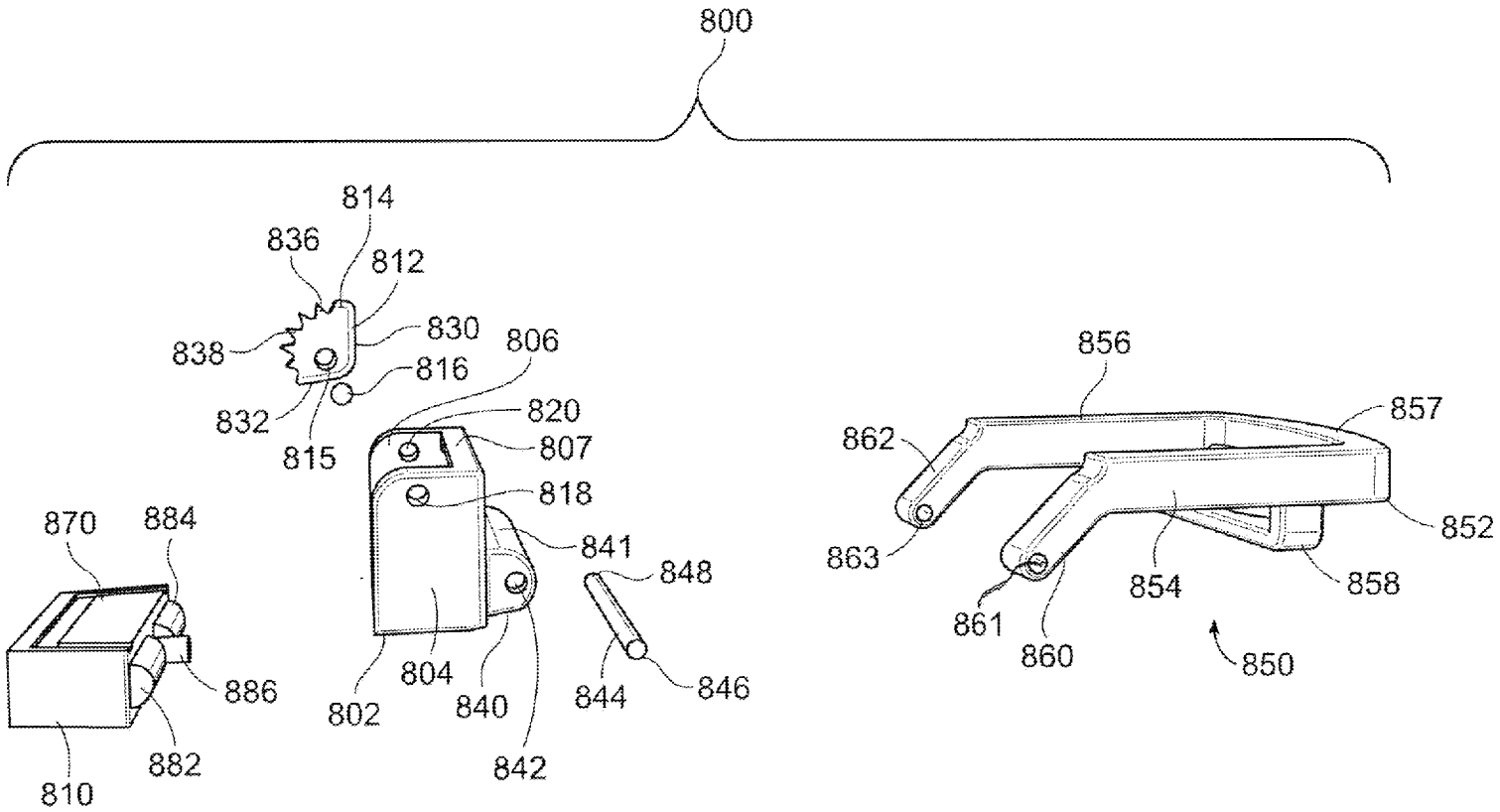
Figure 30:
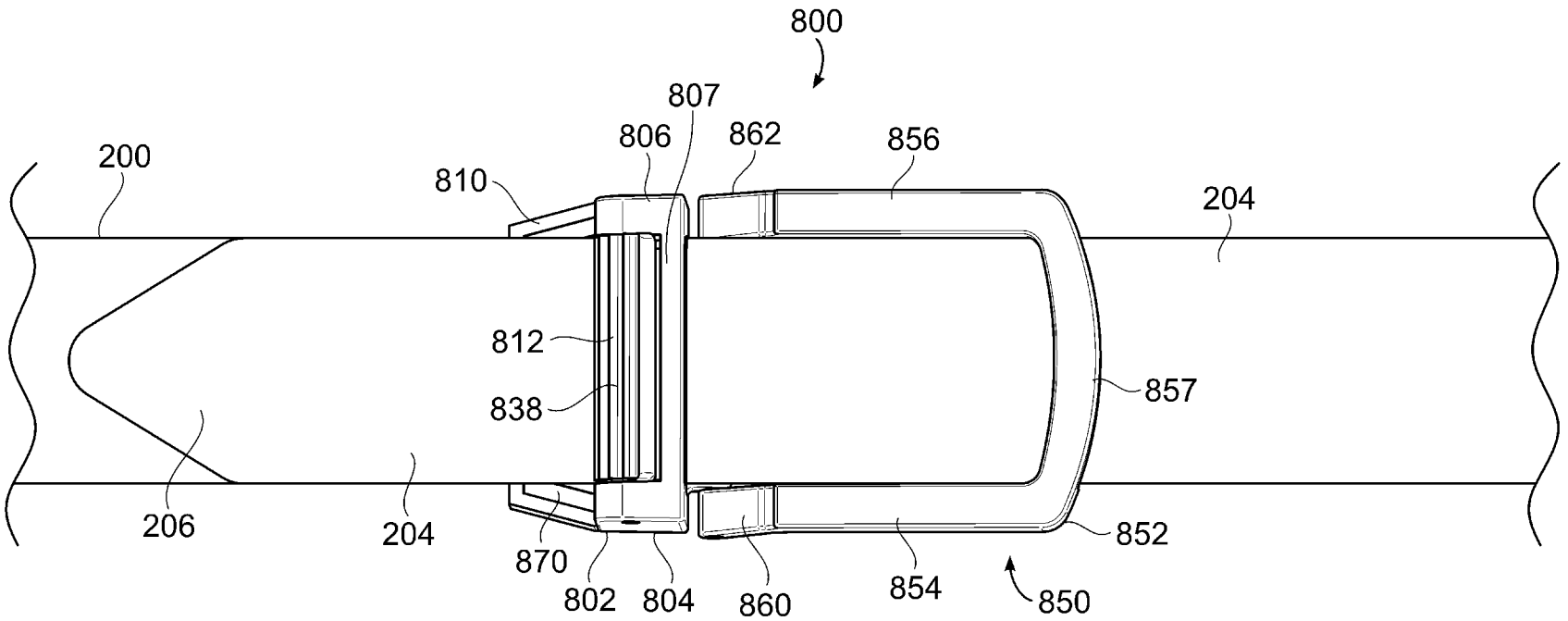
Figure 31:
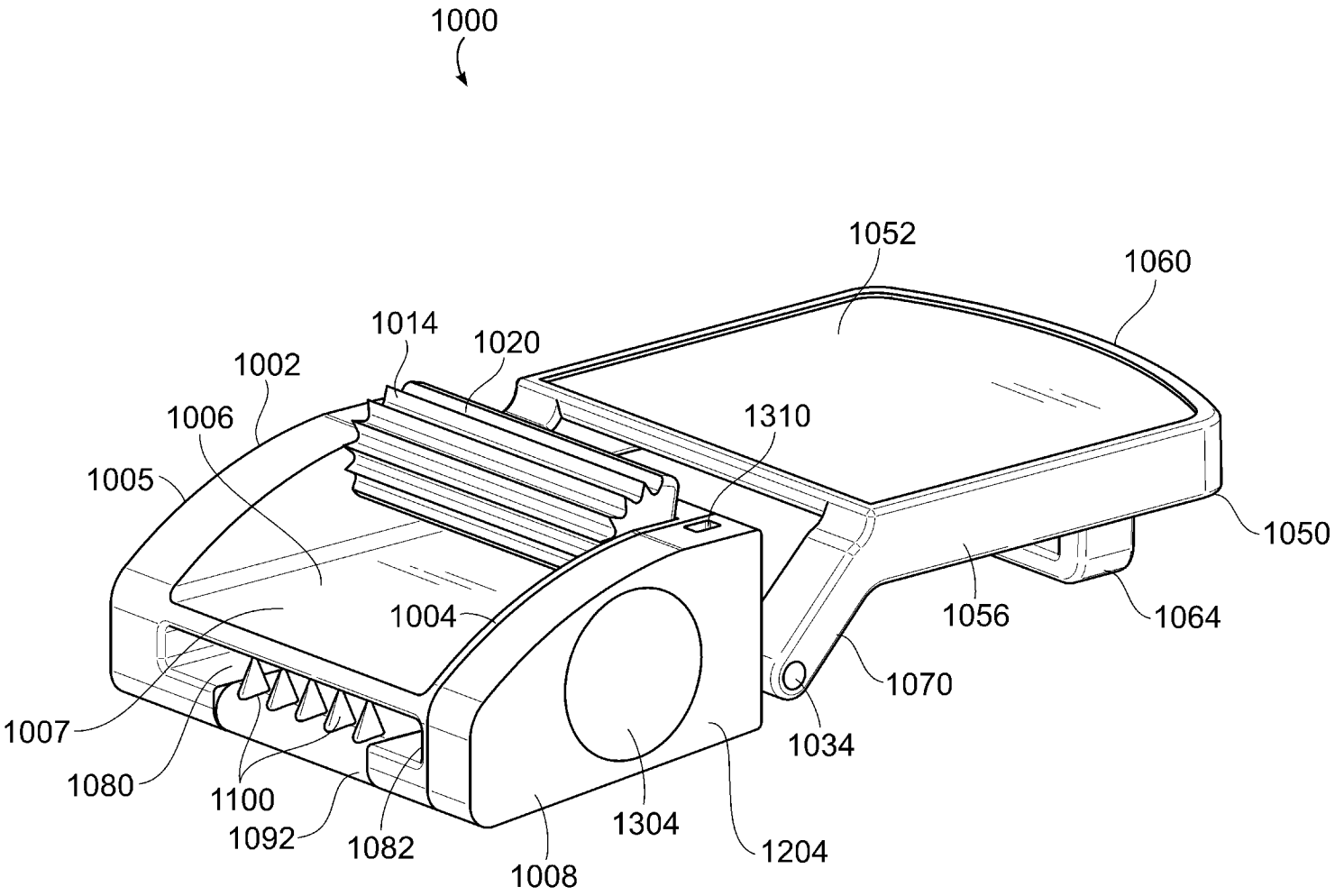
Figure 32:
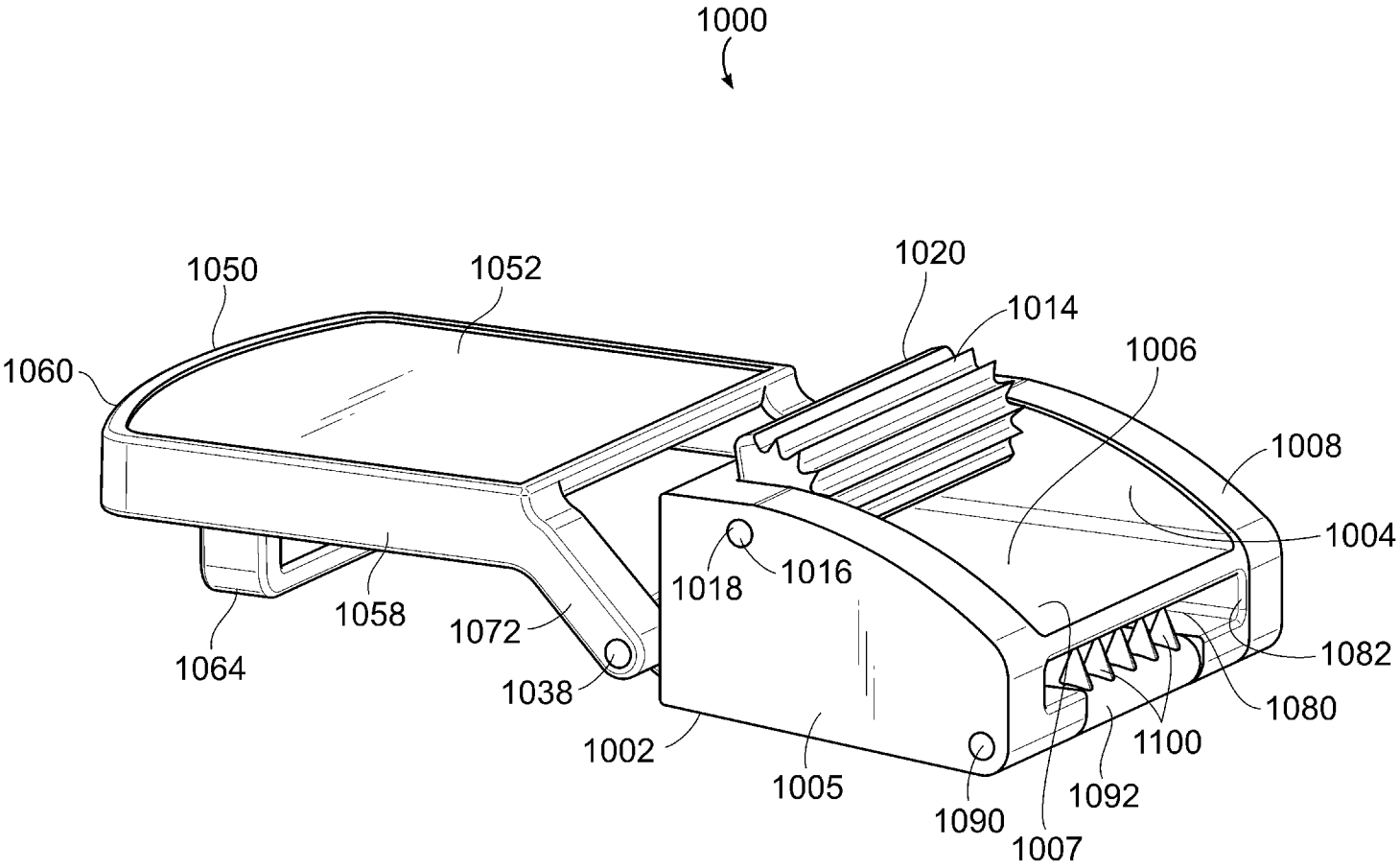
Figure 33:
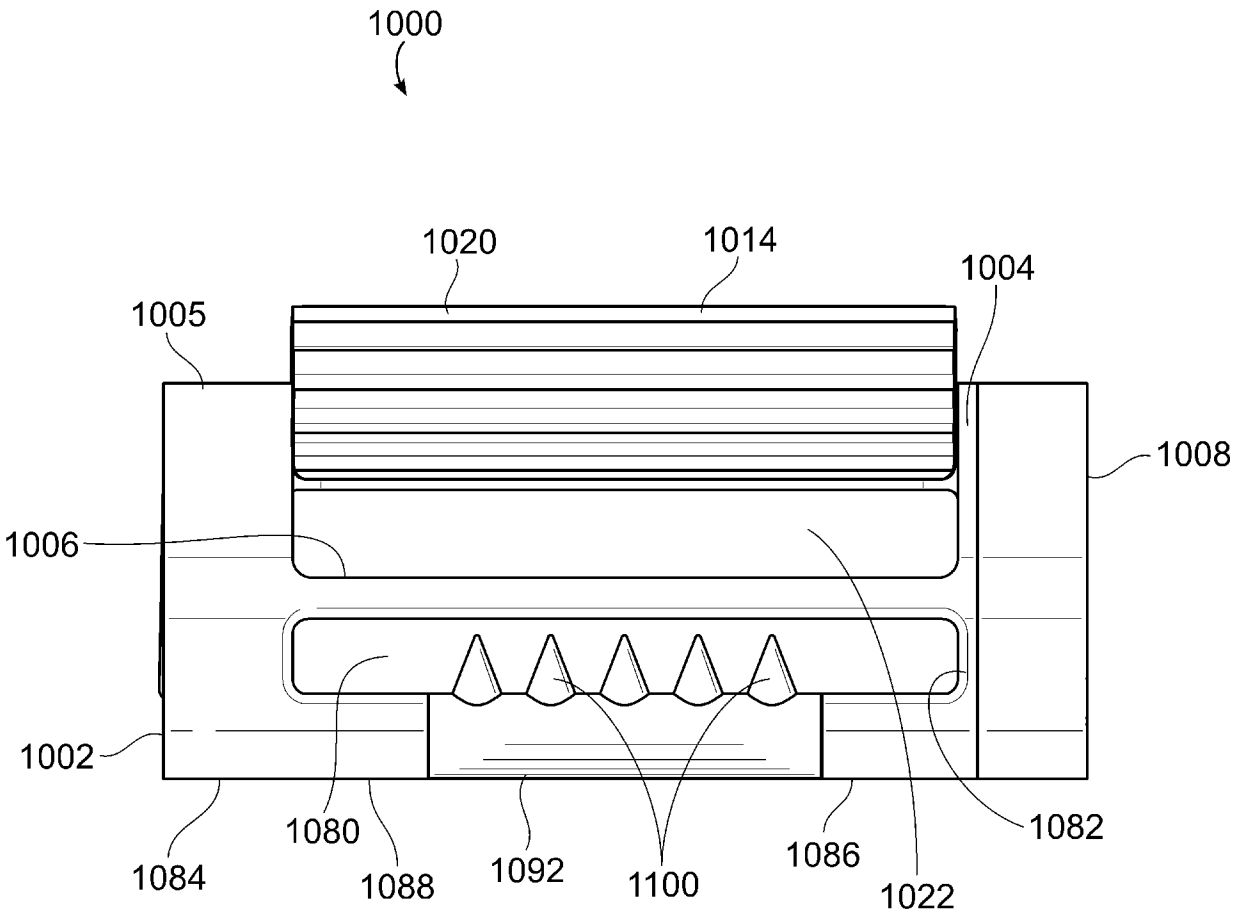
Figure 34:
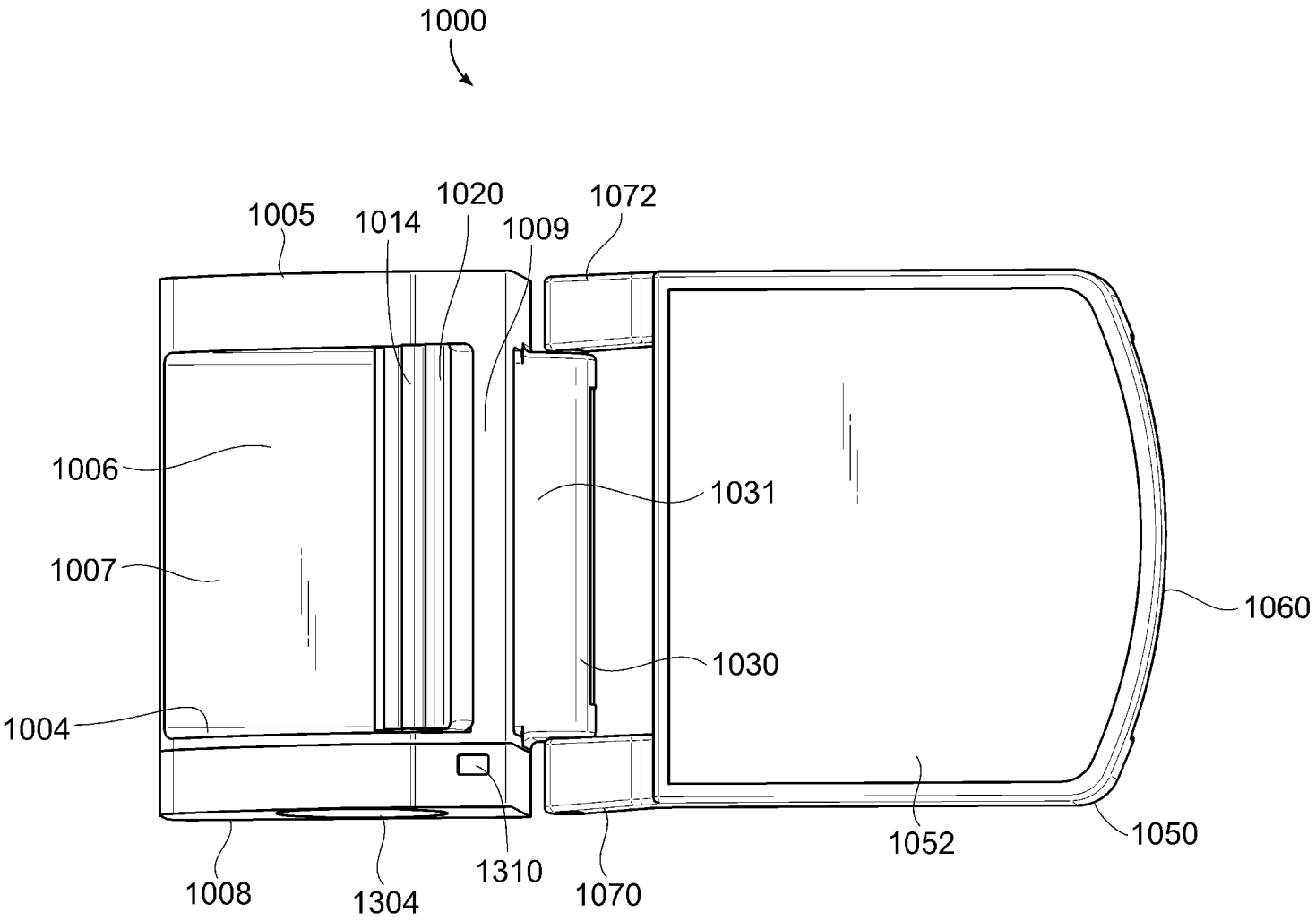
Figure 35:
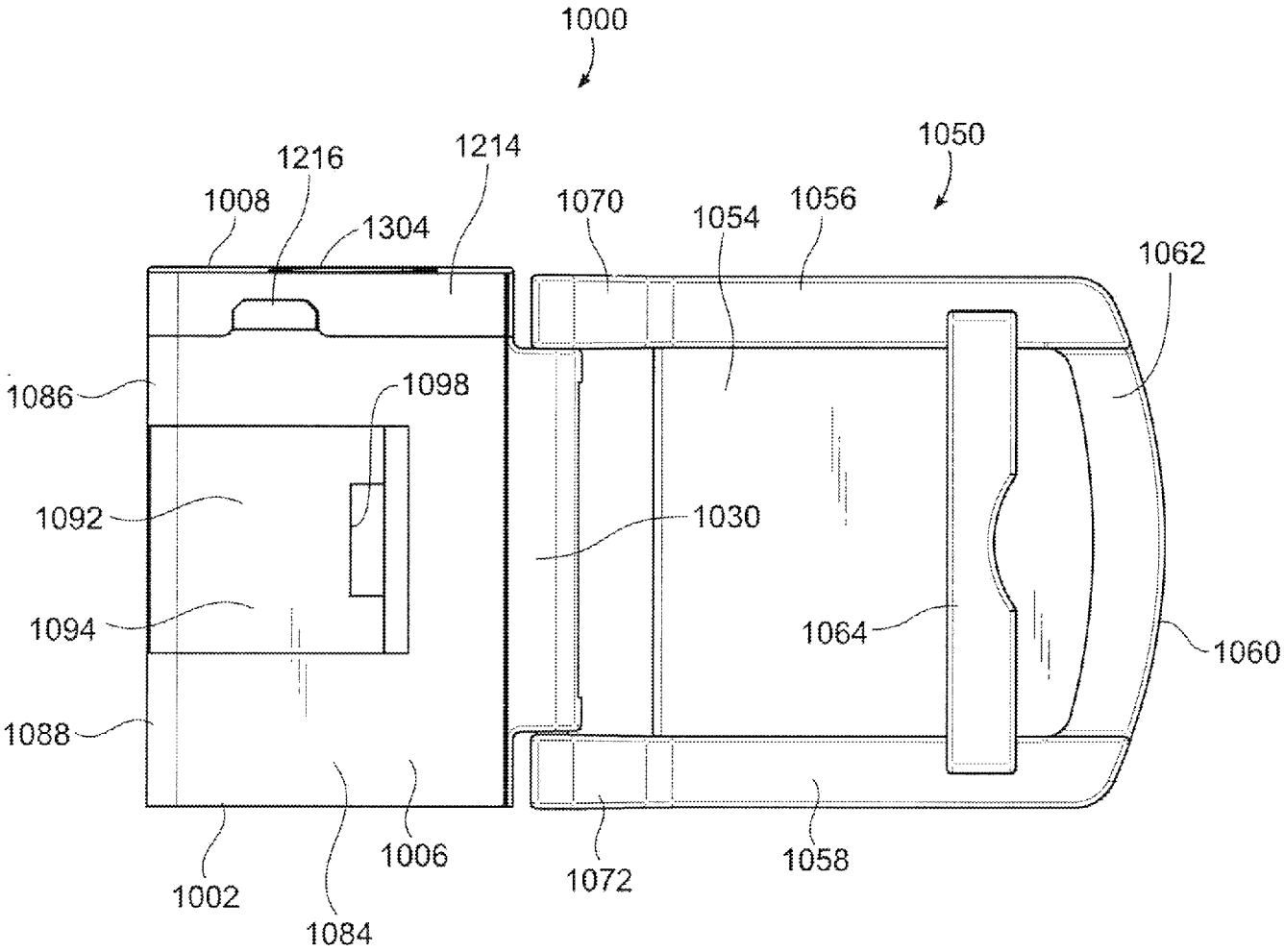
Figure 36:
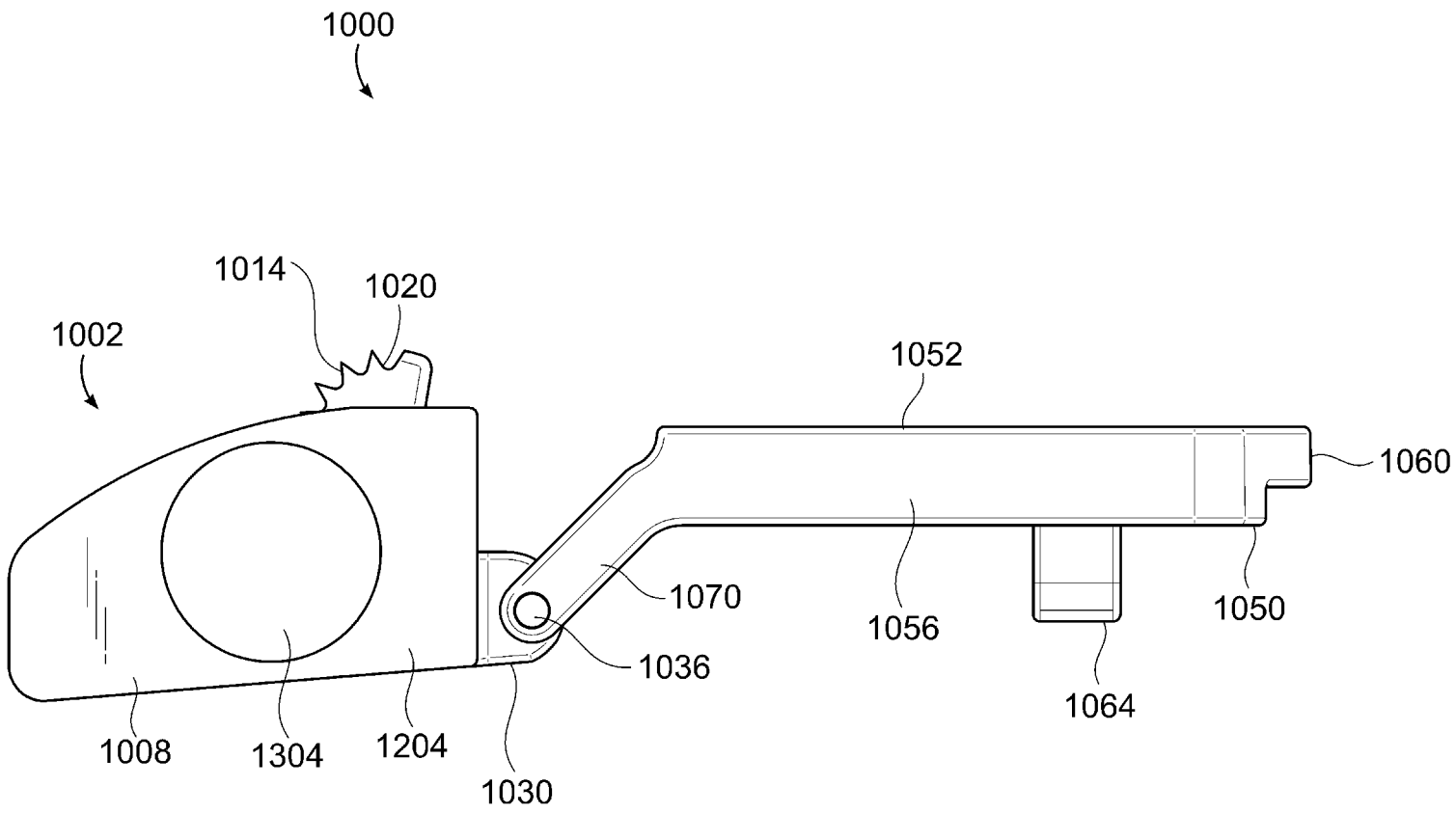
Figure 37:
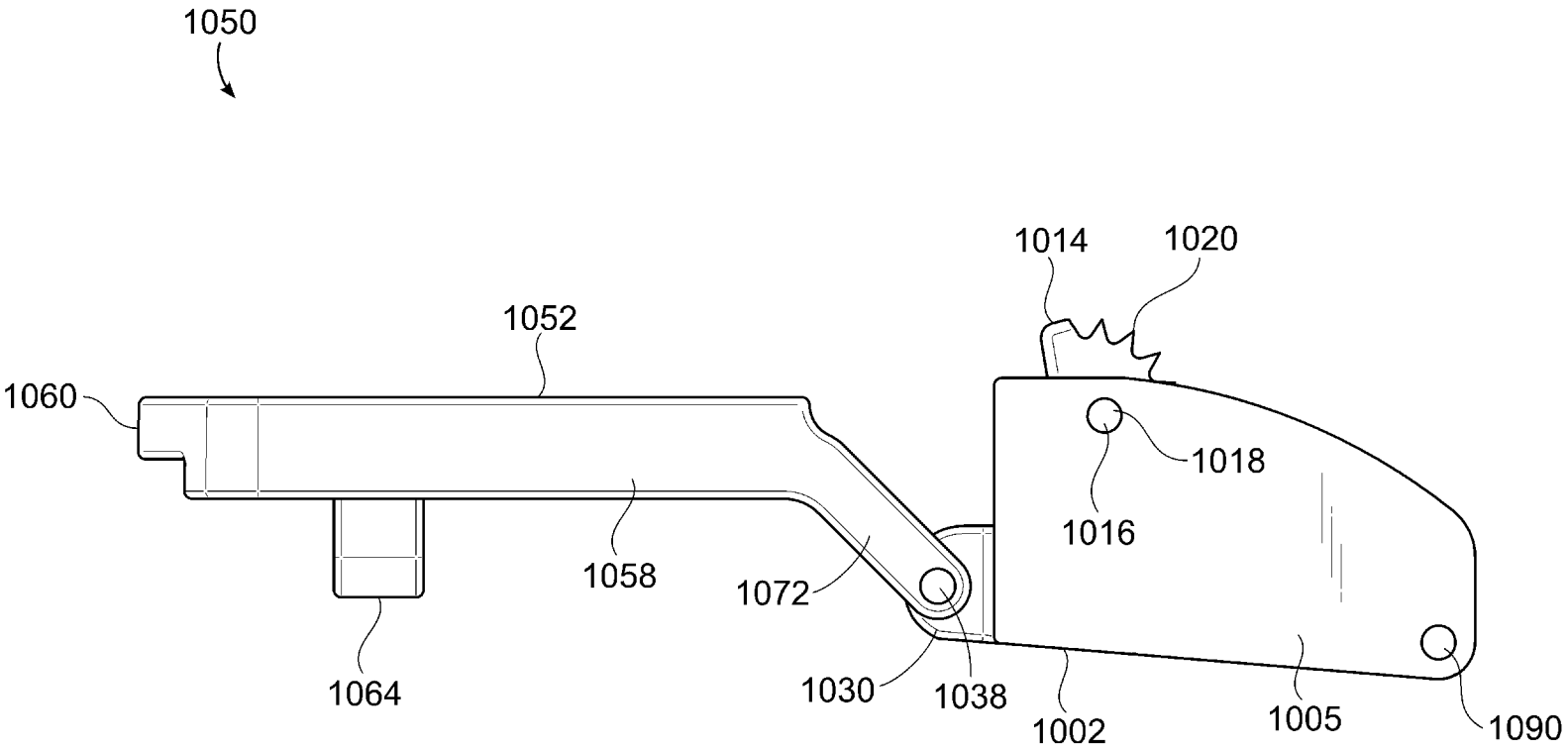
Figure 38:
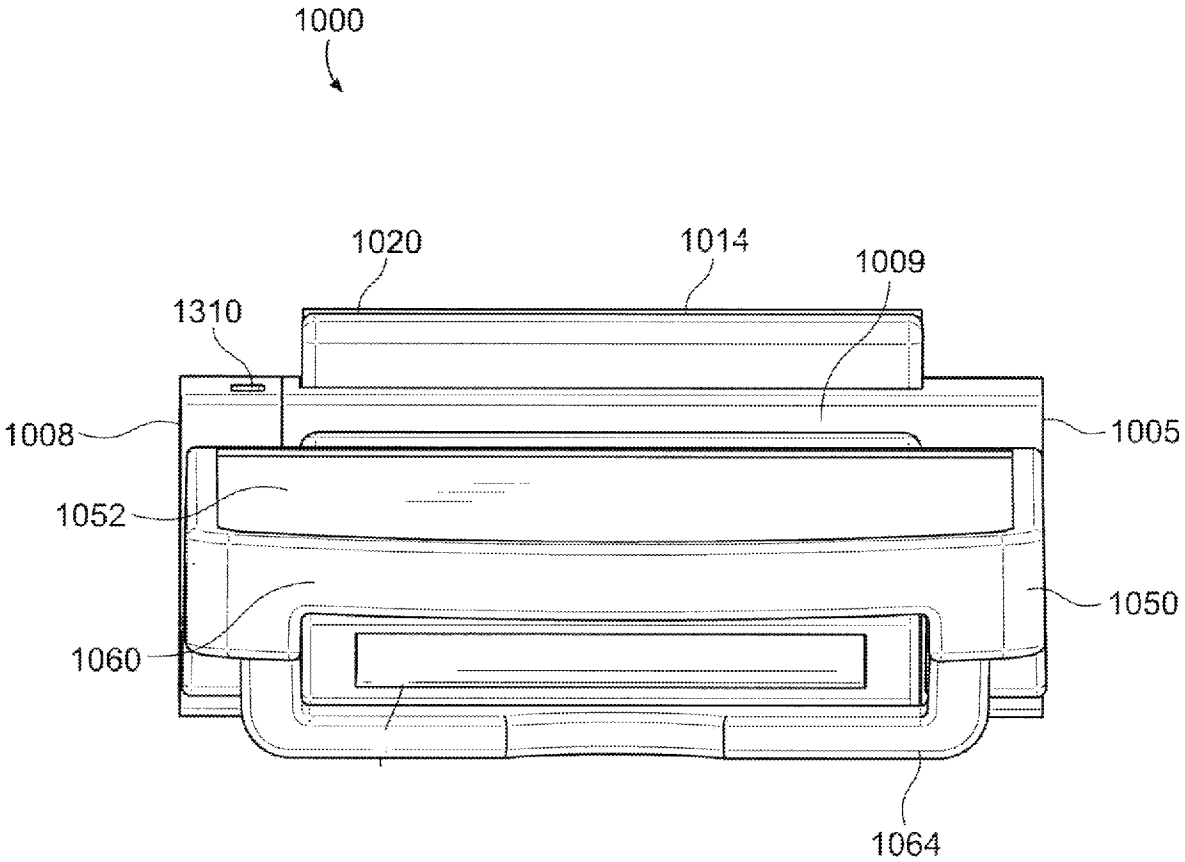
Figure 39:
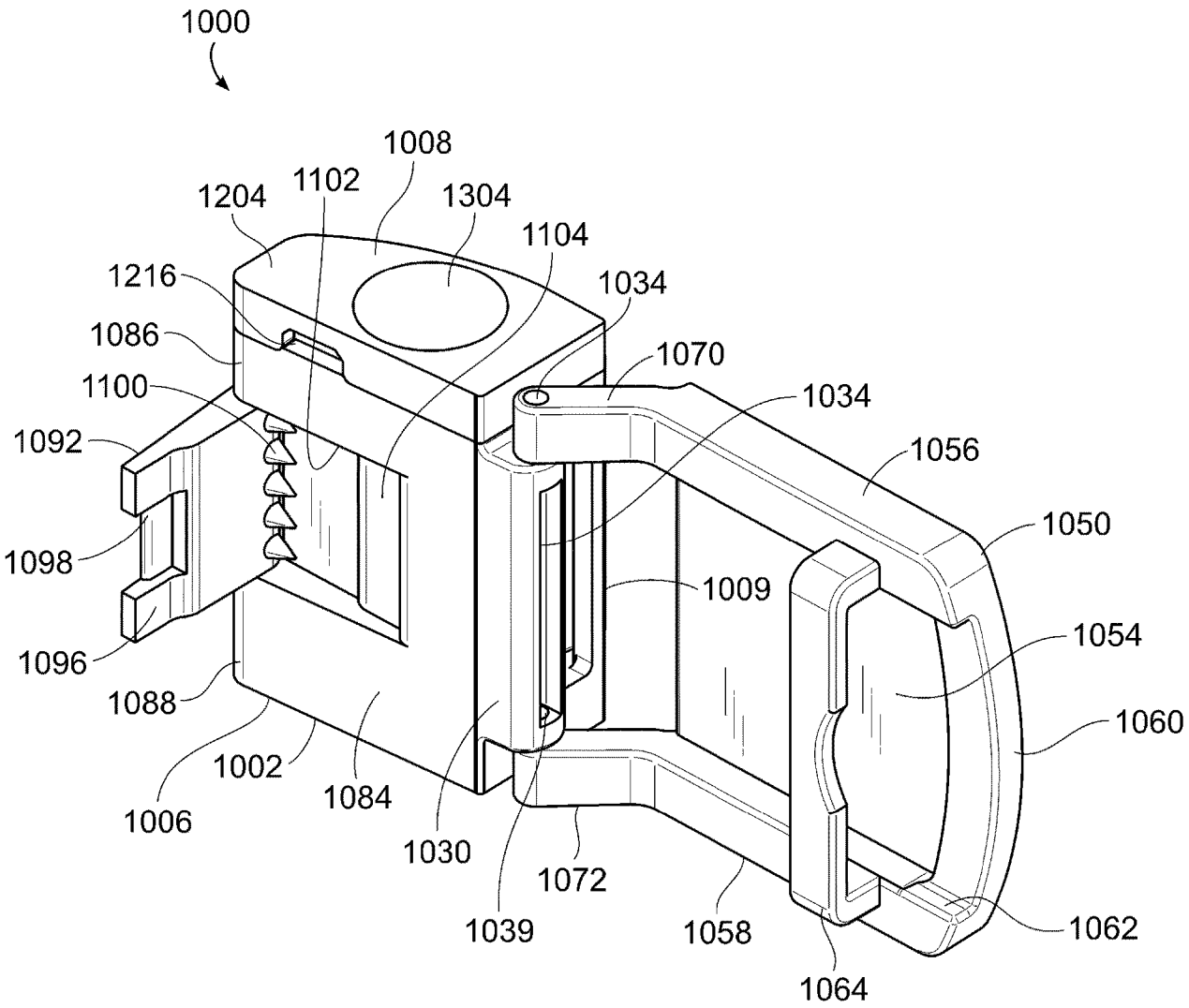
Figure 40:
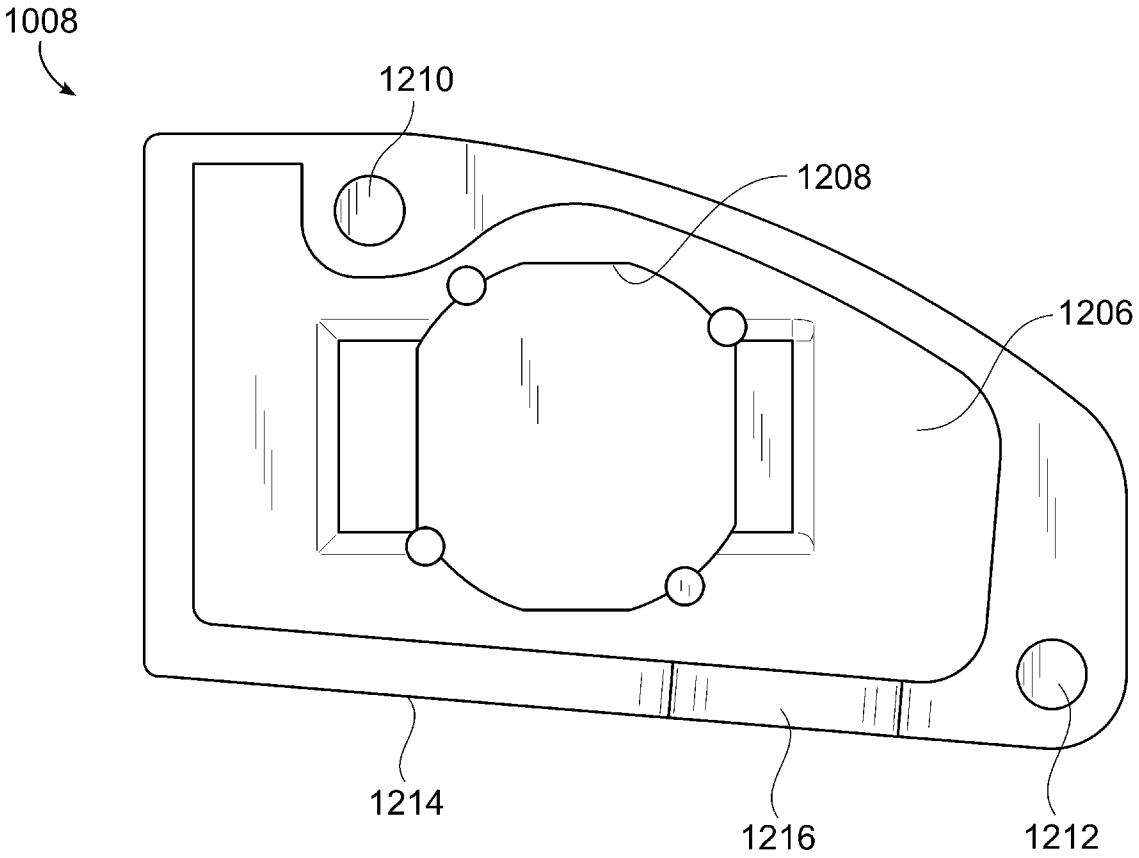
Figure 41:
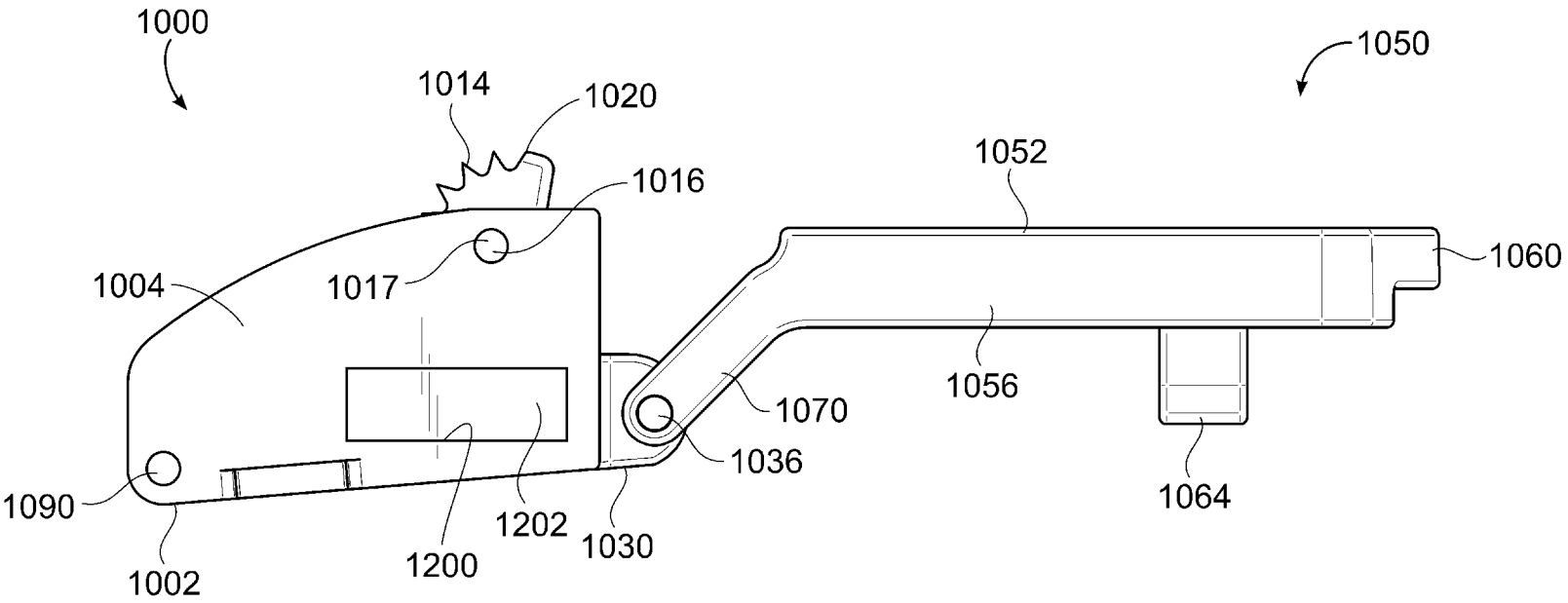
Figure 42:
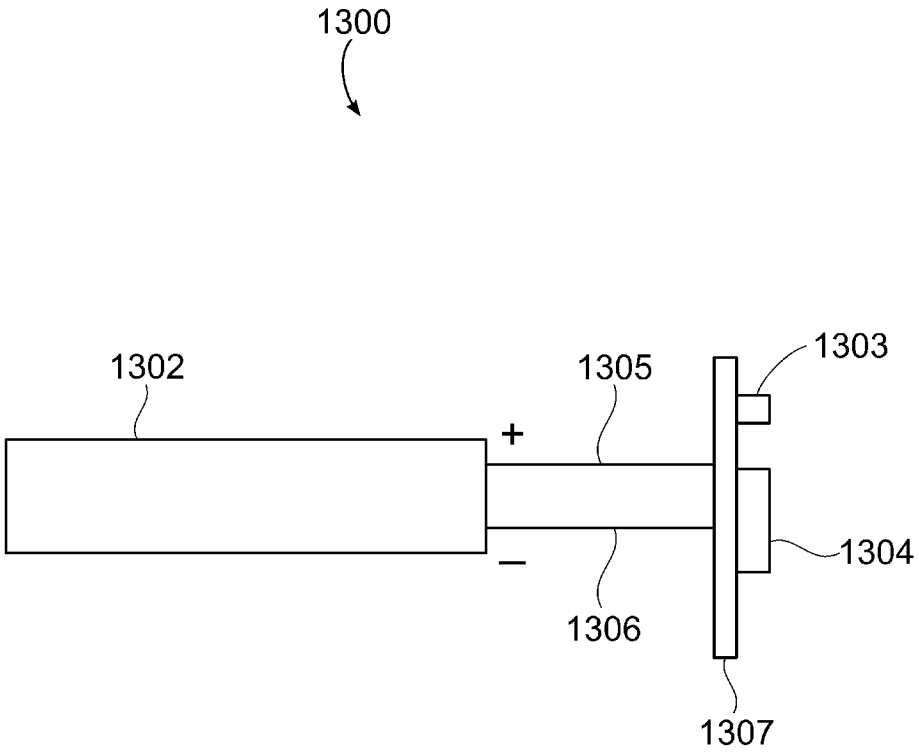
Figure 43:
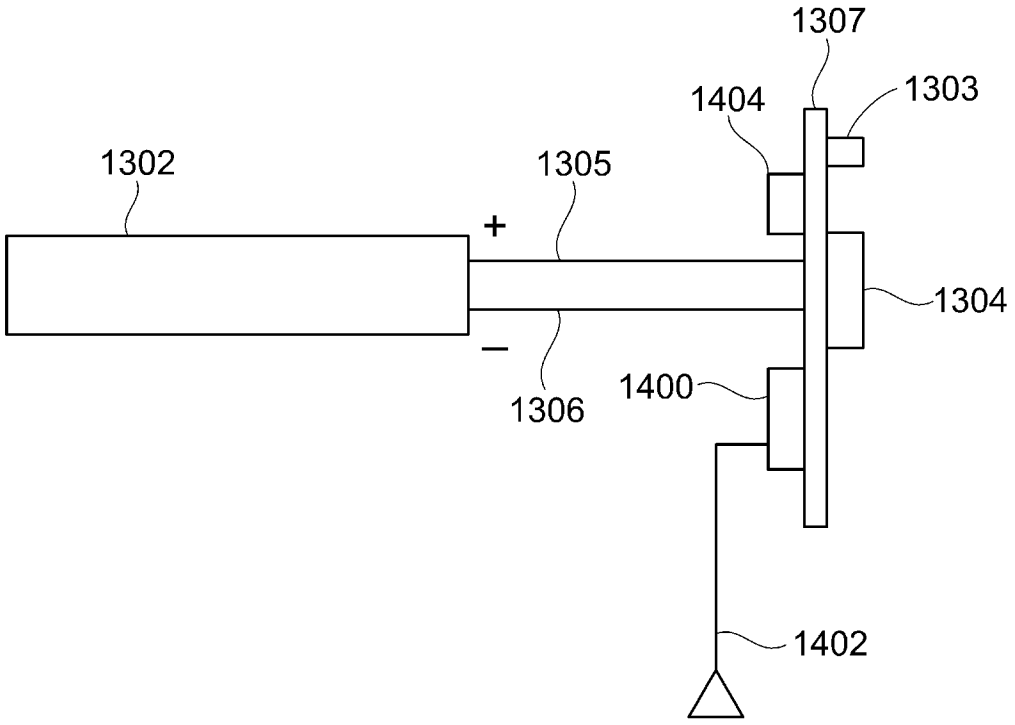
Figure 44:
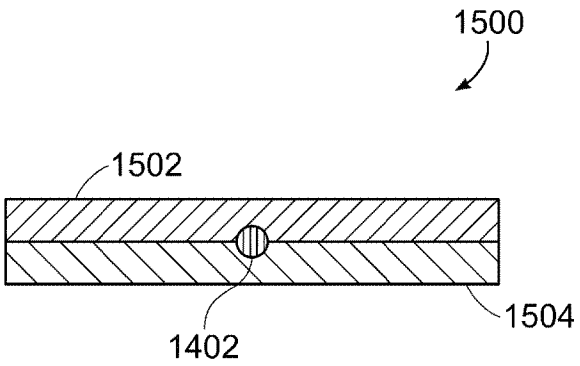
Figure 45:
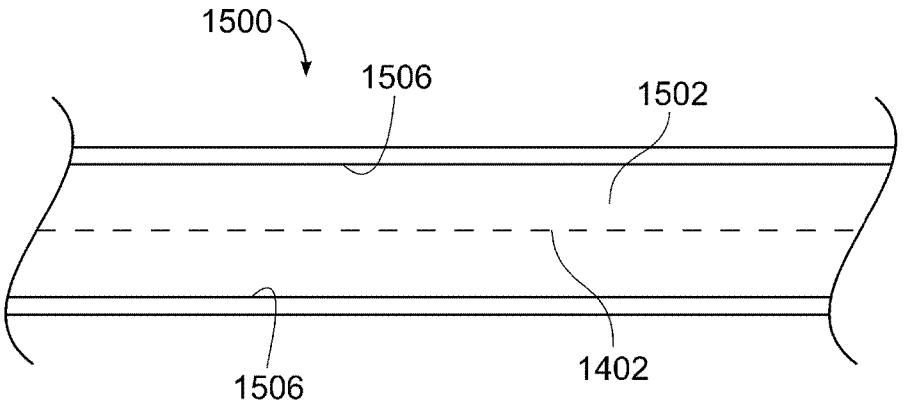
Figure 46:
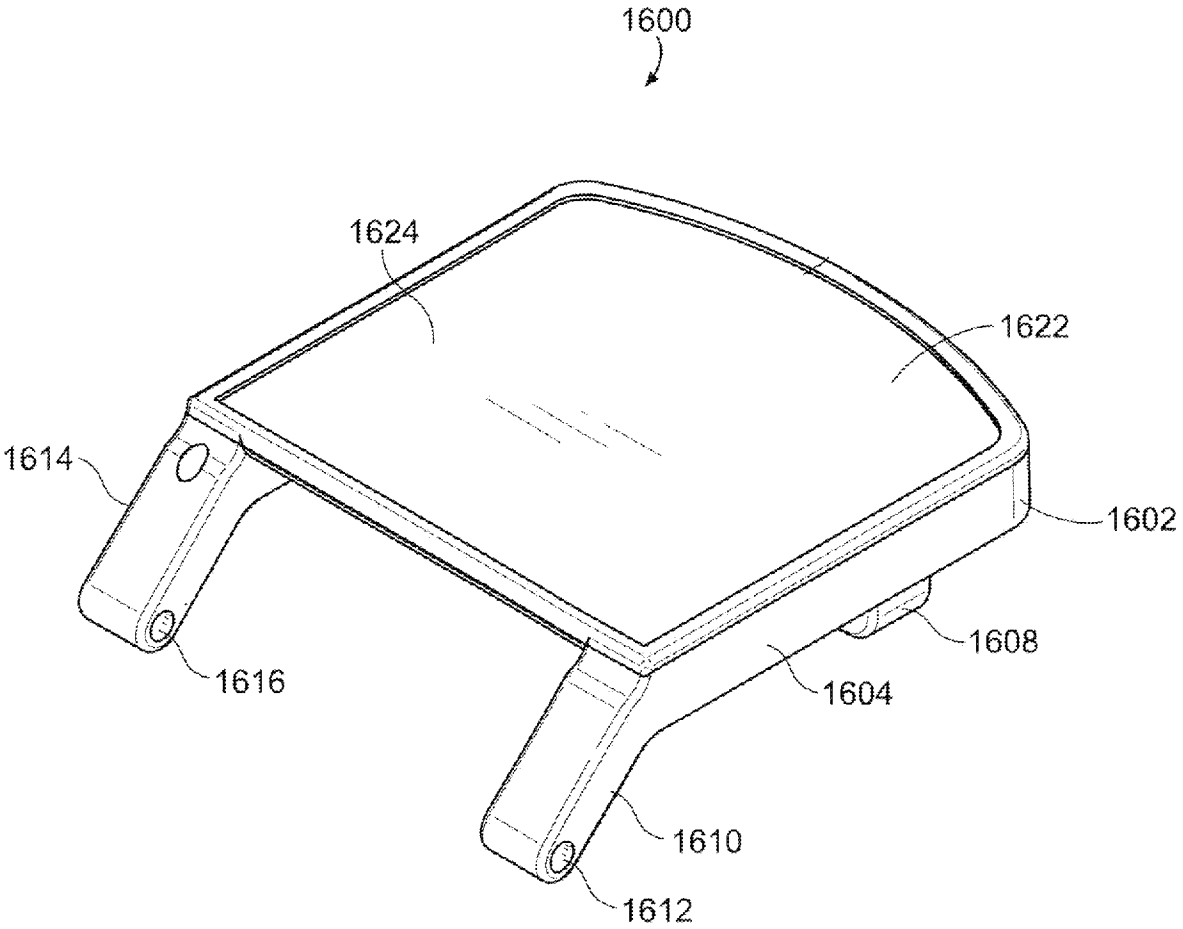
Figure 47:
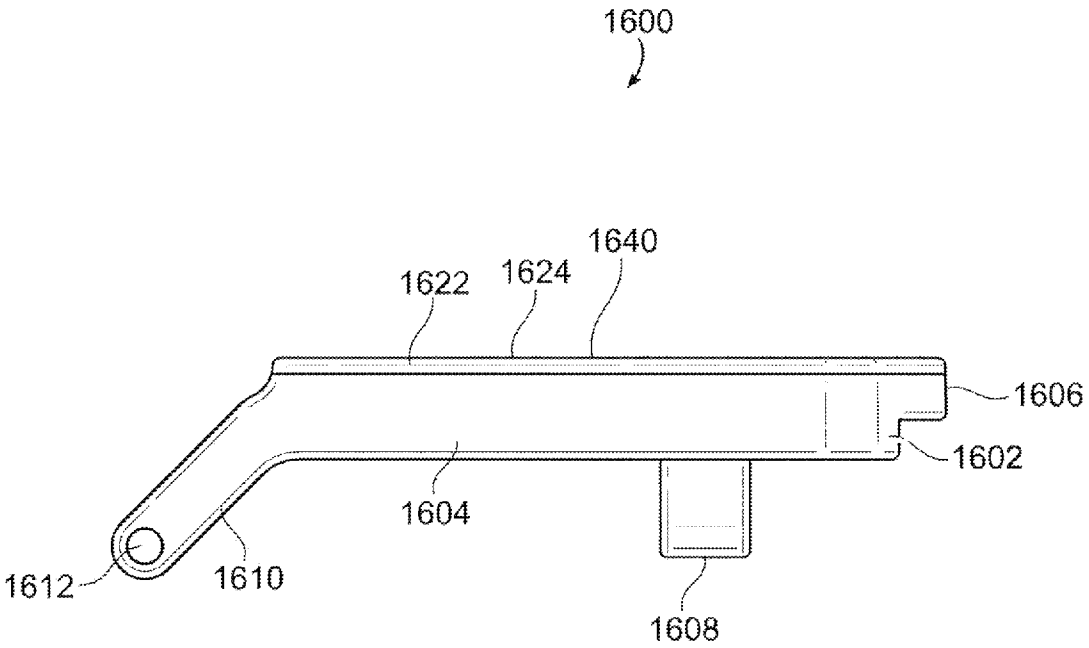
Figure 48:
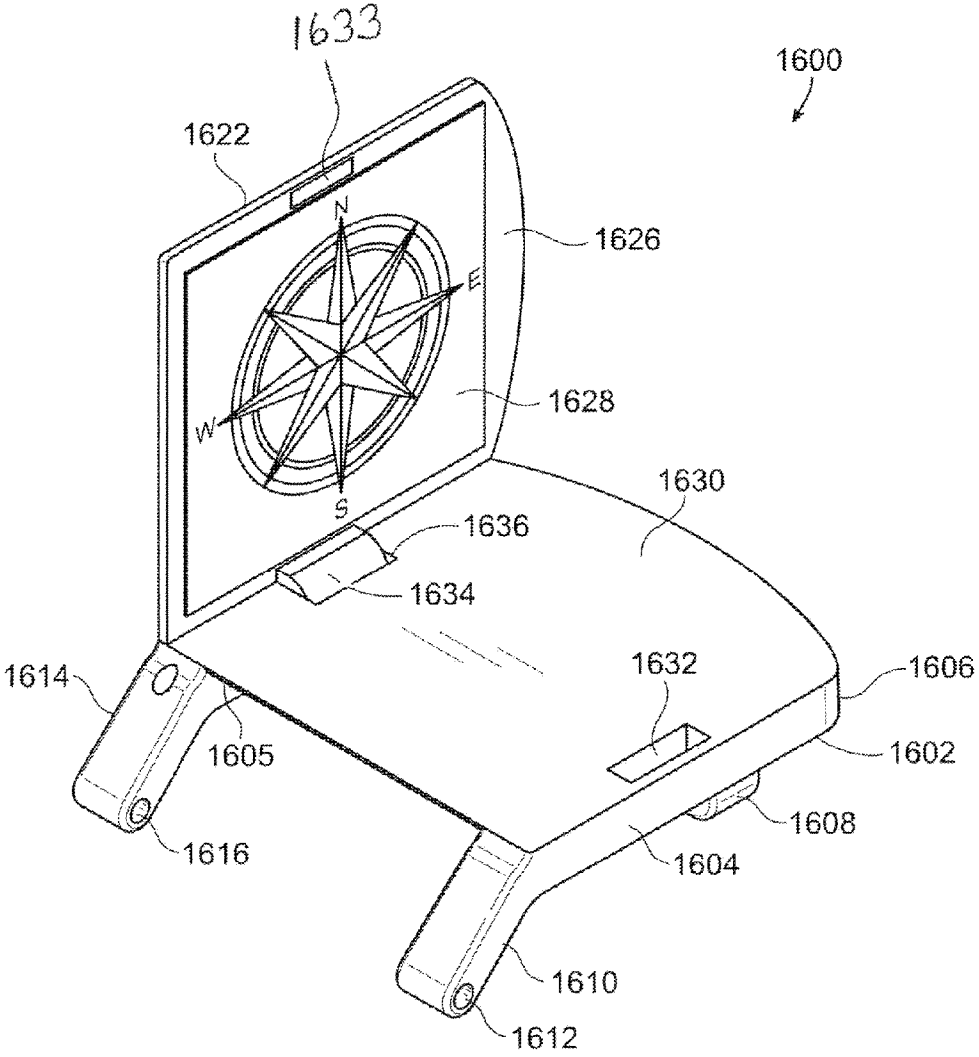
Figure 49:
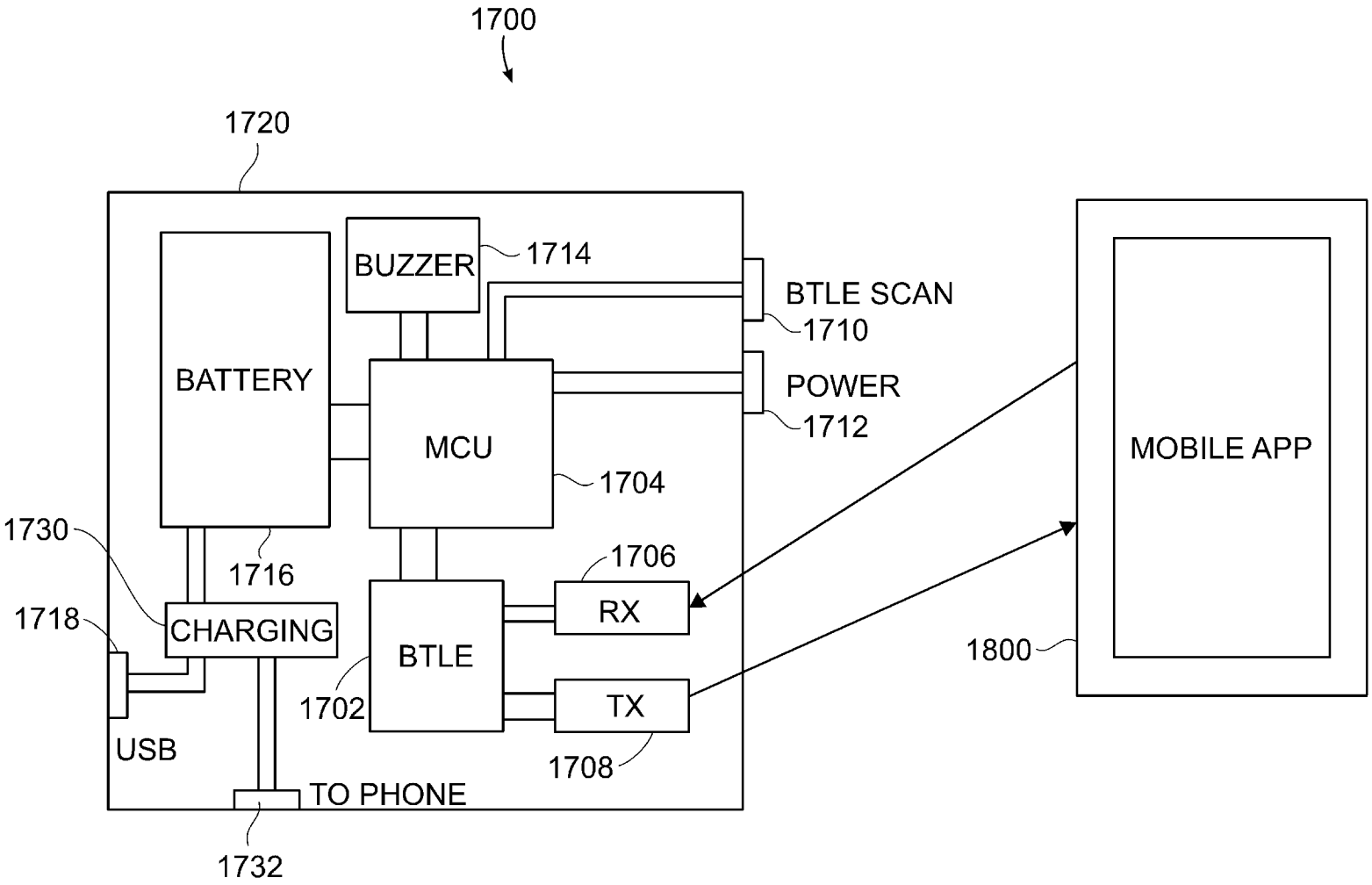
Figure 50A:
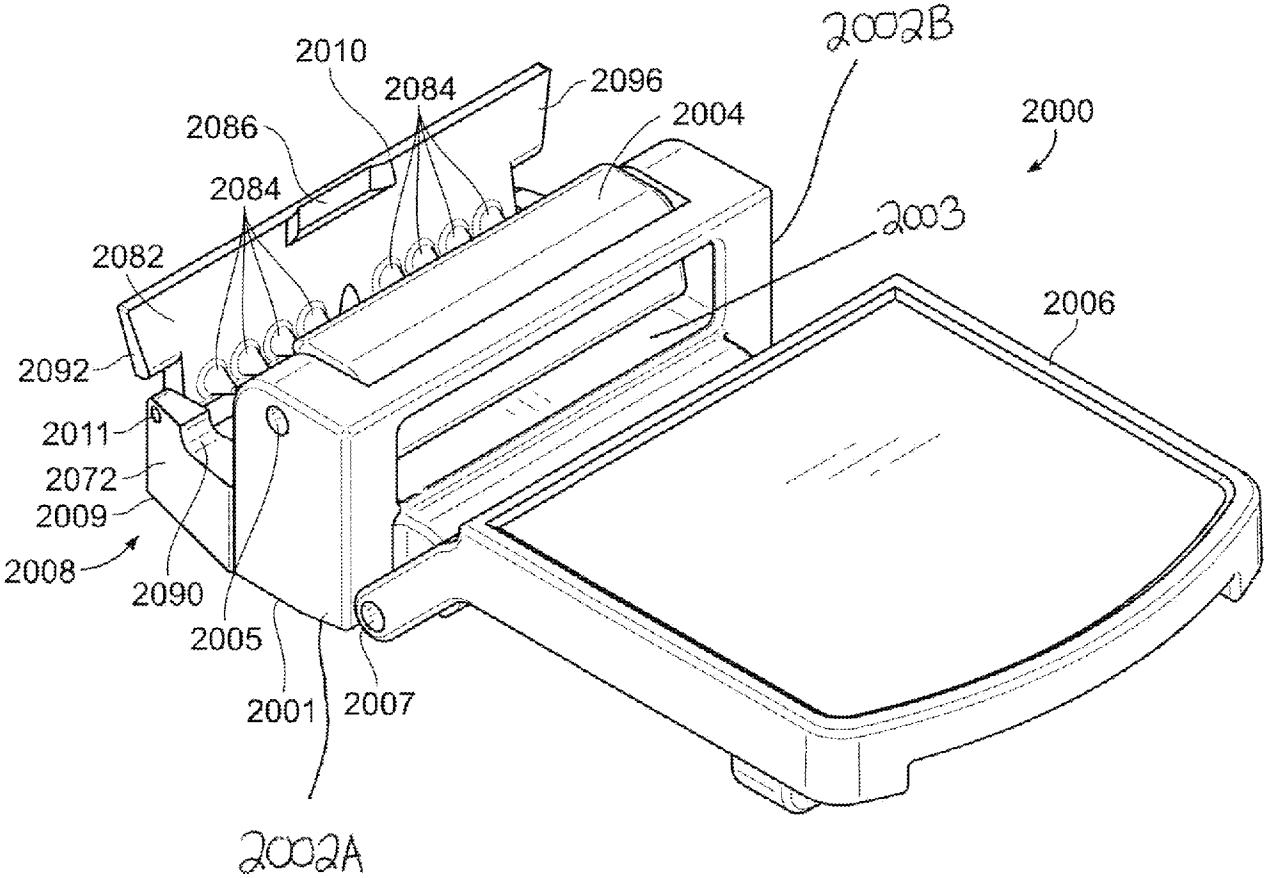
Figure 50B:
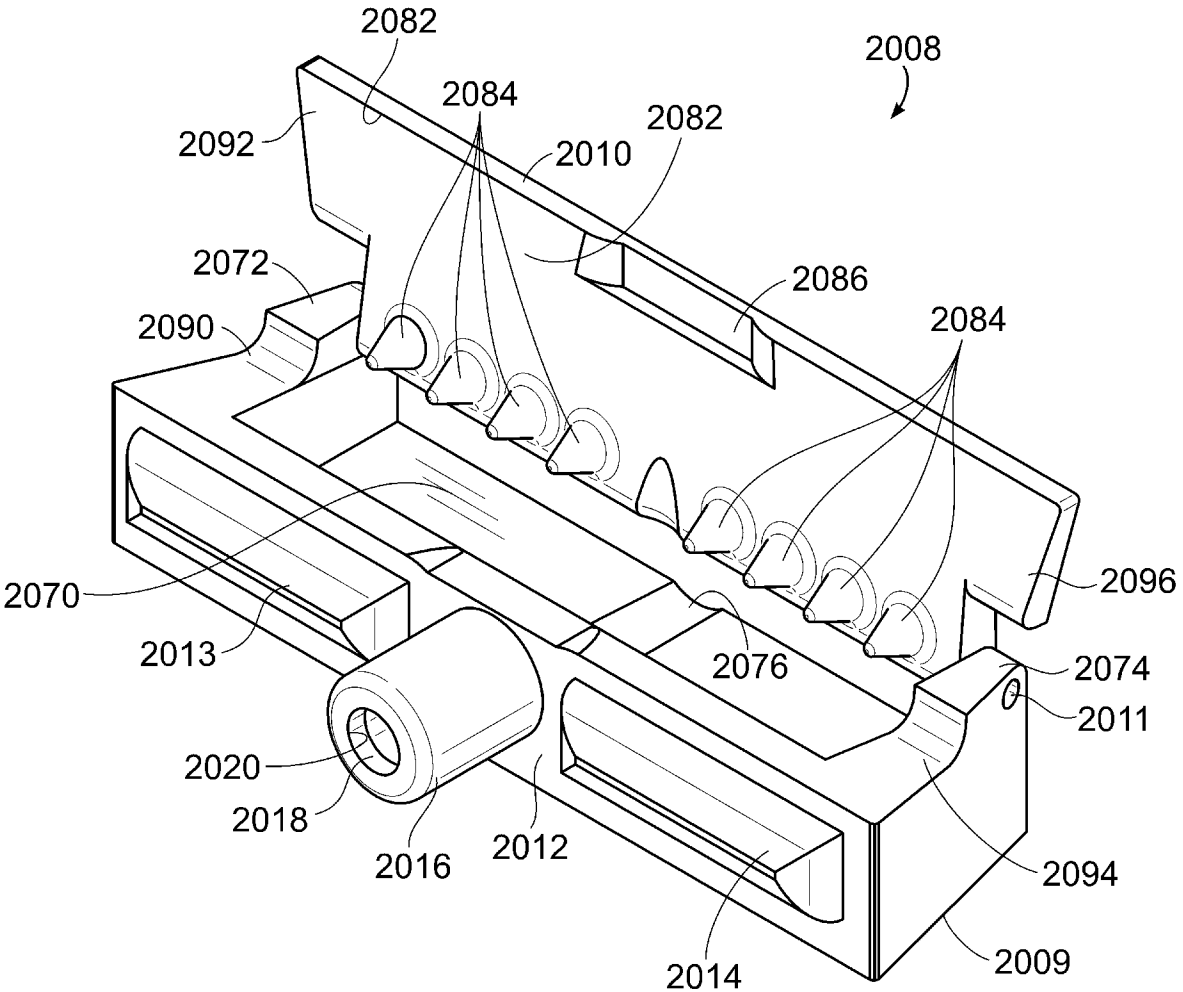
Figure 50C:
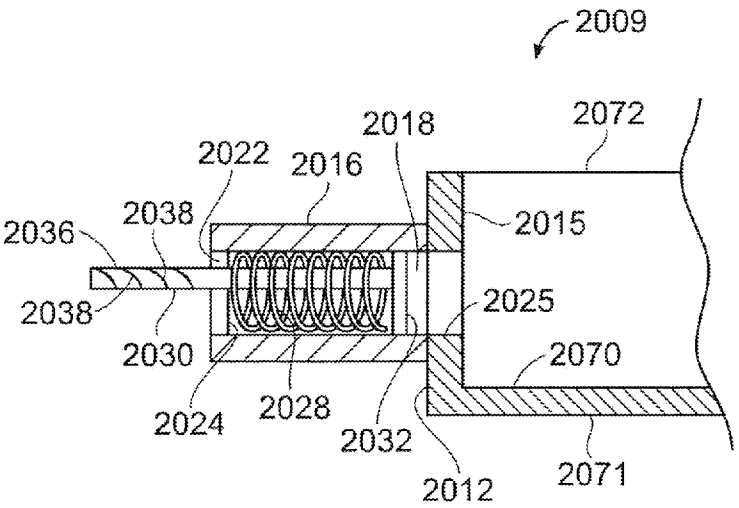
Figure 50D:
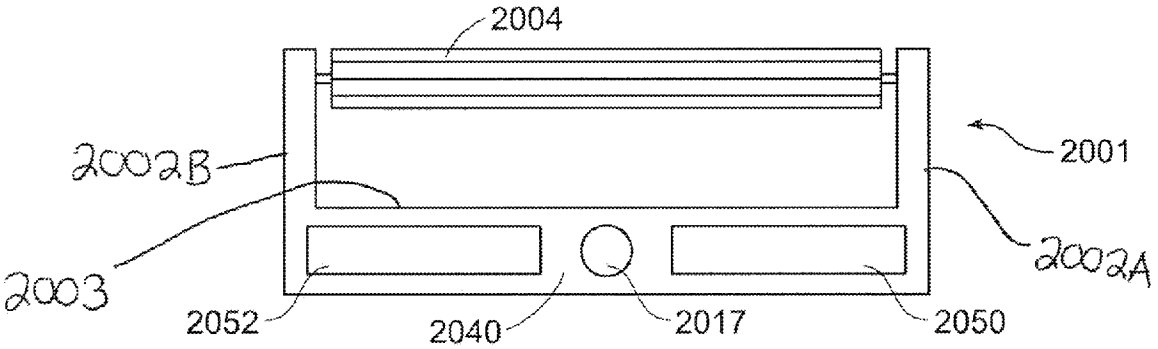
Figure 50E:
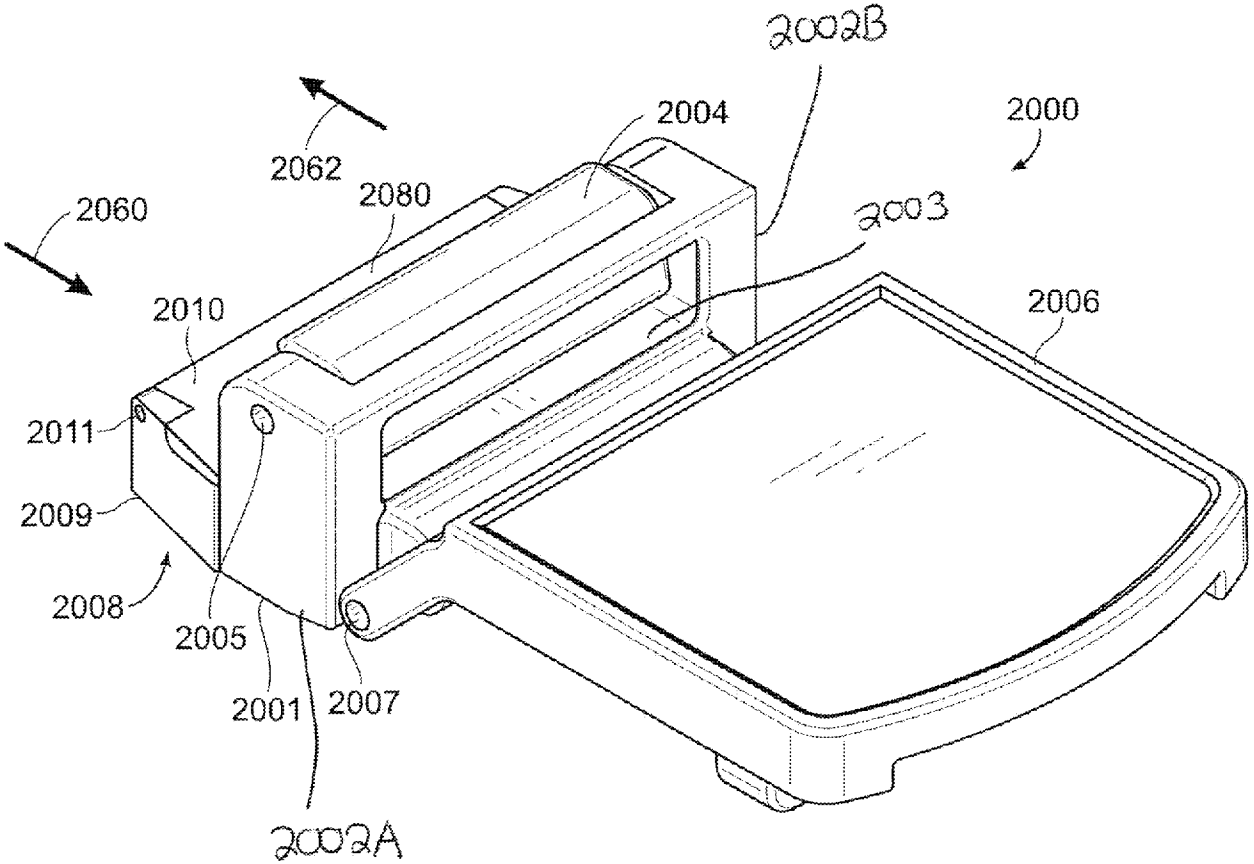

FIG. ills a top view of the pivoting member depicted in FIGS. 5, 7, 8 and 10;

FIG. 12 is a cross-sectional view taken along line 12-12 in FIG. 11;

FIG. 13 is a perspective view of the pivoting member;

FIG. 14 is an end view of the pivoting member;

FIG. 15 is a perspective of a belt buckle in accordance with another exemplary embodiment of the present invention;

FIG. 16 is a top view of the belt buckle shown in FIG. 15;

FIG. 17 is an exploded view of the belt buckle shown in FIG. 15;

FIG. 18 is a perspective view of a belt buckle in accordance with another exemplary embodiment of the present invention, the view showing the front and left sides of the belt buckle;

FIG. 19 is another perspective view of the belt buckle of FIG. 18, the view showing the rear and right sides of the belt buckle;

FIG. 20 is a top plan view of the belt buckle of FIG. 18;

FIG. 21 is a bottom plan view of the belt buckle of FIG. 18;

FIG. 22 is a perspective view of the left side of the belt buckle of FIG. 18;

FIG. 23 is a perspective view of the right side of the belt buckle of FIG. 18;

FIG. 24 is a front elevational view of the belt buckle of FIG. 18;

FIG. 25 is a rear elevational view of the belt buckle of FIG. 18;

FIG. 26 is a perspective view of the belt buckle of FIG. 18, the view showing the belt buckle structure having a first section and second section that is movably attached to the first section;

FIG. 27A is another perspective view of the belt buckle of FIG. 18, the view showing the second section of the buckle structure pivoted 90° with respect to the first section of the buckle structure;

FIG. 27B is a perspective rear view of the belt buckle of FIG. 18, the view showing the second section of the buckle structure pivoted 90° with respect to the first section of the buckle structure, the view not showing the pivoting member or belt guide member in order to simplify the view and to facilitate viewing of the second section of the buckle structure;

FIG. 28 is another perspective view of the belt buckle of FIG. 18, the view showing the second section of the buckle structure pivoted 180° with respect to the first section of the buckle structure;

FIG. 29 is an exploded view of the belt buckle of FIG. 18;

FIG. 30 is a top plan view showing the belt positioned within the belt guide member and extending through the belt buckle FIG. 18;

FIG. 31 is a perspective view of a belt buckle in accordance with another exemplary embodiment of the invention, the view showing the left side of the belt buckle;

FIG. 32 is another perspective view of the belt buckle of FIG. 31, the view showing the right side of the belt buckle;

FIG. 33 is a front view of the belt buckle of FIG. 31;

FIG. 34 is a top plan view of the belt buckle of FIG. 31;

FIG. 35 is a bottom view of the belt buckle of FIG. 31, the view showing a belt clasp in a closed position;

FIG. 36 is a left side elevational view of the belt buckle of FIG. 31;

FIG. 37 is a right side elevational view of the belt buckle of FIG. 31;

FIG. 38 is a rear view of the belt buckle of FIG. 31;

FIG. 39 is a bottom perspective view of the belt buckle of FIG. 31, the view showing the belt clasp in an opened position;

FIG. 40 is a side elevational view of an interior wall of the removable buckle structure sidewall cover shown in FIGS. 31 and 36;

FIG. 41 is a side elevational view of the belt buckle of FIG. 31 without the removable buckle structure sidewall cover so as to facilitate viewing of an interior compartment in which electronic circuitry is located;

FIG. 42 is a block diagram of an electronic light circuit used in the belt buckle of FIG. 31 in accordance with another exemplary embodiment of the present invention;

FIG. 43 is a block diagram of an electronic circuit used in the belt buckle of FIG. 31 in accordance with another exemplary embodiment of the present invention, wherein the electronic circuit includes the electronic light circuit of FIG. 42 and an item separation alarm circuit that alerts the user when an item owned by the user is outside of a predetermined distance from the user;

FIG. 44 is a cross-sectional view of a belt having an embedded antenna that is electrically connected to the item separation alarm circuit in accordance with another exemplary embodiment of the present invention;

FIG. 45 is a plan view of a section of the belt shown in FIG. 44;

FIG. 46 is a perspective view of a belt guide member in accordance with another exemplary embodiment of the present invention, the belt guide member including a compass assembly having a compass;

FIG. 47 is a side elevational view of the belt guide member of FIG. 46;

FIG. 48 is a perspective view of the belt guide member of FIG. 46 wherein the compass is visible;

FIG. 49 is a block diagram of an electronic circuit configured to be mounted or secured to the belt buckle in accordance with another exemplary embodiment of the present invention, wherein the electronic circuit includes wireless communication circuity configured for radio frequency (RF) communication with one or more mobile devices;

FIG. 50A is a perspective view of a belt buckle in accordance with another exemplary embodiment of the present invention, wherein the belt buckle comprises a belt retaining section having a clasp member and wherein the clasp member is in the open position;

FIG. 50B is a perspective view of the belt retainer section shown in FIG. 50A;

FIG. 50C is a partial, cross-sectional view of the body portion of the belt retainer section, the view showing a spring and fastener disposed with a sleeve of the body portion;

FIG. 50D is an end view of the buckle structure shown in FIG. 50A, the view not showing the belt retainer section in order to facilitate viewing of the end portion of the buckle structure; and FIG. 50E is a perspective view of the belt buckle of FIG. 50A wherein the clasp member is in a closed position.

DESCRIPTION OF THE PREFERRED EMBODIMENTS

As used herein, the terms "comprises", "comprising", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

It is to be understood that throughout this description, terms such as "vertical", "horizontal", "top", "bottom", "upper", "lower", "middle", "above", "below", "left", "right" and the like are used for convenience in identifying relative locations of various components and surfaces relative to one another in reference to the drawings and that the apparatus of the present invention may be installed and used in substantially any orientation so that these terms are not intended to be limiting in any way.

Approximating language, as used herein throughout the specification and claims, may be applied to modify any quantitative representation that could permissibly vary without resulting in a change in the basic function to which it is related. Accordingly, a value modified by a term such as "about" or "approximately" is not limited to the precise value specified.

Figure 1:
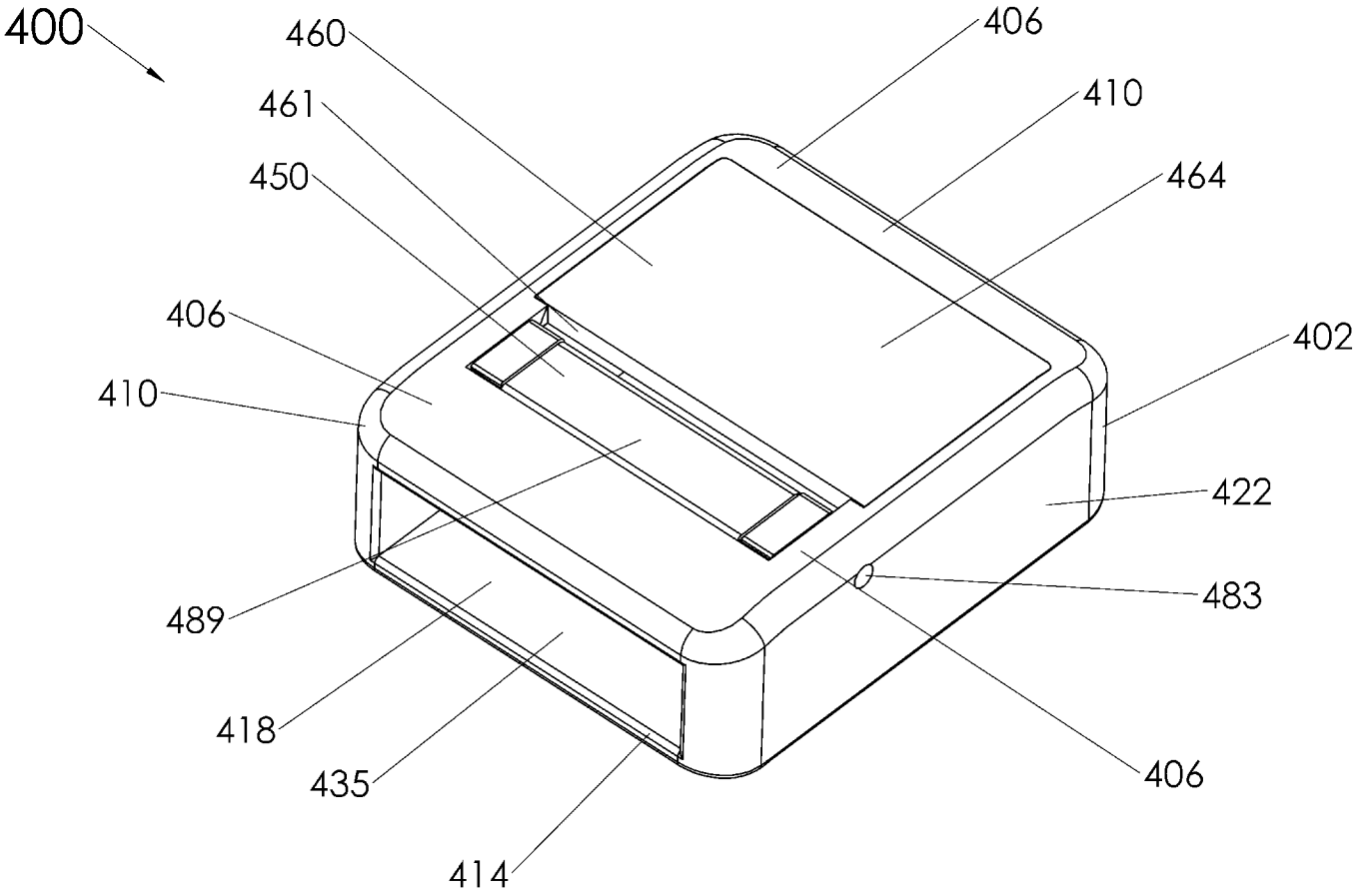
FIG. 1 is a perspective view of a belt buckle in accordance with an exemplary embodiment of the present invention.
Figure 2:
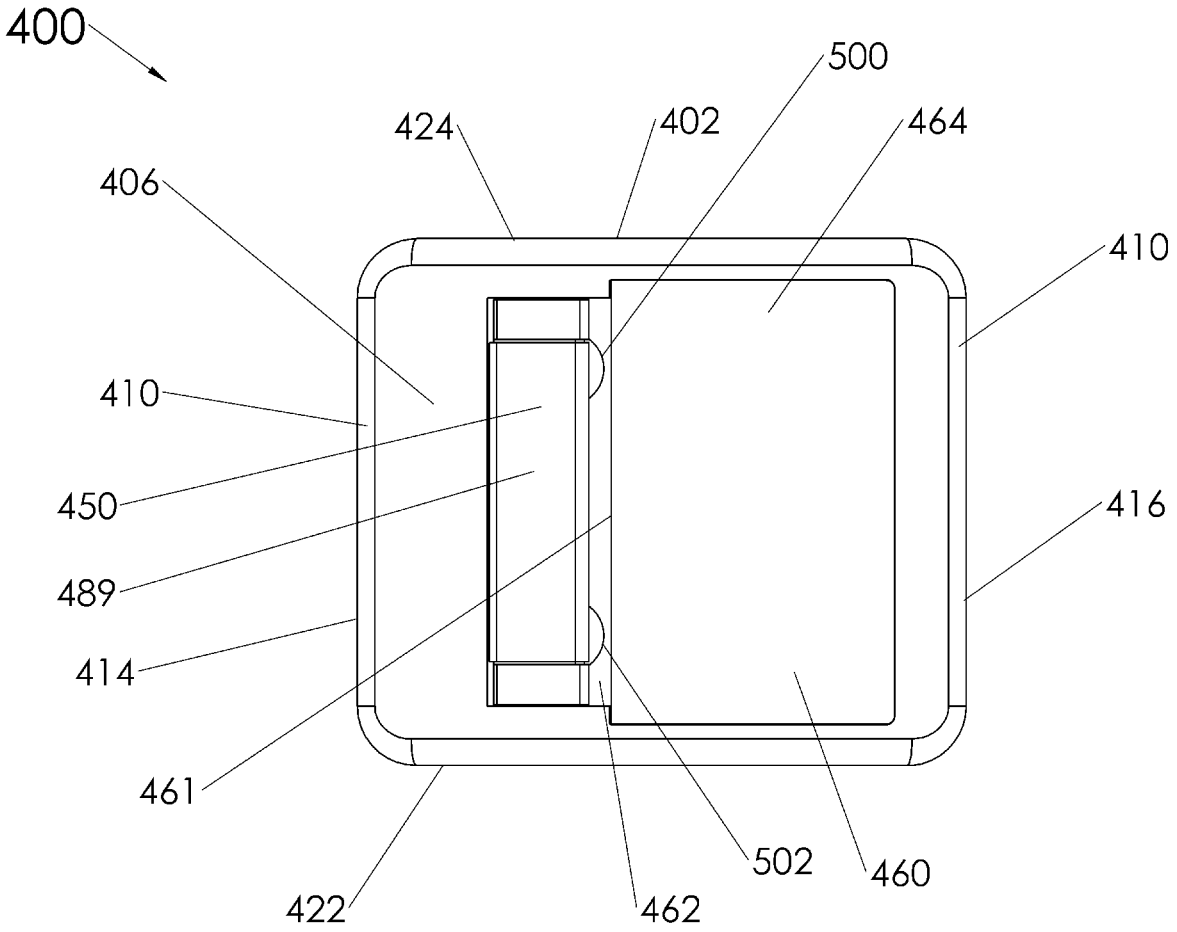
FIG. 2 is a top view of the belt buckle.
Figure 3:
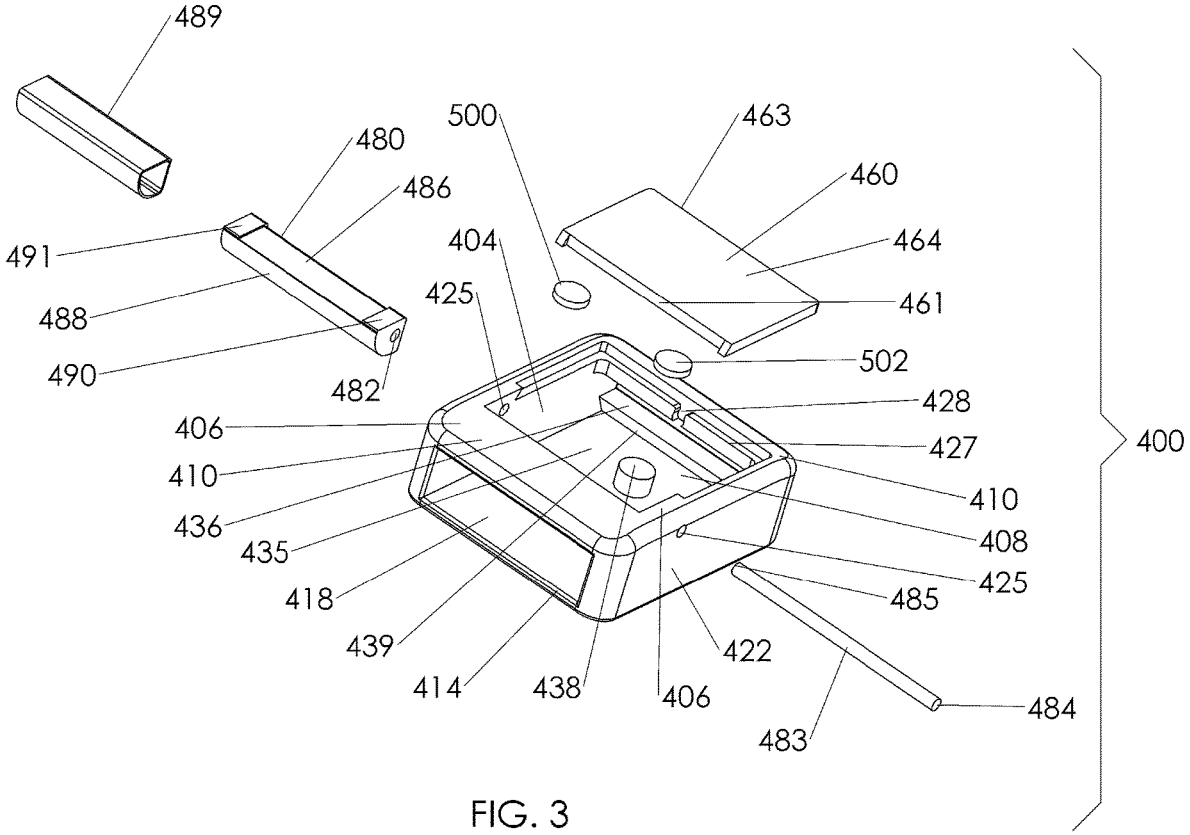
FIG. 3 is an exploded view of the belt buckle.

Referring to FIGS. 1-14, there is shown belt buckle 400 in accordance with another embodiment of the present invention. Belt buckle 400 is used with belt 200. Belt 200 comprises belt end 202, intermediate belt section 204 and free end 206. Belt end 202 is attached or secured to belt buckle 400 as will be described in the ensuing description. Belt buckle 400 comprises buckle body 402. Buckle body 402 comprises an interior region 404 and first side 406. First side 406 has opening 408 that exposes the interior region 404. First side 406 comprises peripheral portion 410 that extends about first side 406. Buckle body 402 further comprises opposite, second side 412, first buckle end 414 and an opposite second buckle end 416. Buckle ends 414 and 416 have openings 418 and 420, respectively, which provide access to the interior region 404. Openings 418 and 420 and interior region 404 are sized to allow portions of belt 200 to pass therethrough. Buckle body 402 further comprises sidewalls 422 and 424 that are contiguous with the buckle ends 414 and 416. Sidewalls 422 and 424 include through-holes 425 for receiving pin member 483 (see FIG. 3). Pin member 483 is attached or mounted to the sidewalls 422 and 424 and extends across the interior region 404. The purpose of pin member 483 is described in the ensuing description. Buckle body 402 includes rib or ledge 427 that is on the interior side of sidewalls 422 and 424 and buckle end 416 as shown in FIG. 3. Rib or ledge 427 has notch 428. The purpose of ledge 427 is discussed in the ensuing description.

Figure 4:
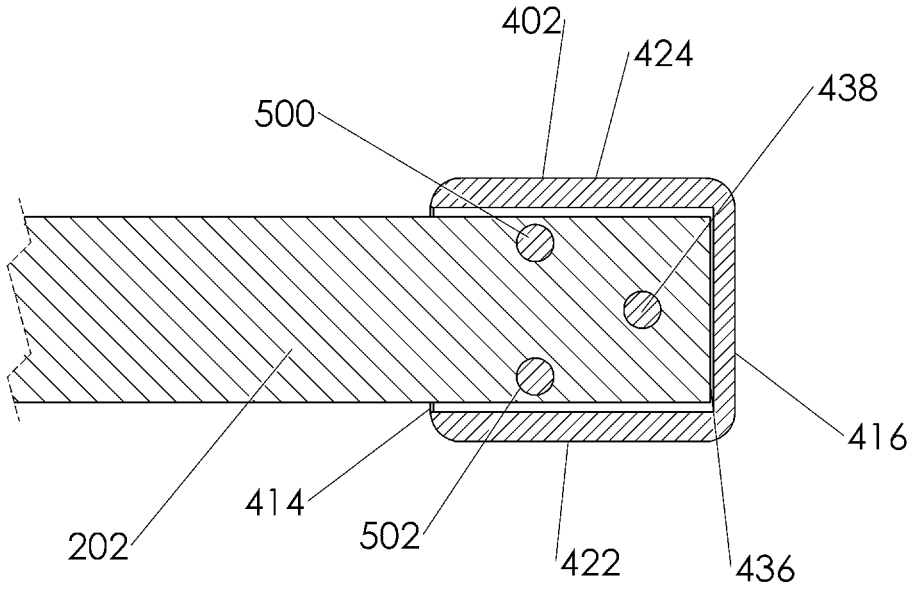
FIG. 4 is a top view, partially in cross-section, of the belt end that is secured to the bottom, interior surface of the belt buckle body, the view showing friction pads that are attached to the bottom, interior surface of the belt buckle body and positioned within corresponding openings in the belt end.
Figure 7:
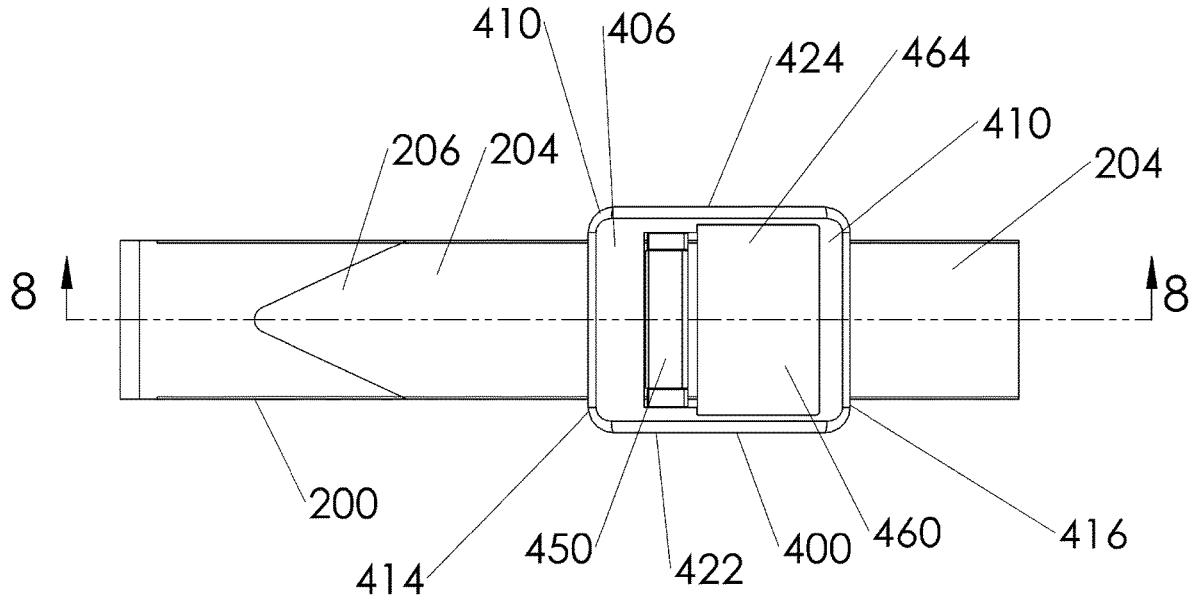
FIG. 7 is a top view of the belt buckle and the belt that is engaged with the belt buckle.

Referring to FIGS. 3, 4 and 7, buckle body 402 further comprises interior bottom surface 435, wall 436 and upstanding tabs or protruding members 438 that upwardly extend from interior bottom surface 435. In an exemplary embodiment, there are two upstanding tabs 438. Wall 436 includes angled portion 439 located within interior region 404. Belt end 202 is positioned within interior region 404 and attached to buckle body 402. Belt end 202 has through-hole 210 and an angled edge 212. Upstanding tabs 438 are frictionally inserted into corresponding through-holes 210 and angled edge 212 is fitted under angled portion 439 of wall 436. In an alternate embodiment, an adhesive is also used to attach belt end 202 to interior bottom surface 435.

Figure 5:
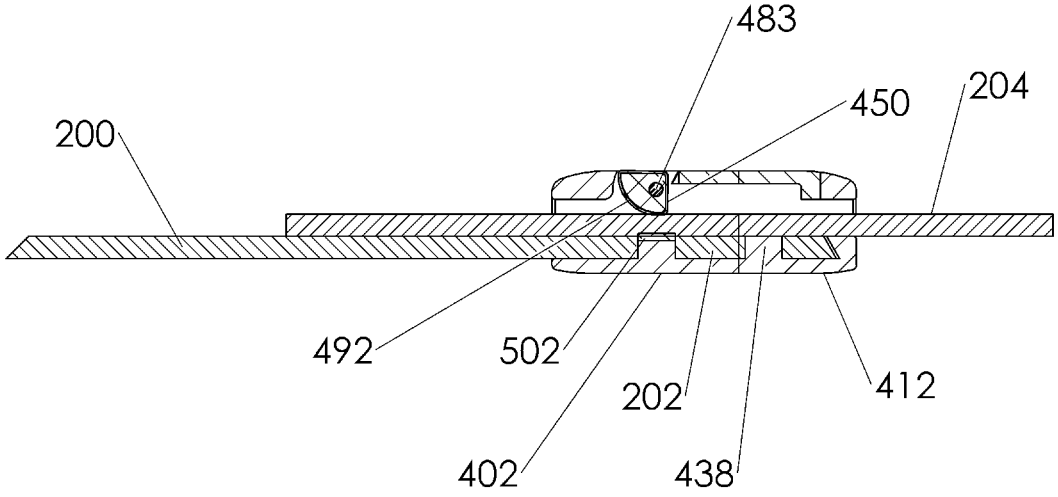
FIG. 5 is a partial side view, in cross-section, showing the belt end secured to the bottom portion of the belt buckle body, the friction pads positioned within the corresponding openings of the belt end, the movable belt section disposed over the belt end, and the pivoting member positioned in a first position wherein the pivoting member contacts the movable belt section.
Figure 6:
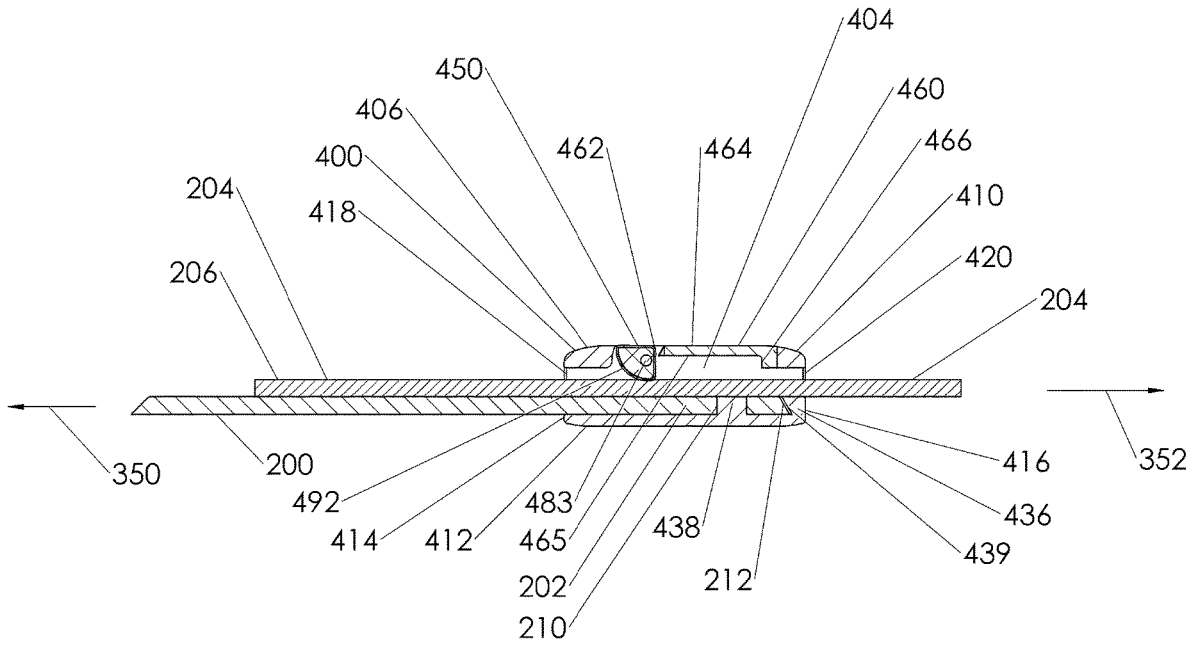
FIG. 6 is a view similar to FIG. 5 and shows the position of the pivoting member resulting from tension on the belt.

Referring to FIGS. 5-8 and 10, buckle 400 further comprises pivoting member 450. Pivoting member 450 can pivot in a first direction to a first position, shown in FIG. 5, wherein the pivoting member 450 contacts belt section 204. Pivoting member 450 can also pivot in a second, opposite direction to a second position, shown in FIG. 10, wherein there is no physical contact between pivoting member 450 and belt section 204. The structure and function of pivoting member 450 is described in detail in the ensuing description. When free end 206 of belt 200 is inserted through opening 420 and interior region 404 and extends from opening 418 and pivoting member 450 is in the second position, the wearer may move belt section 204 in direction 350 to tighten of belt 200 around the wearer's waist or in opposite direction 352 to loosen belt 200. Thus, when pivoting member 450 is in the second position, the wearer may move belt section 204 through belt buckle 400 either in direction 350 or in direction 352. When pivoting member 450 is pivoted in the first direction to the first position, the pivoting member 450 contacts the belt section 204. When a tensile force or tension is on belt 200, pivoting member 450 is pulled downward as shown in FIG. 6. When pivoting member 450 is in this position, there is firm and frictional contact between pivoting member 450 and belt section 204 which prevents belt section 204 from moving in direction 352. This firm and frictional contact between pivoting member 450 and belt section 204 cooperates with the unique shape and structure of pivoting member 450 to prevent movement of belt section 204 in direction 352. Thus, belt 200 cannot become loose around the wearer's waist.

When pivoting member 450 is in the first position or in the position shown in FIG. 5 and the wearer desires to position pivoting member 450 to the second position, the wearer moves belt section 204 in direction 350. Due to the frictional contact between pivoting member 450 and belt section 204, the movement of belt section 204 in direction 350 causes pivoting member 450 to pivot in the second, opposite direction to the second position. When pivoting member 450 is in the second position, there is clearance between pivoting member 450 and belt section 204 which allows the wearer to move belt section 204 in direction 350 to tighten belt 200 or in direction 352 in order to loosen belt 200. Once the wearer is satisfied with the tightness of belt 200, the wearer uses his or her finger to pivot pivoting member 450 in the first direction to the first position wherein pivoting member 450 contacts belt section 204. Then, the wearer's body and clothing produce tensile stress or tension on belt 200 thereby causing pivoting member 450 to be pulled downward to the position shown in FIGS. 5 and 6.

Referring to FIGS. 1-6, belt buckle 400 further comprises cover 460 that is removably attached to the buckle body 402. Specifically, cover 460 is removably and frictionally mounted to peripheral portion 410 and located within opening 408. Cover 460 is sized to cover a portion of interior region 404 of buckle body 402. Cover 460 is supported by ledge 427. Cover 460 includes front end 461. Front end 461 is in proximity to and spaced apart from pivoting member 450 by gap 462. Cover 460 has rear end 463 that is adjacent to peripheral portion 410. Cover 460 has top side 464, bottom side 465, and structure 466 that extends from bottom side 465. Structure 466 includes a tab (not shown) which is sized to fit into notch 428 in ledge 427 (see FIG. 3).

Referring to FIGS. 10-13, pivoting member 450 comprises body section 480. Body section 480 has a longitudinally extending bore 482. Pivoting member 450 further comprises pin member 483 that is disposed within bore 482. Pin member 483 has ends 484 and 485 that are frictionally inserted into openings 425 in sidewalls 422 and 424. In a preferred embodiment, pin member 483 does not rotate. The pivoting member 450 can pivot about the pin member 483 in the first direction and in the opposite second direction. Body section 480 comprises generally flat sides 486 and 487, and curved side 488. Curved side 488 is contiguous with generally flat sides 486 and 487. In an exemplary embodiment, pivoting member 450 includes sleeve 489. Sleeve 489 is fabricated from a material having a relatively high coefficient of friction such as rubber. Other suitable materials may be used to fabricate sleeve 489. Body member 480 is frictionally disposed within sleeve 489. As shown in FIG. 13, body member 480 has sections 490 and 491 that are not covered by sleeve 489. The curved side 488 of body member 480 provides pivoting member 450 with a curved exterior side 492. When pivoting member 450 is in the position shown in FIGS. 5 and 6, curved exterior side 492 firmly and frictionally contacts belt section 204.

Figure 10:
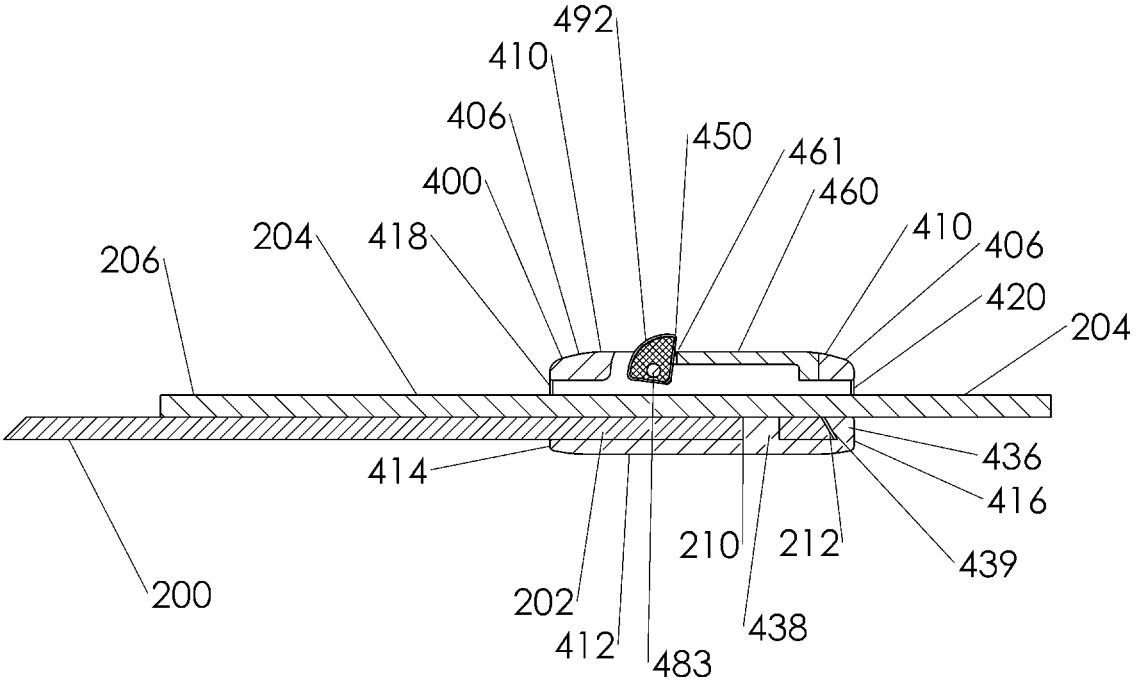
FIG. 10 is another cross-sectional view of the belt and belt buckle, the view being similar to the view of FIG. 6 but instead shows the pivoting member in a second position wherein the pivoting member does not physical contact the movable belt section.

Referring to FIGS. 5 and 6, belt section 204 is within interior region 404 and free end 206 of belt 200 extends from opening 418 in buckle end 414. Tensile forces or stress on belt 200 produce a downward pulling force on pivoting member 450 which causes curved exterior side 492 to firmly and frictionally contact the portion of belt section 204 that is within interior region 404. Specifically, it is sleeve 489 that firmly and frictionally contacts or engages the portion of belt section 204. Due to the shape, size, structure and configuration of pivoting member 450, belt section 204 cannot be pulled in direction 352 when pivoting member 450 is in the position shown in FIGS. 5 and 6. In order to position pivoting member 450 to the second position, the wearer moves belt section 204 in direction 350. Due to the frictional contact between pivoting member 450 and belt section 204, the movement of belt section 204 in direction 350 pivots the pivoting member 450 to the second position as shown in FIG. 10. The wearer may then move belt section 204 in either direction 350 or direction 352.

Figure 8:
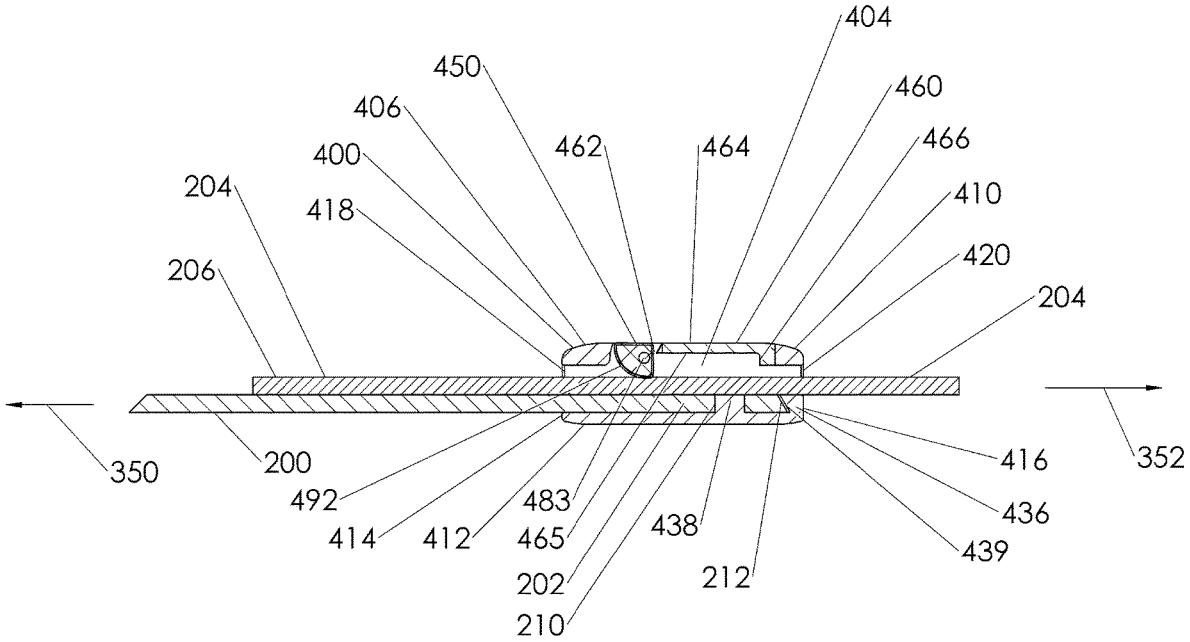
FIG. 8 is a cross-sectional view taken along line 8-8 in FIG. 7, the view showing a pivoting member in a first position wherein the pivoting member contacts the movable belt section.
Figure 9:
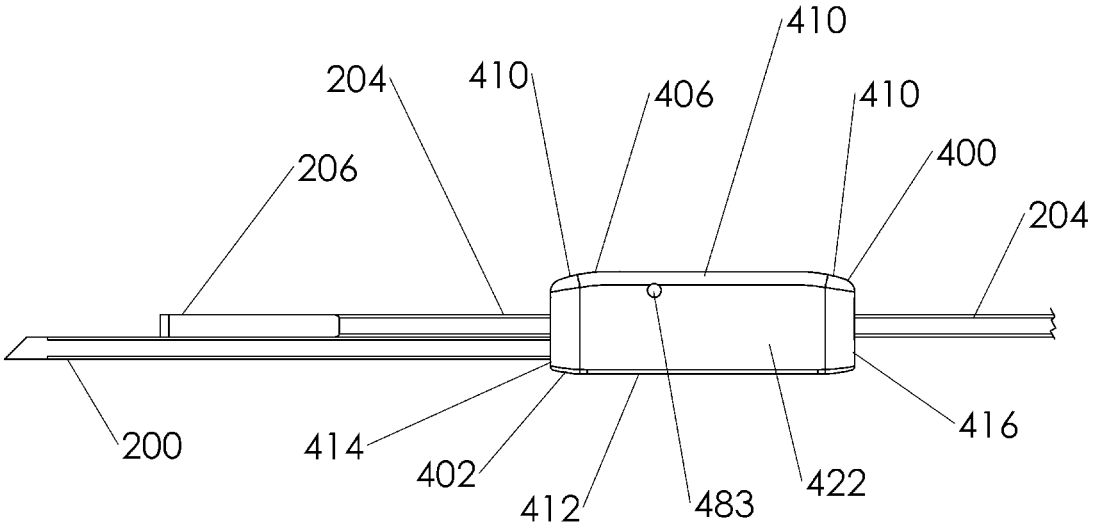
FIG. 9 is a side view of the belt buckle and belt.

In order to use belt 200, the wearer or user wraps belt 200 around his or her waist. The wearer then inserts free end 206 of belt 200 through opening 420 in buckle end 416 and feeds intermediate belt section 204 through belt buckle 400 so that free end 206 exits opening 418 in buckle end 414. Since the wearer is moving the belt section 204 in direction 350, the pivoting member 450 will be pivoted to the second position as shown in FIG. 10. The wearer continues to pull more of intermediate belt section 204 through belt buckle 400 until the wearer is comfortable with the tightness of belt 200 around his or her waist. Once the wearer is comfortable with the tightness of belt 200 around his or her waist, the wearer stops pulling belt section 204 through belt buckle 400 and then pivots the pivoting member 450 in the first direction to the first position as shown in FIGS. 5 and 8 so that pivoting member 450 makes contact with belt section 204. The wearer's waist and clothing create tensile forces or tension on belt 200 which cause pivoting member 450 to be pulled downward as shown in FIG. 6. Once pivoting member 450 is in the position shown in FIG. 6, the pivoting member 450 is in firm, frictional contact with belt section 204 thereby preventing the belt section 204 from moving in direction 352.

As shown in FIGS. 11-13, sleeve 489 is tightly positioned on body member 480 and covers all of body member 480 except sections 490 and 491. In one embodiment, body member 480 is shaped and configured so that sleeve 489 is flush with sections 490 and 491. Such a configuration allows for clearance between pivoting member 450 and belt section 204 when pivoting member 450 is in the second position.

In some embodiments, pivoting member 450 does not have sleeve 489. When sleeve 489 is not used, curved side 488 of body 480 (see FIG. 14) directly contacts belt section 204 when pivoting member 450 is in the first position.

Referring to FIGS. 3-5, in some embodiments of the invention, belt buckle 400 includes friction pads 500 and 502 that are fixed or attached to bottom surface 435 of buckle body 402. In one embodiment, friction pads 500 and 502 are adhered to bottom surface 435. In one embodiment, friction pads 500 and 502 are fabricated from rubber. Friction pads 500 and 502 are frictionally fitted within corresponding openings in belt end 202. As shown in FIG. 5, friction pads 500 and 502 are substantially aligned with pivoting member 450. In one embodiment, friction pads 500 and 502 are aligned with pin member 483. Movable belt section 204 is disposed over belt end 202. The function of friction pads 500 and 502 is to receive the force created when pivoting member 450 firmly and frictionally contacts belt section 204. When pivoting member 450 firmly and frictionally contacts belt section 204, the force produced by the frictional contact causes the portion of belt section 204 directly under pivoting member 450 to be pressed against friction pads 500 and 502, not belt end 202. Such a configuration ensures that the frictional contact between pivoting member 450 and belt section 204 remains firm and tight throughout many uses of belt 200 and belt buckle 400.

In some embodiments, belt buckle 400 does not have friction pad members 500 and 502.

In an alternate embodiment, pivoting member 450 is configured and sized to provide a relatively light degree of physical contact between pivoting member 450 and belt section 204 when pivoting member 450 is in the second position. Thus, in such an alternate embodiment, there is no clearance between pivoting member 450 and belt section 204 when pivoting member 450 is in the second position. The light degree of physical contact between pivoting member 450 and belt section 204 when pivoting member 450 is in the second position does not impede movement of belt section 204 through buckle 400 in direction 350. However, the light degree of physical contact between pivoting member 450 and belt section 204 when pivoting member 450 is in the second position is sufficient to cause pivoting member 450 to pivot to the first position if belt section 204 moves in direction 352. In order for a wearer to move belt section 204 in direction 352 to either loosen belt 200 or remove belt 200, the wearer must hold pivoting member 450 in the second position. Once the wearer releases pivoting member 450, any movement of belt section 204 in direction 352 will cause pivoting member 450 to pivot to the first position.

Referring to FIGS. 15-17, there is shown belt buckle 600 in accordance with another exemplary embodiment of the present invention. Belt buckle 600 comprises buckle body 602. Buckle body 602 has the same structure, shape and configuration as buckle body 402 which was described in the foregoing description and shown in FIG. 3. Buckle body 602 comprises top side 603. Top side 603 includes peripheral portion 604. In an exemplary embodiment, belt buckle 600 includes friction pads 610 and 612 that are fixed to the interior, bottom surface 614 of buckle body 602. Friction pads 610 and 612 provide the same function as friction pads 500 and 502 described in the foregoing description and shown in FIG. 3. Belt buckle 600 further comprises pivoting member 650 that has the same structure, shape and configuration as pivoting member 450 which was described in the foregoing description. Pivoting member 650 comprises pin member 652 that is attached to buckle body 602 and allows pivoting member 650 to pivot in the same manner and directions as pivoting member 450. Pivoting member 650 provides the same function as pivoting member 450. Belt buckle 600 further comprises cover 670. Cover 670 is configured to be removably attached to buckle body 602 in generally the same way that cover 460 is removably attached to buckle body 402. Cover 670 is frictionally fitted within peripheral portion 604 of buckle body 602. Cover 670 comprises a light assembly which comprises switch button 672, light emitting device 674, transparent light cover 676, battery holder 678 and battery 680. Battery 680 fits into battery holder 678. Cover 670 is configured to include compartment 685 on the bottom side thereof. Compartment 685 is sized to receive batter holder 678 with battery 680. Also located within compartment 685, but not visible, are electrical wires, the light switch and the electrical wires or leads of light emitting device 674. The light emitting device 674, battery 680, light switch, and electrical wires form an electrical circuit. Any suitable electrical switch known in the art can be used to realize the aforementioned light switch. Switch button 672 is movably positioned within opening 690 in cover 670 and is attached to the light switch located in compartment 685. Transparent light cover 676 is sized to frictionally fit within opening 692 in cover 670. A wearer can activate the light emitting device 674 by pushing switch button 672 in the proper position. Light emitting device 674 can be configured as a light-emitting diode (LED) or any other suitable light-emitting device. In other embodiments, the light-emitting device 674 can be configured to be a flashing light, or mini-strobe light or a non-flashing light. Light-emitting device 674 can be configured to provide different color lights. In some embodiments, bottom side of cover 670 includes structure 700 that allows cover 670 to be frictionally fitted within peripheral portion 604 of buckle body 602.

Referring to FIGS. 18-25 and 29, there is shown belt buckle 800 in accordance with another embodiment of the present invention. Belt buckle 800 may be used with belt 200 which has been described in the foregoing description. Belt buckle 800 comprises buckle structure 802. Buckle structure 802 comprises a pair of upstanding and opposing sidewalls 804 and 806 and base section 808. Opposing sidewalls 804 and 806 are attached to the base section 808. Buckle structure 802 includes support structure 807 which is attached to sidewalls 804 and 806. Base section 808 includes belt-receiving surface 809 over which a free or movable end 204 of belt 200 may pass. Sidewalls 804 and 806 are spaced apart and belt-receiving surface 809 is between sidewalls 804 and 806. In an exemplary embodiment, surface 809 is substantially flat. Buckle structure 802 further comprises belt-retaining section 810 that is movably attached to base section 808. Section 810 is described in detail in the ensuing description. Belt buckle 800 further comprises pivoting member 812. Pivoting member 812 has the same purpose and function as pivoting member 450 (see FIG. 5). Pivoting member 812 is pivotably attached to opposing sidewalls 804 and 806 at a predetermined position such that there is space 813 under pivoting member 812. As shown in FIGS. 18 and 19, space 813 is between pivoting member 812 and base section 808. Pivoting member 812 comprises body section 814. Body section 814 has a shape that is similar to the shape of body section 480 of pivoting member 450 (see FIGS. 11-13) except for the differences described in the ensuing description. Body section 814 has a longitudinally extending bore 815 therein (see FIG. 29). Pivoting member 812 includes pin member 816 that is disposed within longitudinally extending bore 815. In an exemplary embodiment, pin member 816 is fabricated from metal. Pin member 816 has the same function and shape as pin member 483 of pivoting member 450 (see FIGS. 1, 3 and 5). Pin member 816 comprises a first end that is visible at opening 818 in sidewall 804. Pin member 816 further comprises an opposite second end that is visible at opening 820 of sidewall 806. Such a configuration allows pivoting member 812 to pivot with respect to opposing sidewalls 804 and 806. Referring to FIG. 29, body section 814 comprises a first longitudinally extending generally flat side 830, a second longitudinally extending generally flat side 832 that is contiguous with the first longitudinally extending generally flat side 830 and a longitudinally extending curved side 836 that is contiguous with both the first longitudinally extending generally flat side 830 and the second longitudinally extending generally flat side 832. In an exemplary embodiment, longitudinally extending curved side 836 includes serrated or toothed surface 838 which contacts a portion of belt 200 as will be described in the ensuing description. Pivoting member 812 is pivotable to a first position such that serrated surface 838 firmly contacts movable section 204 of belt 200 when movable section 204 is positioned between opposing sidewalls 804 and 806 so as to prevent movement of movable section 204 in first direction 352 that would cause loosening of belt 200. Tensile force on belt 200 while serrated surface 838 frictionally contacts movable belt section 204 increases the degree of frictional contact between serrated surface 838 and movable belt section 204 located between opposing sidewalls 804 and 806. Pivoting member 812 is pivotable to a second position wherein no portion of pivoting member 812 physically contacts movable belt section 204 that is located between opposing sidewalls 804 and 806 so that there is clearance between pivoting member 812 and movable belt section 204. When pivoting member 812 is in the first position, movement of movable belt section 204 in an opposite second direction 350 causes pivoting member 812 to pivot to the second position such that curved side 836 of pivoting member 812 no longer physically contacts movable belt section 204 that is located between opposing sidewalls 804 and 806 thereby providing a clearance between the pivoting member 812 and movable belt section 204. This clearance allows movable belt section 204 to be moved in either first direction 352 or in opposite second direction 350.

Referring to FIGS. 19-23, base section 808 includes extending section 840 that extends beyond opposing sidewalls 804 and 806 and includes surface 841 (see FIG. 29) that is contiguous with belt-receiving surface 809. Extending portion 840 further includes longitudinally extending channel 842 that is sized for receiving pin member 844. In an exemplary embodiment, extending portion 840 is configured with longitudinally extending slot-shaped opening 845 which allows viewing of pin member 844 positioned within channel 842. Pin member 844 comprises first end 846 and second end 848. First end 846 extends through one side of extending portion 840 and opposite second end 848 extends through the opposite side of extending portion 840. In an exemplary embodiment, pin member 844 is fabricated from metal. In some embodiments, extending portion 840 does not have slot-shaped opening 845.

Referring to FIGS. 18-23, belt buckle 800 further comprises belt guide member 850 which facilitates placement of belt section 204 through belt buckle 800. Belt guide member 850 comprises frame 852 that includes substantially straight section 854, substantially straight section 856 and section 857 that is joined or attached to sections 852 and 854. In an exemplary embodiment, section 857 is curved. Frame 852 includes support member 858 that is attached to sections 854 and 856. Frame 852 further comprises arm section 860 which is attached to straight section 854. Arm section 860 includes channel 861 that is sized to receive first end 846 of pin member 844. Similarly, frame 852 includes arm section 862 which is attached to straight section 856. Arm section 862 includes channel 863 that is sized to receive opposite second end 848 of pin member 844. As a result of this configuration, belt guide member 850 is pivotably attached to portion 840 of base section 808. As shown in FIG. 30, free end 206 of belt 200 is inserted through belt guide member 850 so that belt section 204 is below section 857 of frame 852 and supported by support member 858. Belt section 204 extends through space 813 between pivoting member 812 and base portion 808 so that free end 206 is positioned over the section of belt 200 that is attached section 810 of buckle structure 802. In FIG. 29, pivoting member 812 is pivoted so that no portion of pivoting member 812 contacts the belt portion 204 that is between upstanding wall members 804 and 806. When pivoting member 812 is in this position, belt portion 204 can be moved either in direction 350 or in direction 352.

Referring to FIGS. 18 and 25-29, buckle structure 802 includes belt-retaining section 810 that is movably attached to base section 808. Section 810 includes top side 870, bottom side 872 and interior region 874 that is sized to receive an end of belt 200. Pins or similar fastening members (not shown) are inserted through openings 876 in bottom side 872 (see FIG. 21) and penetrate the end of belt 200 in order to rigidly attach the end of belt 200 to section 810. As shown in FIGS. 18 and 29, section 810 includes rear wall 880 which is visible through interior region 874. Rear wall 880 includes protruding portions 882 and 884 that are separated by a thru-hole (not shown) through which fastening device 886 extends (see FIGS. 27B and 29). Protruding portions 882 and 884 are sized to fit into corresponding channels 887 and 888, respectively, in base portion 808. Fastening device 886 includes head 890 which can be seen in FIG. 18. Fastening device 886 is disposed through spring 892 such that spring 892 is interposed between head 890 and rear wall 880. A notch is formed in the end of belt 200 before the end of belt 200 is inserted into interior region 874. The notch is sized to receive fastening device 886 and spring 892 thereby allowing the end of the belt 200 to be fully inserted into interior region 874. The notch may have any suitable shape, e.g. "V" shaped, "U" shaped, etc. Section 810 is attached to base portion 808 via fastening device 886 but the length of fastening device 886 is such that section 810 can bi-directionally move with respect to base portion 808, as indicated by arrows 900 and 902. Spring 892 urges section 810 in the direction indicated by arrow 902 so that protruding portions 882 and 884 are inserted into channels 887 and 888, respectively, as shown in FIGS. 18, 20 and 26. As a result of this configuration, a user can grasp section 810 and pull it outwardly in direction 900 and against the force of spring 892 as shown in FIG. 26, and then pivot section 810 as shown in FIGS. 27A, 27B and 28 so that section 810 is pivoted 180°. The user then releases section 810 so that the force of spring 892 pulls section 810 back in the direction 902 such that protruding portion 882 enters channel 888 and protruding portion 884 enters channel 887. As a result of this feature, the opposite side of belt 200 is now visible. This feature is very useful if belt 200 has a first color scheme on one side and a second color scheme on the opposite side. The user simply pulls section 810 outward and then pivots section 810 so that the desired color scheme will be visible. If the user changes the color scheme of his or her wardrobe, he or she can simply pivot section 810 so that the color scheme on the visible side of the belt matches his or her wardrobe. In an exemplary embodiment, one side of belt 200 is black and the other side of belt 200 is brown. However, it is to be understood that each side of belt 200 can have any color scheme.

Referring to FIGS. 31-38, there is shown belt buckle 1000 in accordance with another embodiment of the present invention. Belt buckle 1000 may be used with belt 200 which has been described in the foregoing description. Belt buckle 1000 comprises buckle structure 1002. Buckle structure 1002 comprises a pair of upstanding and opposing sidewalls 1004 and 1005 and base section 1006. Opposing sidewalls 1004 and 1005 are attached to base section 1006. Base section 1006 includes belt-receiving surface 1007 that extends between sidewalls 1004 and 1005. Free or movable belt section 204 passes over belt-receiving surface 1007. In an exemplary embodiment, belt-receiving surface 1007 is substantially flat. Belt buckle 1000 further comprises sidewall cover 1008 which is removably attached to sidewall 1004. The purpose and function of sidewall cover 1008 is described in the ensuing description. Buckle structure 1002 includes support structure 1009 which is attached to sidewalls 1004 and 1005. Belt buckle 1000 further comprises pivoting member 1014 which is pivotably attached to sidewalls 1004 and 1005. Pin member 1016 extends through a longitudinally extending bore (not shown) in pivoting member 1014. Pin member 1016 has the same function and shape as pin member 816 of pivoting member 812. Pin member 1016 has ends 1017 and 1018 (see FIG. 41). In an exemplary embodiment, pin member 1016 is fabricated from metal. Pivoting member 1014 has the identical structure, function and purpose of pivoting member 812 of belt buckle 800. Pivoting member 1014 includes serrated or toothed surface 1020 which has the identical structure, function and purpose as serrated surface 838 of pivoting member 812. As shown in FIGS. 31-33, pivoting member 1014 is attached to opposing sidewalls 1004 and 1005 at a predetermined position so as to provide space 1022 between pivoting member 1014 and base section 1006. Space 1022 is sized to allow belt section 204 to pass therethrough. Pivoting member 1014 is pivotable to a first position such that serrated surface 1020 firmly contacts movable section 204 of belt 200 when movable section 204 is positioned between opposing sidewalls 1004 and 1005 so as to prevent movement of movable section 204 in first direction 352 that would cause loosening of belt 200. Tensile force on belt 200 while serrated surface 1020 frictionally contacts movable belt section 204 increases the degree of frictional contact between serrated surface 1020 and movable belt section 204 located between opposing sidewalls 1004 and 1005. Pivoting member 1014 is pivotable to a second position wherein no portion of pivoting member 1014 physically contacts movable belt section 204 that is located between opposing sidewalls 1004 and 1005 so that there is clearance between pivoting member 1014 and movable belt section 204. When pivoting member 1014 is in the first position, movement of movable belt section 204 in an opposite second direction 350 causes pivoting member 1014 to pivot to the second position such that serrated surface 1020 no longer physically contacts movable belt section 204 that is located between opposing sidewalls 1004 and 1005 thereby providing a clearance between the pivoting member 1014 and movable belt section 204. This clearance allows movable belt section 204 to be moved in either the first direction 352 or in the opposite second direction 350.

Referring to FIGS. 34-37, base section 1006 includes extending portion 1030 that extends beyond opposing sidewalls 1004 and 1005. Extending portion 1030 has the same structure, function and purpose as extending portion 840 of buckle structure 802. Extending portion 1030 includes surface 1031 that is contiguous with belt-receiving surface 1007. Extending portion 1030 further includes longitudinally extending bore or channel that is sized for receiving pin member 1034. Pin member 1034 comprises first end 1036 and second end 1038. First end 1036 extends from one side of extending portion 1030 and opposite second end 1038 extends from the opposite side of extending portion 1030. In an exemplary embodiment, pin member 1034 is fabricated from metal. In an exemplary embodiment, extending portion 1030 has a slot-shaped opening 1039 therein to allow viewing of pin member 1034 (see FIG. 39).

Referring to FIGS. 31, 32 and 34-37, belt buckle 1000 further comprises belt guide member 1050 which facilitates placement of belt section 204 through belt buckle 1000. Belt guide member 1050 comprises an exterior side 1052, an interior side 1054, a first sidewall 1056 and an opposite sidewall 1058. Belt guide member 1050 includes front sidewall 1060 which has a recessed area 1062 (see FIG. 35) that is sized to allow belt section 204 to pass therethrough. In an exemplary embodiment, front wall 1060 has a curved shape. Belt guide member 1050 further includes support member 1064 that is attached to sidewalls 1056 and 1058. Support member 1064 and recessed area 1062 cooperate to facilitate insertion of belt section 204 into space 1022 that is between base portion 1006 and pivoting member 1014. Belt guide member 1050 includes first arm portion 1070 that includes a channel or bore (not shown) for receiving first end 1036 of pin member 1034. Belt guide member 1050 further includes second arm portion 1072 that includes a channel or bore (not shown) that is sized to receive opposite second end 1038 of pin member 1034. This configuration results in belt guide member 1050 being pivotally attached to extending portion 1030.

Referring to FIGS. 31-33 and 39, base portion 1006 includes interior region or space 1080 that is accessible through front opening 1082 which is located at the front of base portion 1006. Interior region or space 1080 is sized to receive an end of belt 200. Base portion 1006 further includes bottom side 1084 and lower front edge sections 1086 and 1088. Lower front edge sections 1086 and 1088 are near front opening 1082 and are separated by belt clasp 1092 which is described in detail in the ensuing description. Front edge section 1086 has a bore or channel therein that is substantially parallel to the longitudinally extending bore (not shown) in pivoting member 1014. Similarly, front edge section 1088 has a bore or channel therein that is substantially parallel to the longitudinally extending bore (not shown) in pivoting member 1014. The bore or channel in front edge section 1086 is coaxial with the bore or channel in front edge section 1088. Base portion 1006 further includes pin member 1090 that extends through the bores or channels in lower front edge sections 1086 and 1088. Base portion 1006 further includes belt clasp 1092 that is pivotally mounted to pin member 1090. Belt clasp 1092 has a channel or bore extending therethrough which is coaxial with the bores or channels in lower front edge sections 1086 and 1088. Pin member 1090 extends through the bore or channel in belt clasp 1092 such that belt clasp 1092 pivots about pin member 1090. Belt clasp 1092 further includes exterior side 1094, interior side 1096, cut-out or notch 1098 and teeth or protruding members 1100 that are attached to interior side 1096. Referring to FIG. 39, bottom side 1084 of base portion 1006 has an area or region cut out so as to form opening 1102 that leads to interior region or space 1080 and ledge 1104. Belt clasp 1092 is pivotable to a closed position, as shown in FIGS. 31-33 and 35, and to an open position, as shown in FIG. 39. When in the closed position, belt clasp 1092 is positioned within opening 1102 such that interior side 1096 contacts ledge 1104 and exterior side 1094 is substantially flush with bottom side 1084 of base portion 1006. When belt clasp 1092 is in the closed position, teeth 1100 protrude into interior space or region 1080. When belt clasp 1092 is fully open, teeth 1100 are outside of interior region or space 1080. In order to attach the end of belt 200 to belt buckle 1000, the user must first pivot belt clasp 1092 to the open position. In order to pivot belt clasp 1092 to the open position, the user inserts a portion of his finger or finger nail into notch 1098 and then lifts belt clasp 1092 out from opening 1102 and pivots belt clasp 1092 until teeth 1100 are no longer within interior region or space 1080 (see FIG. 39). The user then inserts the end of belt 200 into interior region or space 1080 and then pivots belt clasp 1092 to the closed position, applying enough force so teeth 1100 penetrate the end of the belt 200. The user continues to apply force to belt clasp 1092 until teeth 1100 fully penetrate the end of belt 200 and belt clasp 1092 is completely positioned within opening 1102.

Referring to FIG. 41, there is shown a side view buckle structure 1000 without sidewall cover 1008. Sidewall 1004 has opening 1200 therein that provides access to interior compartment 1202. Interior compartment 1202 is sized to receive electronic circuitry and components for the different accessories described in the ensuing description. As shown in FIGS. 31 and 40, sidewall cover 1008 includes exterior side 1204, interior side 1206 and central opening 1208. Sidewall cover 1008 also includes cavities 1210 and 1212 on interior side 1206. Cavity 1210 is sized to receive an end of pin member 1016. Cavity 1212 is sized to receive an end of pin member 1090. Sidewall cover 1008 is completely attached to sidewall 1004 when ends of pin members 1016 and 1090 are completely inserted into cavities 1210 and 1212, respectively. Sidewall cover 1008 obscures the view of interior compartment 1202 when sidewall cover 1008 is attached to sidewall 1004. As shown in FIGS. 35 and 40, sidewall cover 1008 includes bottom edge 1214 which has notch 1216. Notch 1216 facilitates removal of sidewall cover 1008 from sidewall 1004. For example, a user may insert a tool, such as a screw driver, to pry sidewall cover 1008 away from sidewall 1004 so that the ends of pin members 1016 and 1090 become dislodged from cavities 1210 and 1212, respectively.

Referring to FIGS. 31, 36, 41 and 42, in some embodiments, belt buckle 1000 includes a built-in light circuit 1300 that comprises battery 1302, light-emitting device 1303, switch 1304 and wires 1305 and 1306. Light circuit 1300 includes printed circuit board 1307. Light-emitting device 1303 and switch 1304 are mounted and electrically connected to printed circuit board 1307. Wires 1305 and 1306 electrically connect battery 1302 and printed circuit board 1307. In some embodiments, battery 1302 has a rectangular shape and is sized to fit into interior compartment 1202. Printed circuit board 1307 is positioned against interior side 1206 of sidewall cover 1008 such that switch 1304 is positioned within opening 1208 and light-emitting device 1303 is adjacent to opening 1310 in sidewall cover 1008 (see FIG. 31). Light emitted by light-emitting device 1303 passes through opening 1310. In one embodiment, light-emitting device 1303 comprises a LED (light emitting diode). In another embodiment, light-emitting device 1303 is configured as a flashing light. In a further embodiment, light-emitting device 1303 is configured as a strobe light. In yet another embodiment, light-emitting device 1303 comprises an infrared light.

Referring to FIGS. 43 and 44, in some embodiments, belt buckle 1000 includes an item separation alarm circuit that alerts the user when an item is outside of a predetermined distance from the user. The item can be any object or device including, but not limited to, smart phone, car keys, wallet, purse, eyeglasses, sunglasses, laptop computer, etc. In an exemplary embodiment, the electronic circuit components of the item separation alarm circuit are mounted to printed circuit board 1307 which was described in the foregoing description. The item separation alarm circuit comprises receiver circuit 1400, antenna 1402 and alarm device 1404. Receiver circuit 1400 and alarm device 1404 are mounted and electrically connected to printed circuit board 1307. Antenna 1402 receives radio frequency (RF) signals and provides these RF signals to receiver circuit 1400. In one embodiment, antenna 1402 is embedded in the belt used with belt buckle 1000. Such an embodiment is shown in FIGS. 44 and 45. Belt 1500 comprises leather layer 1502 and leather layer 1504. Leather layers 1502 and 1504 are stitched together via stitching 1506. Antenna 1402 is sandwiched between leather layers 1502 and 1504. In FIG. 45, antenna 1402 is shown in phantom. In some embodiments, antenna 1402 extends for substantially the entire length of belt 1500. In some embodiments, there is more than one antenna sandwiched between leather layers 1502 and 1504. In one exemplary embodiment, there are two antennae sandwiched between leather layers 1502 and 1504 wherein one antenna is for Bluetooth® communications and the other antenna is for WiFi.

In some embodiments, alarm device 1404 is any suitable device that is configured to produce audible sounds in response to particular electronic signals received from receiver circuit 1400. Such audible sounds include continuous tones, intermittent tones, chirping sounds, a series of sounds with different audio frequencies, warbler sound, siren sound, etc. Alarm device 1404 may include such circuits or devices such as an audio signal generator, audio speaker, buzzer or piezo buzzer, etc. In an exemplary embodiment, switch 1304 controls both light-emitting device 1303 and receiver circuit 1400. For example, pressing switch 1304 a first time will activate only light circuit 1300. Pressing switch 1304 a second time will activate only the item separation alarm circuit. Pressing switch 1304 a third time will activate both light circuit 1300 and item separation alarm circuit. Pressing switch 1304 a fourth time will deactivate both light circuit 1300 and item separation alarm circuit. In an exemplary embodiment, receiver circuit 1400 includes a RFID (radio-frequency identification) reader that is configured to sense the presence of active RFID tags that are attached to and associated with the various aforementioned items, e.g. car keys, smart phone, wallet, etc. Receiver circuit 1400 monitors these aforementioned items to ensure that the user did not misplace or lose the items. Specifically, receiver circuit 1400 is configured to monitor the items by periodically sensing the presence of the items and alerts the user, via alarm device 1404, if it is determined that (1) one of the items being monitored can no longer be detected, or (2) if it detects the absence of an item that is typically present at a certain time, date or location.

In some embodiments, alarm device 1404 is configured to generate vibrations when particular electronic signals are received from receiver circuit 1400.

In some embodiments, battery 1302 is rechargeable by a wireless charger.

In some embodiments, belt buckle 1000 includes a charging port built into buckle structure 1002 to allow charging of battery 1302.

In an exemplary embodiment, battery 1302 comprises a lithium battery.

In an exemplary embodiment, the aforementioned item separation alarm circuit used in belt buckle 1000 is modeled after the electronic circuitry and monitoring device described in U.S. Pat. No. 9,489,821, entitled "Device and Method for Monitoring the Presence of an Item". The entire disclosure of U.S. Pat. No. 9,489,821 is hereby incorporated by reference into this present application.

In some embodiments, the aforementioned item separation alarm circuit used in belt buckle 1000 utilizes the receiver unit described in U.S. Pat. No. 7,106,191, entitled "Child Distance Monitoring and Alerting System". The entire disclosure of U.S. Pat. No. 7,106,191 is hereby incorporated by reference into this present application. In this embodiment, transmitter units are attached to the items being monitored, e.g. wallet, purse, car keys, smart phone, etc., and may also be attached to a child in order to monitor the distance the child is from the parent.

In some embodiments, the aforementioned item separation alarm circuit used in belt buckle 1000 is configured to function as the wireless item loss prevention system described in U.S. Pat. No. 9,779,612, entitled "Wireless Item Loss Prevention System". The entire disclosure of U.S. Pat. No. 9,779,612 is hereby incorporated by reference into this present application.

In some embodiments, the aforementioned item separation alarm circuit used in belt buckle 1000 is configured to function as the device described in U.S. Pat. No. 8,810,392, entitled "Device and Method for Monitoring the Presence of Items and Issuing an Alert If an Item Is Not Detected." The entire disclosure of U.S. Pat. No. 8,810,392 is hereby incorporated by reference into this present application.

In some embodiments, the aforementioned item separation alarm circuit used in belt buckle 1000 comprises a transceiver circuit that is configured to receive and transmit radio frequency (RF) signals and a plurality of transceiver circuits attached to corresponding items that are to be monitored, e.g. car keys, wallet, smart phone, etc. In such an embodiment, the transceiver circuit in belt buckle 1000 transmits a signal that is received by the transceiver attached to the item (e.g. laptop computer). When the transceiver attached to the item receives the signal, that transceiver generates an audible alert signal in the form of an audio signal which aids the user in determining the location of the item. Examples of audio signals include chirp sounds, buzzer sounds, whistle sounds, etc. The transceiver circuit attached to the item periodically transmits a signal in accordance with a predetermined repetition rate. The transceiver in belt buckle 1000 will receive this signal provided the item is within a predetermined distance from the user. When the transceiver in belt buckle 1000 no longer receives the signal transmitted by the transceiver attached to the item, the transceiver in belt buckle 1000 generates an alert that informs the user that the item is outside of a predetermined distance. The audible alert signal can be in the form of an audio signal, e.g. siren, chirp, buzzer, etc.

In another embodiment, additional radio frequency (RF) circuitry (not shown) is mounted and electrically connected to printed circuit board 1307 and is also electrically connected to antenna 1402. The additional radio frequency (RF) circuitry is in radio frequency (RF) communication with a smart phone via a smart phone App. In such an embodiment, the smart phone App allows the user to control the light circuitry and item separation alarm circuitry shown in FIG. 43.

In another embodiment, Bluetooth® circuitry is mounted and electrically connected to printed circuit board 1307 and is also electrically connected to antenna 1402. In this embodiment, a smart phone communicates with the Bluetooth® circuitry which is in RF communication with antenna 1402. This configuration increases WiFi coverage.

In some embodiments, belt buckle 1000 includes a commercially available compass (not shown) that is attached to exterior side 1052 of belt guide 1050.

Referring to FIGS. 46-48, there is shown belt guide member 1600 in accordance with another exemplary embodiment of the present invention. Belt guide member 1600 may be used in place of belt guide member 850 which was described in the foregoing description. Belt guide member 1600 comprises frame 1602 that includes a first side section 1604, opposite second side section 1605 and front side 1606. Frame 1602 includes transverse support member 1608 that is attached to first side section 1604 and opposite second side 1605. Transverse support member 1608 performs the same function as support member 858 shown in FIG. 29 and described in the foregoing description. First side section 1604 includes first arm section 1610 which has channel 1612 that is sized to receive first end 846 of pin member 844 which was described in the foregoing description (see FIG. 29). Second side section 1605 further includes second arm section 1614 which has channel 1616 that is sized to receive opposite end 848 of pin member 844 (see FIG. 29). Belt guide member 1600 further comprises support panel member 1622 which has exterior side 1624, interior side 1626 and compass 1628 that is attached, joined or mounted to interior side 1626. In one embodiment, interior side 1626 includes a square-shaped recess sized to receive compass 1628. In one embodiment, the compass 1628 is adhesively bonded to interior side 1626. In another exemplary embodiment, the compass 1628 is integral with support panel member 1622. Frame 1602 further includes panel member 1630 which is integral with side section 1604, opposite side section 1605, first arm section 1610 and second arm section 1614. Panel member 1630 has cavity or hole 1632 that is sized to receive protruding member or tab 1633 on interior side 1626. In some embodiments, support panel member 1622 is pivotably or hingedly attached to panel member 1630 via hinge member 1634. Hinge member 1634 is partially positioned within cavity or recess 1636 and pivots about a hinge pin (not shown) that is positioned within cavity or recess 1636. In an exemplary embodiment, the hinge pin is fabricated from metal. In some alternate embodiments, the hinge pin is integral with support panel member 1630.

As shown in FIG. 48, compass 1628 is positioned in the open position. In order to configure compass 1628 to the closed position, the user uses his or her fingers to push support panel member 1622 down so that protruding member or tab 1633 enters cavity 1632. In an exemplary embodiment, protruding member or tab 1633 is sized so that it frictionally fits into cavity 1632. In some embodiments, protruding member or tab 1633 is configured and sized to snap into cavity 1632. FIGS. 46 and 47 show compass 1628 in the closed position. In order to open compass 1628, the user positions his or her finger at edge 1640 of support panel 1622 and then pries support panel 1622 outward so that protruding member or tab 1633 is forced out of cavity 1632. Once protruding member or tab 1633 is forced out from cavity 1632, the user continues to pivot support panel 1622 outward until it is positioned as shown in FIG. 48. In some embodiments, there are two hinge members 1634. In some embodiments, hinge member 1634 is not used. Instead, a piece of resilient material is attached to support panel 1622 and panel 1630 such that support panel 1622 can pivot with respect to panel 1630. Examples of resilient material include, but are not limited to, soft plastic, wire, spring metal and fabric. In some embodiments, belt guide member 1600 does not include panel member 1630. In such an embodiment, support panel 1622 is pivotably attached to side section 1605 and cavity 1632 is formed in side section 1604.

Free end 206 of belt 200 is inserted through belt-guide member 1600 so that the belt section 204 is below panel member 1630 and supported by transverse support member 1608.

Referring to FIG. 49, in some embodiments, belt-buckle 1000 includes electronic circuit 1700 that includes wireless communication circuits. Electronic circuit 1700 comprises Bluetooth Low Energy (BTLE) circuit 1702 and microcontroller (MCU) 1704. BTLE circuit 1702 is in electronic signal communication with receiver circuit 1706 and transmitter circuit 1708. BTLE circuit 1702 is also in electronic signal communication with MCU 1704. MCU 1704 is electronically coupled to BTLE SCAN button or switch 1710 and is also electronically coupled to POWER button or switch 1712. BTLE SCAN switch 1710 and POWER switch 1712 are mounted or attached to the exterior of buckle structure 1000 so that switches 1710 and 1712 are accessible to the user. Pressing Power switch 1712 activates electronic circuit 1700. BTLE SCAN switch 1710 is used to set BTLE circuit 1702 to the "Track Mode" which is described in the ensuing description. Electronic circuit 1700 includes buzzer device 1714 and battery 1716. Battery 1716 provides electrical power to BTLE circuit 1702, MCU 1704, receiver circuit 1706, transmitter circuit 1708 and buzzer device 1714. In an exemplary embodiment, battery 1716 is a lithium battery. Electronic circuit 1700 further comprises charging circuit 1730 which is electrically coupled to battery 1716, USB port 1718 and port 1732. Charging circuit 1730 contains electronic components that receive an external voltage via USB port 1718 and conditions this voltage so it can be used to charge battery 1716 and charge smart phone 1800. In order for charging circuit 1730 to charge smart phone 1800, smart phone 1800 is connected to port 1732 via a cable (not shown). The cable provides the voltage outputted by charging circuit 1730 to the smart phone 1800. Ports 1718 and 1732 are mounted, attached or joined to locations on buckle structure 1000 so that ports 1718 and 1732 can be easily accessed by a user.

In an exemplary embodiment, BTLE circuit 1702, MCU 1704, receiver circuit 1706, transmitter circuit 1708, BTLE SCAN switch 1710, POWER switch 1712, buzzer device 1714 and battery 1716 are mounted on circuit board 1720. In another exemplary embodiment, sidewall cover 1008 (see FIG. 31) is replaced by a modified cover member (not shown) that does not have a central opening, such as central opening 1208, but which does have an interior or rear side (not shown) that is similar to interior side 1206 of sidewall cover 1008. Circuit board 1720 is mounted to the rear or interior side of the modified cover member. Although BTLE SCAN switch 1710 and POWER switch 1712 are mounted to circuit board 1720, portions of these switches 1710 and 1712 protrude through corresponding openings (not shown) in the modified cover member so that a user has access to switches 1710 and 1712. Ports 1718 and 1732 can be attached, joined or mounted to any suitable location on buckle structure 1000.

Receiver circuit 1706 is configured to receive radio frequency (RF) signals from smart phone 1800. Transmitter circuit 1708 is configured to transmit RF signals to smart phone 1800. Smart phone 1800 is programmed with an app that allows smart phone 1800 to communicate with BTLE circuit 1702 such that BTLE circuit 1702 and smart phone 1800 become and function as paired devices. The smart phone app may be configured to operate with any operating systems, e.g. iOS, Android, etc. BTLE circuit 1702 is configured so that it can be set to scan for the paired mobile device, in this case smart phone 1800, in accordance with a set time interval, or by movement of either of the paired devices. Smart phone 1800 runs a mobile app (i.e. application) and transmits a pre-set BTLE beacon signal that is used to track the distance between smart phone 1800 and BTLE circuit 1702. This operation of the paired devices in this manner is referred to herein as the "default operation".

BTLE circuit 1702 and smart phone 1800 may be configured to operate in either a "Passive Mode" or a "Track Mode". The Passive Mode is actually the default operation described in the foregoing description. In the Passive Mode, BTLE circuit 1702 alerts the user via buzzer device 1714 when smart phone 1800 is no longer within a pre-set or predetermined distance from belt buckle 1000. Passive Mode can be activated or deactivated via the smart phone app.

In order to implement the Track Mode, the user either presses BTLE SCAN switch or button 1710 or uses the app to set smart phone 1800 to the Track Mode. In the Track Mode, BTLE circuit 1702 functions in a scan mode wherein the user will experience feedback from buzzer device 1714. Buzzer device 1714 produces a "buzzing sound" when MCU 1704 provides a voltage to the voltage input of buzzer device 1714. BTLE circuit 1702 outputs an electronic signal to MCU 1704 that determines when MCU 1704 will output the voltage as well as the magnitude of such voltage. As the magnitude of the voltage provided by MCU 1704 increases, the audio level of the "buzzing sound" increases as well. As the user moves closer to smart phone 1800, the voltage provided by MCU 1704 increases in magnitude thereby causing the audio level of buzzing device 1714 to increase so as to let the user know that he or she is getting close to the location of the smart phone 1800.

In some embodiments, buzzer device 1714 is configured to vibrate as well. In other embodiments, buzzer device 1714 is replaced with a vibratory device that produces vibrations when MCU 1704 provides a voltage to the input of the vibratory device. In the Track Mode, as the user gets closer to smart phone 1800, the magnitude of the voltage that MCU 1704 provides to the vibratory device increases thereby causing an increase in the magnitude of the vibrations produced by the vibratory device.

In an alternate embodiment, one or more antennae are printed on the exterior surface of the belt.

In an alternate embodiment, battery 1716 is charged wirelessly via suitable commercially available wireless charging components.

In a further embodiment, the belt is made from a material that absorbs heat from the sun and converts the absorbed heat into electrical power that can be used to charge battery 1716.

In another embodiment, the belt is made from a material that absorbs heat from the wearer's body and converts the absorbed heat into electrical power that can be used to charge battery 1716.

In an alternate embodiment, the belt is made from a material that generates electrical power as the belt bends and flexes. Such material is known as a wearable triboelectric nanogenerator or WTNG. Thus, as the wearer moves (e.g. run, walk, jog, etc.) and the belt bends and flexes, the belt generates electricity that can be used to charge battery 1716.

In another embodiment, the belt buckle of the present invention utilizes one or more solar cells that convert sunlight into electrical power that is used to charge battery 1716.

Referring to FIGS. 50A-E, there is shown belt buckle 2000 in accordance with another exemplary embodiment of the present invention. Belt buckle 2000 comprises buckle structure 2001. The structure of buckle structure 2001 is similar to the structure of buckle structure 802 described in the foregoing description with the exception that buckle structure 2001 includes bore or cavity 2017 in end 2040 (see FIG. 50D). The purpose of bore or cavity 2017 is described in the ensuing description. Buckle structure 2001 includes a pair of upstanding and opposing sidewalls 2002A and 2002B and belt-receiving surface 2003 that extends between sidewalls 2002A and 2002B. Sidewalls 2002A and 2002B are spaced apart by a predetermined distance so as to allow movable belt section 204 to pass therebetween and over belt-receiving surface 2003. Belt buckle 2000 includes pivoting member 2004 which has the same structure and function as pivoting member 812 described in the foregoing description. The pivoting member 2004 pivots about pin 2005. Pin 2005 has the same structure and function as pin 816 described in the foregoing description. Pivoting member 2004 is pivotable to a first position in which pivoting member 2004 physically contacts the free or movable end 204 of belt 200 that is located between opposing sidewalls 2002A and 2002B and positioned on belt-receiving surface 2003. Pivoting member 2004 is also pivotable to a second position in which no portion of pivoting member 2004 physically contacts the movable belt section 204 that is located between opposing sidewalls 2002A and 2002B and positioned on belt-receiving surface 2003.

Belt buckle 2000 further comprises belt guide member 2006 which has the same function and structure as belt guide member 850 which was described in detail in the foregoing description. Belt guide member 2006 pivots about pin 2007. Pin 2007 has the same function and structure as pin 844 which was described in the foregoing description.

Belt buckle 2000 further comprises belt retainer section 2008 that is movably attached to buckle structure 2001. Belt retainer section 2008 comprises body portion 2009 and clasp member 2010 that is pivotably attached to body portion 2009 via pivot pin 2011. Body portion 2009 includes rear wall 2012 which has protruding portions 2013 and 2014 which have the same structure as protruding portions 882 and 884 shown in FIGS. 27A and 27B. Body portion 2009 includes front wall 2015 (see FIG. 50C). Body portion 2009 further includes sleeve 2016 which is located on rear wall 2012 between protruding portions 2013 and 2014. Sleeve 2016 is sized to fit into bore or inlet 2017 formed in end 2040 of buckle structure 2001 (see FIG. 50D). Sleeve 2016 includes bore or passage 2018, opening 2020 and end portion 2022. Bore or passage 2018 extends through sleeve 2016 up to opening 2020. End portion 2022 has interior side 2024.

Referring to FIG. 50C, front wall 2015 of body section 2009 includes opening 2025 that is in communication with bore or passage 2018. Spring 2028 is disposed within bore or passage 2018. The diameter of spring 2028 is greater than the diameter of opening 2020 so that spring 2028 abuts interior side 2024. Fastener 2030 is disposed within spring 2028. Fastener 2030 includes head 2032 that has a diameter that is larger than the diameter of spring 2028 so that head 2032 does not pass through spring 2028. Thus, spring 2028 is interposed between head 2032 and interior side 2024 of end 2022. Head 2032 has a cavity or recess (not shown) that is configured to receive a tool such as a screw driver. In some embodiments, the aforesaid cavity or recess is configured to receive an Allen-type tool such as an Allen wrench. Fastener 2030 has portion 2036 that is configured to have sharp threads or cutting edges 2038 that easily penetrate the material from which buckle structure 2001 is made and become rigidly embedded in such material. In order to movably attach belt retainer section 2008 to buckle structure 2001, fastener 2030 and spring 2028 are inserted into opening 2025 in front wall 2015 of body portion 2009 so that fastener 2030 extends through spring 2028 and extends through opening 2020 in sleeve 2016 as shown in FIG. 50C. Spring 2028 and fastener 2030 are not shown in FIG. 50B in order to simplify the view of FIG. 50B.

Belt retainer section 2008 is then maneuvered so that sleeve 2016 is inserted into bore or cavity 2017 in end 2040 of buckle structure 2001. A tool is used to screw fastener 2030 into the material of buckle structure 2001 that is at the rear of bore or cavity 2017 so that threads or cutting edges 2038 become embedded in the aforesaid material. Fastener 2030 is only screwed into the material of buckle structure 2001 for a distance that is sufficient to movably attach belt retainer 2008 to buckle structure 2001 but yet allow spring 2028 to be elongated when a tensile force is applied. Spring 2028 normally urges belt retainer section 2008 against buckle structure 2001. Specifically, spring 2028 normally urges belt retainer section 2008 in the direction indicated by arrow 2060 such that protruding portions 2013 and 2014 are positioned within openings 2050 and 2052, respectively, in end 2040 of buckle structure 2001. Openings 2050 and 2052 are sized to receive protruding portions 2013 and 2014, respectively. As a result of this configuration, a user can grasp belt retainer section 2008 and pull it outwardly in the direction indicated by arrow 2062 thereby applying a tensile force to spring 2028 and then rotate belt retainer section 2008 one hundred eighty degrees in the same manner as section 810 is rotated (see FIGS. 27A, 27B and 28). The user then releases belt retainer section 2008 so that the force of spring 2028 pulls belt retainer section 2008 back in the direction 2060 so that protruding portions 2013 and 2014 enter openings 2052 and 2050, respectively. In order to rotate belt retainer section 2008 as described in the foregoing description, user need only pull belt retainer section 2008 outward in direction 2062 until protruding portions 2013 and 2014 clear openings 2050 and 2052, respectively. Then, the user may rotate belt retainer section 2008. A portion of sleeve 2016 always remains in bore or cavity 2017 while belt retainer section 2008 is pulled outward and rotated. The purpose of belt retainer section 2008 is described in detail in the ensuing description.

Referring to FIG. 50B, body portion 2009 includes top side 2070 and opposite bottom side 2071. Top side 2070 is between sidewall 2072 and sidewall 2074. Top side 2070 includes channel 2076 that is aligned with opening 2025 in front wall 2015. Channel 2076 facilitates insertion of spring 2028 and fastener 2030 through opening 2025 and into bore 2018 of sleeve 2016. Top side 2070 is sized to receive an end of belt 200. Clasp member 2010 includes top side 2080, bottom side 2082 and a plurality of teeth 2084 attached or joined to bottom side 2082. In some embodiments, teeth 2084 are integral with bottom side 2082. Bottom side 2082 has recess 2086 that enables a user to use his or her finger to lift clasp member 2010. In order to attach the end of belt 200 to belt retainer section 2008, a user lifts clasp member 2010 to the open position as shown in FIGS. 50A and 50B and positions the end of belt 200 on top side 2070. The user then closes clasp member 2010 so that teeth 2084 physically contact the end of belt 200 so that the end of belt 200 is firmly retained on top side 2070 by clasp member 2010. The configuration of body portion 2009 and clasp member 2010 cooperate to ensure that teeth 2084 forcibly contact the end of the belt 200 such that teeth 2084 deform the material of the end of belt 200.

If belt 200 has a first color scheme on one side and a second color scheme on the opposite side, belt retainer section 2008 allows a user to orient belt 200 to show the side of belt 200 having the desired color scheme. If belt retainer section 2008 is positioned as shown in FIG. 50A, then the user simply pulls belt retainer section 2008 outward in direction 2062 and then rotates belt retainer section 2008 one-hundred eighty (180) degrees so that the opposite side of belt 200 having the desired color scheme is visible. The user then releases belt retainer section 2008 so that spring 2028 pulls belt retainer section 2008 back toward end 2040 of belt structure 2001 and protruding members 2013 and 2014 enter openings 2052 and 2050, respectively, in end 2040. Therefore, if the user changes the color scheme of his or her wardrobe and wants to flip belt 200 to show the other side of belt 200 which will match the color scheme, he or she can simply pull belt retainer section 2008 outward, rotate it 180°, then release belt retainer section 2008 so spring 2028 pulls belt retainer section 2008 back toward end 2040. The other side of belt 200 is now visible. If the user changes his or her mind and wants the other side of belt 200 to be visible, then he or she simply pulls belt retainer section 2008 outward, rotates the belt retainer section 180°, then releases belt retainer section 2008 so spring 2028 pulls belt retainer section 2008 back toward end 2040 and protruding members 2013 and 2014 enter openings 2050 and 2052, respectively.

Referring to FIG. 50B, sidewall 2072 includes recessed or notched area 2090 that is configured to receive end portion 2092 of clasp member 2010. Similarly, sidewall 2074 includes recessed or notched area 2094 that is configured to receive end portion 2096 of clasp member 2010. Recessed areas 2090 and 2094 allow clasp member 2010 to be completely closed as shown in FIG. 50E.

Belt 200 may be fabricated from any one of variety of materials known in the art, e.g. leather, synthetic leather, plastic, resin, fabric, etc. Portions of belt buckles 400, 600, 800 and 1000 may be fabricated from any suitable materials such as plastic, resin, polymers, composite materials, metal, etc. Belt buckles 400, 600, 800, 1000 and 2000 may be configured to have different sizes for use with belts having different widths or thicknesses. Belt buckles 400, 600, 800, 1000 and 2000 may be configured with different colors and ornamental designs. Belt buckles 400, 600, 800, 1000 and 2000 may be worn with either side facing the wearer's torso. Reference in the specification to "an exemplary embodiment", "one embodiment", "an embodiment", "some embodiments" or "other embodiments" means that a particular feature, structure or characteristic described in connection with the embodiment is included in at least one embodiment of the invention. The appearances of the phrases "an exemplary embodiment", "one embodiment", "an embodiment", "some embodiments" or "other embodiments" in various places in the specification are not necessarily all referring to the same embodiment.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A belt buckle for use with a belt (200) having a first side and an opposite second side, the belt buckle comprising:

a buckle structure comprising a base having a belt-receiving surface over which a movable belt section (204) of a belt (200) may pass and a pair of upstanding and opposing sidewalls attached to the base and spaced apart such that a portion of the belt-receiving surface is between the opposing sidewalls, wherein the opposing sidewalls are spaced apart by a predetermined distance so as to allow the movable belt section (204) to pass therebetween and over the belt-receiving surface, the base further comprising an interior space that is located under the belt-receiving surface and which is sized to receive an end of a belt, the base further comprising a clasp device movably attached to the base, wherein the clasp device is movable to an open position to allow an end of the belt to be inserted into the interior space and to a closed position to retain the end of the belt within the interior space; and a pivoting member pivotally attached to the opposing sidewalls at a predetermined position such that there is a space between the pivoting member and the belt-receiving surface, the pivoting member comprising a body section having a longitudinally extending bore therein and a pin member disposed within the longitudinally extending bore, the pin member having a first end that extends from the longitudinally extending bore and is pivotally attached to one of the opposing sidewalls and an opposite second end that extends from the longitudinally extending bore and is pivotally attached to the other one of the opposing sidewalls, the body section comprising a first longitudinally extending generally flat side, a second longitudinally extending generally flat side that is contiguous with the first longitudinally extending generally flat side and a longitudinally extending curved side that is contiguous with both the first longitudinally extending generally flat side and the second longitudinally extending generally flat side, wherein the first and second longitudinally extending generally flat sides and the longitudinally extending curved side form a perimeter of the body section, the pivoting member being pivotable to a first position such that the curved side frictionally contacts a movable belt section (204) of belt (200) that is positioned over the belt-receiving surface and between the opposing sidewalls so as to prevent movement of the movable belt section (204) in a first direction (352) which would cause loosening of the belt, wherein a tensile force on the belt while the curved side is frictionally contacting the movable belt section (204) increases a degree of frictional contact between said curved side and the movable belt section (204) located between the opposing sidewalls, the pivoting member being pivotable to a second position wherein no portion of the pivoting member physically contacts the movable belt section (204) that is located between the opposing sidewalls so that there is clearance between the pivoting member and said movable belt section (204); and whereby when the pivoting member is in said first position, movement of the movable belt section (204) in an opposite second direction (350) causes the pivoting member to pivot to the second position such that said curved side of the pivoting member no longer physically contacts the movable belt section (204) that is located between the opposing sidewalls thereby providing a clearance between said pivoting member and the movable belt section (204) so as to allow the movable belt section (204) to be moved in either the first direction (352) or in the opposite second direction (350).

2. The belt buckle according to claim 1 wherein the clasp device comprises at least one tooth that is configured to penetrate the material from which the belt is fabricated, wherein the at least one tooth enters the interior space and penetrates the end of the belt that is positioned in the interior space when the clasp device is pivoted to the closed position and wherein the at least one tooth is withdrawn from the interior space when the clasp device is pivoted to the open position.

3. The belt buckle according to claim 1 wherein the base further comprises an extending section that has a surface that is contiguous with the belt-receiving surface but is not located between the opposing sidewalls, the belt buckle further comprising a belt guide member pivotally attached to the extending section for guiding the moveable belt section (204) to the space between the pivoting member and the belt receiving surface.

4. The belt buckle according to claim 3 wherein the extending section has a longitudinally extending bore that is substantially parallel to the longitudinally extending bore of the pivoting member and wherein the extending section includes a second pin member disposed within the longitudinally extending bore thereof, the second pin member having ends that extend from the extending section, wherein the belt guide member is pivotally attached to the ends of the second pin member.

5. The belt buckle according to claim 1 wherein the base includes a compartment therein and wherein one of the sidewalls has an opening that provides access to the compartment.

6. The belt buckle according to claim 5 further comprising a sidewall cover removably attached to the sidewall which has the opening that provides access to the compartment, the sidewall cover having an exterior side, an interior side and a light opening therein that is sized to allow light to pass therethrough.

7. The belt buckle according to claim 6 further comprising a built-in light circuit, the built-in light circuit comprising:

a battery positioned within the compartment;

a printed circuit board mounted to the interior side of the sidewall cover and being electrically connected to the battery;

a light-emitting device that is mounted and electrically connected to the printed circuit board; and a switch mounted to the sidewall cover and electrically connected to the printed circuit board, the switch having a first position that completes a circuit between the battery and the light-emitting device such that the light-emitting device produces light that passes through the light opening and a second position which breaks the circuit between the battery and the light-emitting device so as to prevent the light-emitting device from producing light.

8. The belt buckle according to claim 7 wherein the sidewall cover includes an additional opening and wherein the switch is positioned within the additional opening.

9. The belt buckle according to claim 7 further comprising an item separation alarm circuit that is electrically connected to the printed circuit board, the item separation alarm circuit comprising:

a receiver circuit configured to receive signals from an active RFID tag that is attached to a personal item and to generate an alarm activation signal when the distance between the user and the personal item exceeds a predetermined distance;

an antenna to detect signals from the active RFID tag and couple the detected signals to the receiver circuit; and an alarm device in electrical signal communication with the receiver circuit and configured to produce an audio alert when the receiver generates an alarm activation signal.

10. The belt buckle according to claim 9 wherein the antenna is embedded within the belt.

* * * * *